US009791819B2

(12) United States Patent
Ikeda et al.

(10) Patent No.: US 9,791,819 B2
(45) Date of Patent: Oct. 17, 2017

(54) END MEMBER, PHOTOSENSITIVE DRUM UNIT, DEVELOPING ROLLER UNIT, AND PROCESS CARTRIDGE

(71) Applicant: Mitsubishi Chemical Corporation, Chiyoda-ku (JP)

(72) Inventors: Shuichi Ikeda, Odawara (JP); Yohei Matsuoka, Odawara (JP); Yasunori Kawai, Odawara (JP); Susumu Taguchi, Odawara (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

(21) Appl. No.: 15/255,631

(22) Filed: Sep. 2, 2016

(65) Prior Publication Data

US 2016/0370750 A1 Dec. 22, 2016

Related U.S. Application Data

(63) Continuation of application No. PCT/JP2015/056434, filed on Mar. 4, 2015.

(30) Foreign Application Priority Data

| | | |
|---|---|---|
| Mar. 6, 2014 | (JP) | 2014-044368 |
| Jul. 10, 2014 | (JP) | 2014-142742 |
| Aug. 8, 2014 | (JP) | 2014-163057 |

(51) Int. Cl.
*G03G 15/00* (2006.01)
*G03G 21/18* (2006.01)

(52) U.S. Cl.
CPC ..... *G03G 15/757* (2013.01); *G03G 21/186* (2013.01); *G03G 21/1857* (2013.01)

(58) Field of Classification Search
CPC ..... G03G 15/757; G03G 21/1857
See application file for complete search history.

(56) References Cited

U.S. PATENT DOCUMENTS

| | | | |
|---|---|---|---|
| 5,903,803 | A | 5/1999 | Kawai et al. |
| 2003/0053823 | A1 | 3/2003 | Cho et al. |

(Continued)

FOREIGN PATENT DOCUMENTS

| | | |
|---|---|---|
| JP | 2875203 | 3/1999 |
| JP | 2003-120713 | 4/2003 |

(Continued)

OTHER PUBLICATIONS

International Search Report dated May 26, 2015 in PCT/JP2015/056434, filed on Mar. 4, 2015 ( with English Translation).

(Continued)

*Primary Examiner* — Erika J Villaluna
(74) *Attorney, Agent, or Firm* — Oblon, McClelland, Maier & Neustadt, L.L.P.

(57) ABSTRACT

An end member is disposed at an end portion of a columnar rotating body mounted on an image forming apparatus body. The end member includes a tubular bearing member and a shaft member held by the bearing member. The shaft member includes a shaft-like rotating shaft which is disposed coaxially to the bearing member, and which rotates around a shaft line with respect to the bearing member to move in a direction of the shaft line, and a tip end member which is disposed coaxially to the rotating shaft, and at which a rotating force receiving member having a tip end provided with an engaging member which engages with a driving shaft of the image forming apparatus body is disposed. A rotating force around the shaft line is transmitted to the rotating force receiving member, the rotating shaft, and the bearing member in order.

14 Claims, 54 Drawing Sheets

(56) References Cited

U.S. PATENT DOCUMENTS

| | | | |
|---|---|---|---|
| 2008/0260428 | A1 | 10/2008 | Ueno et al. |
| 2009/0317129 | A1 | 12/2009 | Abe et al. |
| 2011/0159970 | A1 | 6/2011 | Okabe |
| 2012/0201566 | A1 | 8/2012 | Abe et al. |
| 2013/0336674 | A1 | 12/2013 | Abe et al. |

FOREIGN PATENT DOCUMENTS

| | | |
|---|---|---|
| JP | 2008-233868 | 10/2008 |
| JP | 2010-2688 | 1/2010 |
| JP | 2011-133682 | 7/2011 |
| WO | WO 2012/113289 A1 | 8/2012 |

OTHER PUBLICATIONS

Written Opinion dated May 26, 2015 in PCT/JP2015/056434, filed on Mar. 4, 2015.

Japanese Institute of Invention and Innovation, Journal of technical Disclosure, No. 2010-502197, 2010, 18 pages.

END MEMBER, PHOTOSENSITIVE DRUM UNIT, DEVELOPING ROLLER UNIT, AND PROCESS CARTRIDGE

CROSS REFERENCE TO RELATED APPLICATION(S)

This application is a continuation of international application No. PCT/JP2015/056434 filed on Mar. 4, 2015 based upon and claiming the benefit of priorities of Japanese Patent Applications No. 2014-44368 filed on Mar. 6, 2014, No. 2014-142742 filed on Jul. 10, 2014 and No. 2014-163057 filed on Aug. 8, 2014, the contents of which are incorporated herein by reference in its entirety.

BACKGROUND OF THE INVENTION

1. Field of the Invention

The present invention relates to a process cartridge which is mounted on an image forming apparatus, such as a laser printer or a copying machine, a photosensitive drum unit which is disposed in the process cartridge, a developing roller unit, and an end member.

2. Description of the Related Art

In an image forming apparatus which is represented by a laser printer or a copying machine, a process cartridge which is attachable to and detachable from a body (hereinafter, referred to as an "apparatus body") of the image forming apparatus is provided.

The process cartridge is a member which forms contents to be expressed by letters or figures and transfers the contents to a recording medium, such as a paper sheet. Therefore, in the process cartridge, the photosensitive drum in which the transferred contents are formed is included, and various devices for forming the contents to be transferred by acting on the photosensitive drum are disposed together. Examples of these devices include a developing roller unit, a charging roller unit, and a device for performing cleaning.

The process cartridge is so configured that the same process cartridge is attached to and detached from the apparatus body for maintenance, or a new process cartridge is mounted on the apparatus body instead after disengaging an old process cartridge from the apparatus body. Attaching and detaching the process cartridge in this manner is performed by users of the image forming apparatus themselves, and it is desirable to perform attaching and detaching as easily as possible.

Meanwhile, it is necessary that the photosensitive drum included in the process cartridge is rotated around a shaft line during the operation thereof. Therefore, the photosensitive drum is configured to be engaged with a driving shaft of the apparatus body directly or via another member at least during the operation, to receive a rotating force from the driving shaft, and to rotate. Therefore, in order to attach and detach the process cartridge to and from the apparatus body, it is necessary to release (disengage) the engagement between the driving shaft of the apparatus body and the photosensitive drum every time attaching and detaching occur, and to mount the process cartridge again.

Here, if it is possible to move the photosensitive drum (process cartridge) in the shaft line direction of the driving shaft of the apparatus body, and to attach and detach the photosensitive drum, the above-described structure for attaching and detaching is relatively simple. However, from the viewpoint of reducing the image forming apparatus in size or ensuring an attachment and detachment space of the process cartridge, it is preferable to disengage the process cartridge from the apparatus body to be pulled out in the direction which is different from the shaft line direction of the driving shaft, and to mount the process cartridge on the apparatus body to be pushed in this direction.

In Patent Literature 1, a technology in which the driving force from the apparatus body side is transferred to the photosensitive drum when a cover of the apparatus body is closed, and movement to be separated is performed so that the driving force is not transferred to the photosensitive drum when the cover is opened, is disclosed. Accordingly, the process cartridge can be attached to and detached from the apparatus body in the direction which is different from the shaft line direction of the driving shaft.

In addition, in Patent Literature 2, an invention in which the driving shaft of the apparatus body and the photosensitive drum are engaged with each other via a rotating force transmission component having a trunnion structure attached to the photosensitive drum, and the photosensitive drum is rotated, is disclosed. Since the rotating force transmission component can change an angle with respect to the shaft line of the photosensitive drum by the trunnion structure, engagement and disengagement between the driving shaft of the apparatus body and the photosensitive drum unit is easy.

In Non-Patent Literature 1, a technology in which a bearing member of the photosensitive drum unit engaged with the driving shaft is provided to be movable in the shaft line direction by an elastic member, such as a spring, is disclosed. Accordingly, while the bearing member is biased by the elastic member when attaching and detaching the bearing member and the driving shaft, the attachment and the detachment are smoothly performed by moving and retreating in the shaft line direction.

Patent Literature 1: Japanese Patent No. 2875203

Patent Literature 2: JP-A-2008-233868

Non-Patent Literature 1: Japan Institute of Invention and Innovation, Journal of technical disclosure 2010-502197

SUMMARY OF THE INVENTION

However, in the aspect described in Patent Literature 1, when attaching and detaching the process cartridge, a process of moving a rotating body in the shaft line direction of the rotating body by interlocking the rotating body with the opening and closing of a lid, is included, and a mechanism therefor is necessary.

In the aspect according to Patent Literature 2, it is possible to directly move the process cartridge in the direction (practically orthogonal direction) which is different from the shaft line direction of the photosensitive drum, but a configuration which freely inclines the rotating force transmission component is necessary, and the structure becomes complicated. Accordingly, there is a case where it is difficult to match the shaft line of a driving transmission shaft and the shaft line of a driven transmission shaft. In addition, there is also a case where the deterioration of accuracy of rotation transmission occurs.

In the aspect according to Non-Patent Literature 1, there is a case where the engagement between a groove of the rotating force transmission portion and the rotating force transmission portion on the driving shaft side is weak, and the transmission of the rotating force is not appropriately performed. In addition, when attaching and detaching the process cartridge, there is also a case where a hooked state is generated according to the posture in the rotational direction of the member, and the attachment and the detachment are difficult.

Here, in consideration of the above-described problems, a non-limited object of the present invention is to provide an end member which can transmit an appropriate rotating force and can be smoothly attached to and detached from an apparatus body. In addition, the present invention is to provide a photosensitive drum unit provided with the end member, a developing roller unit, and a process cartridge.

Hereinafter, some aspects of the present invention will be described. Here, a part of reference numerals in the drawings is illustrated as an example by being written in parentheses in order to make it easy to understand, but the present invention is not limited thereto.

According to an aspect of the present invention, there is provided an end member (30) to be disposed in an end portion of a columnar rotating body (11) mounted on an image forming apparatus body (2), the end member including: a tubular bearing member (40): and a shaft member (50) held by the bearing member, in which the shaft member includes a shaft-like rotating shaft (51) which is disposed coaxially to the bearing member, and which rotates around a shaft line with respect to the bearing member to move in a direction of the shaft line, and a tip end member (55) which is disposed coaxially to the rotating shaft, and at which a rotating force receiving member (58) having a tip end provided with an engaging member (60) which engages with a driving shaft (70) of the image forming apparatus body is disposed, and in which a rotating force around the shaft line is transmitted to the rotating force receiving member, the rotating shaft, and the bearing member in order.

According to one aspect of the end member (30) of the present invention, for example, at least one of the rotating shaft and the tip end member moves in a direction along the shaft line direction regardless of the rotation around the shaft line of the shaft member.

According to one aspect of the end member (30) of the present invention, for example, a recessed portion (159*a*) having a depth in the shaft line direction is formed on an end surface of the rotating force receiving member, and a side surface of the recessed portion is formed in a projected shape (159*c*).

According to one aspect of the end member (30) of the present invention, for example, a recessed portion (259*a*) having a depth in the shaft line direction is formed on an end surface of the rotating force receiving member, and a side surface of the recessed portion includes a spiral groove (259*b*) extending in a racial shape when viewed from the shaft line and being curved in a circumferential direction around the shaft line.

According to one aspect of the end member (30) of the present invention, for example, the engaging member (60) includes an inclined surface or a curved surface (60*a*, 60*b*, 60*c*) inclined to the shaft line direction.

According to one aspect of the end member (30) of the present invention, for example, the engaging member (60) includes a recessed portion (60*d*) with which the driving shaft (70) is engaged.

According to one aspect of the end member (30) of the present invention, for example, a part (47) formed in a spiral shape is provided on an inner surface of the bearing member (40), and a member (67) which moves inside the part formed in the spiral shape is provided in the rotating shaft (51), whereby the rotating shaft rotates around the shaft line with respect to the bearing member to move in the shaft line direction.

According to one aspect of the end member (30) of the present invention, for example, a part (452) formed in a spiral shape is provided on an inner surface of the rotating shaft (451), and a member (456) which moves inside a part formed in the spiral shape is provided in the tip end member (455), whereby the tip end member rotates around the shaft line with respect to the rotating shaft to move in the shaft line direction.

According to a photosensitive drum unit of an aspect of the present invention, the photosensitive drum unit includes a photosensitive drum as the columnar rotating body, and the end member according to the description above which is disposed at least in one end portion of the photosensitive drum.

According to a developing roller unit of an aspect of the present invention, the developing roller unit includes a developing roller as the columnar rotating body, and the end member according to the description above which is disposed at least in one end portion of the developing roller.

A process cartridge of an aspect of the present invention includes: a housing; and the photosensitive drum unit according to the description above which is held by the housing.

A process cartridge of an aspect of the present invention includes; a housing; and the developing roller unit according to the description above which is held by the housing.

According to the non-limited aspects of the present invention, it is possible to transmit a rotating force equivalent to that of the related art, and attachment to and detachment from the apparatus body can be more smoothly performed.

BRIEF DESCRIPTION OF THE DRAWINGS

In the accompanying drawings.

DETAILED DESCRIPTION OF THE EXEMPLARY EMBODIMENTS

Figure 1:
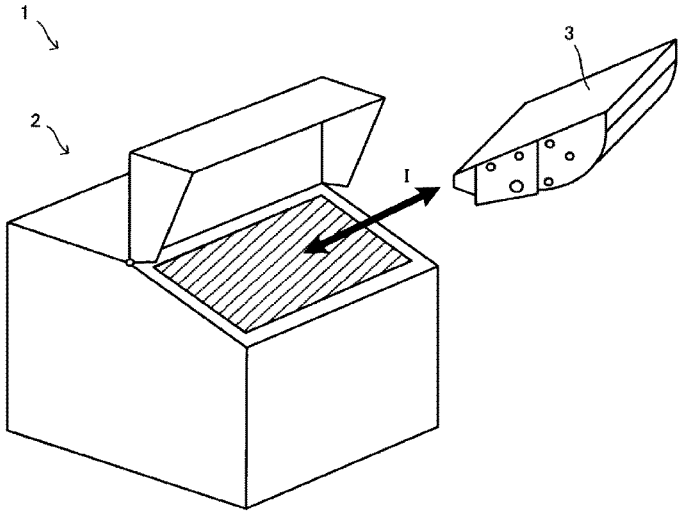
FIG. 1 is a schematic view of an image forming apparatus body and a process cartridge.

Hereinafter, the present invention will be described based on aspects illustrated in the drawings. However, the present invention is not limited to the aspects.

FIG. 1 is a diagram illustrating a first aspect, and is a perspective view schematically illustrating an image forming apparatus 1 including a process cartridge 3 and an image forming apparatus body 2 (hereinafter, there is a case of being described as "apparatus body 2") which mounts and uses the process cartridge 3. The process cartridge 3 can be mounted on and disengaged from the apparatus body 2 by moving in the direction illustrated by I in FIG. 1. In addition, the direction illustrated by I is different from the shaft line direction of a driving shaft 70 (refer to FIG. 15) provided in the apparatus body 2.

Figure 2:
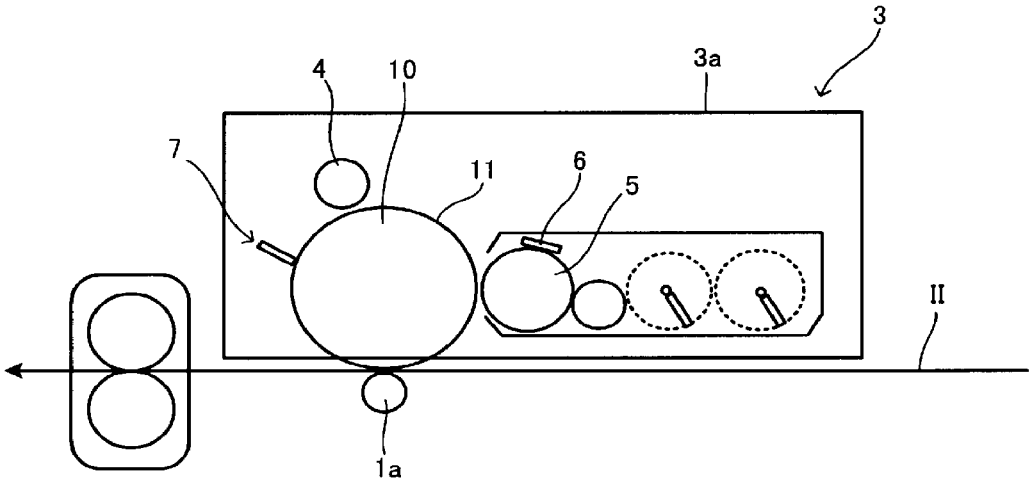
FIG. 2 is a schematic view illustrating a configuration of the process cartridge.

In FIG. 2, a structure of the process cartridge 3 is schematically illustrated. As can be ascertained from FIG. 2, the process cartridge 3 includes a photosensitive chum unit 10 (refer to FIG. 3) on the inner side of a housing 3*a*, a charging roller unit 4, a developing roller unit 5, a regulating member 6, and a cleaning blade 7. In a posture in which the process cartridge 3 is mounted on the apparatus body 2, as a recording medium, such as a paper sheet, moves along line illustrated by II in FIG. 2, an image is transferred to the recording medium.

In addition, the attachment and detachment of the process cartridge 3 to and from the apparatus body 2 is generally performed as follows. As the photosensitive drum unit 10 provided in the process cartridge 3 receives a rotation driving force from the apparatus body 2, and rotates, a state where the driving shaft 70 (refer to FIG. 15A) of the apparatus body 2 and an end member 30 (refer to FIG. 4) of the photosensitive drum unit 10 are engaged with each other at least during the operation, and the rotating force can be transmitted, is achieved (refer to FIG. 16A).

Meanwhile, when attaching and detaching the process cartridge 3 to and from the apparatus body 2, it is necessary that the driving shaft 70 and the end member 30 are promptly engaged and disengaged not to interrupt the movement each other regardless of the posture.

In this manner, the end member 30 of the photosensitive drum unit 10 is appropriately engaged with the driving shaft 70 of the apparatus body 2, and the rotation driving force is transmitted.

Hereinafter, each configuration will be described.

In the process cartridge 3, as can be ascertained from FIG. 2, the charging roller unit 4, the developing roller unit 5, the regulating member 6, the cleaning blade 7, and the photosensitive drum unit 10 are provided, and these members are included inside the housing 3*a*. Each of these is explained as follows.

The charging roller unit 4 charges a photosensitive drum 11 of the photosensitive drum unit 10 by applying voltage from the apparatus body 2. The charging is performed as the charging roller unit 4 rotates following the photosensitive drum 11, and comes into contact with an outer circumferential surface of the photosensitive drum 11.

The developing roller unit 5 is a roller which supplies a developer to the photosensitive drum 11. In addition, an electrostatic latent image formed on the photosensitive drum 11 is developed by the developing roller unit 5. In addition, in the developing roller unit 5, a fixed magnet is embedded.

The regulating member 6 is a member which adjusts an amount of developer adhered onto the outer circumferential surface of the above-described developing roller unit 5, and imparts a frictional electrification charge to the developer itself.

The cleaning blade 7 is a blade which comes into contact with the outer circumferential surface of the photosensitive drum 11, and removes the developer remaining after the transfer by a tip end thereof.

Figure 3:
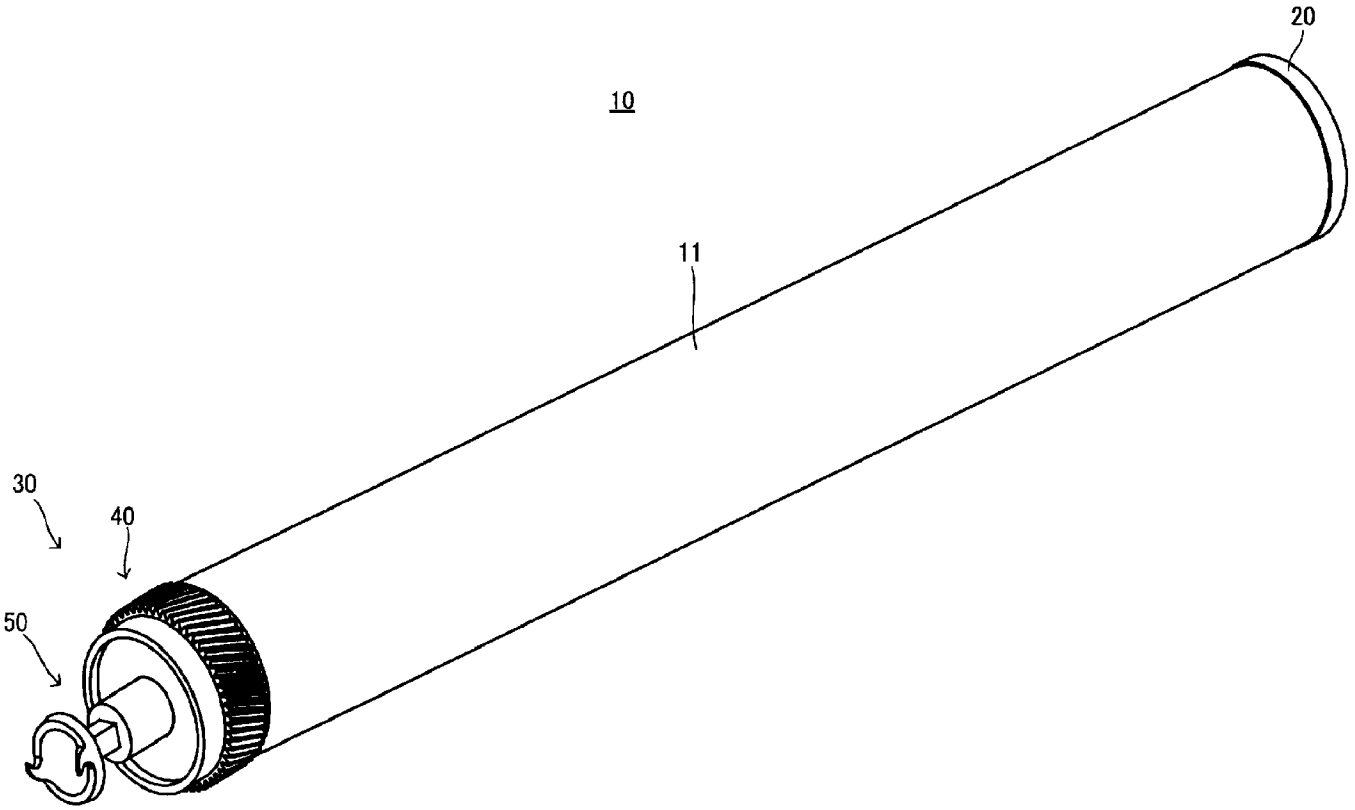
FIG. 3 is an appearance perspective view of a photosensitive drum unit 10.

The photosensitive drum unit 10 is provided with the photosensitive drum 11, and here, letters or figures to be transferred to the recording medium are formed. FIG. 3 is an appearance perspective view of the photosensitive drum unit 10. As can be ascertained from FIG. 3, the photosensitive drum unit 10 is provided with the photosensitive drum 11, a lid member 20, and the end member 30.

The photosensitive drum 11 is a member which covers a photosensitive layer on the outer circumferential surface of a drum cylinder which is a columnar rotating body. In other words, the drum cylinder is a conductive cylinder made of aluminum or the like, and here, the cylinder is coated with the photosensitive layer. On the photosensitive layer, characters or figures to be transferred to the recording medium, such as a paper sheet, are formed.

The base body is a member in which a conductive material made of aluminum or aluminum alloy is formed in a cylindrical shape. A type of the aluminum alloy used in the base body is not particularly limited, but 6000 series, 5000 series, and 3000 series aluminum alloys which are defined by JIS standard (JIS H 4140) which are used as the base body of the photosensitive drum in many cases, are preferable.

In addition, the photosensitive layer formed on the outer circumferential surface of the base body is not particularly limited, and a known material can be employed depending on the purpose.

It is possible to manufacture the base body by forming the cylindrical shape by a cutting process, an extrusion processing, or a drawing processing. In addition, it is possible to manufacture the photosensitive drum 11 by laminating by coating the outer circumferential surface of the base body with the photosensitive layer.

In order to rotate the photosensitive drum 11 around the shaft line as will be described later, at least two end members are attached to one end of the photosensitive drum 11. One end member in the aspect is the lid member 20, and the other end member is the end member 30.

The lid member 20 is an end member which is disposed in an end portion on a side on which the driving shaft 70 of the apparatus body 2 is not engaged, among the end portions in the shaft line direction of the photosensitive drum 11. The lid member 20 is formed of a resin, and a fitting portion fitted to the cylindrical inner side of the photosensitive drum 11, and a bearing portion disposed to cover one end surface of the photosensitive drum 11 are coaxially formed. The bearing portion has a shape of a disk which covers the end surface of the photosensitive drum 11, and is provided at a part which receives a shaft provided in the housing 3*a*. In addition, in the lid member 20, an earth plate made of a conductive material is disposed, and accordingly, the photosensitive drum 11 and the apparatus body 2 are electrically connected to each other.

In addition, in the aspect, an example of the lid member is illustrated, but the present invention is not limited thereto, and it is possible to employ a lid member of another aspect which can be generally obtained. For example, a gear for transmitting the rotating force to the lid member may be disposed.

In addition, the above-described conductive material may be provided on the end member 30 side.

Figure 4:
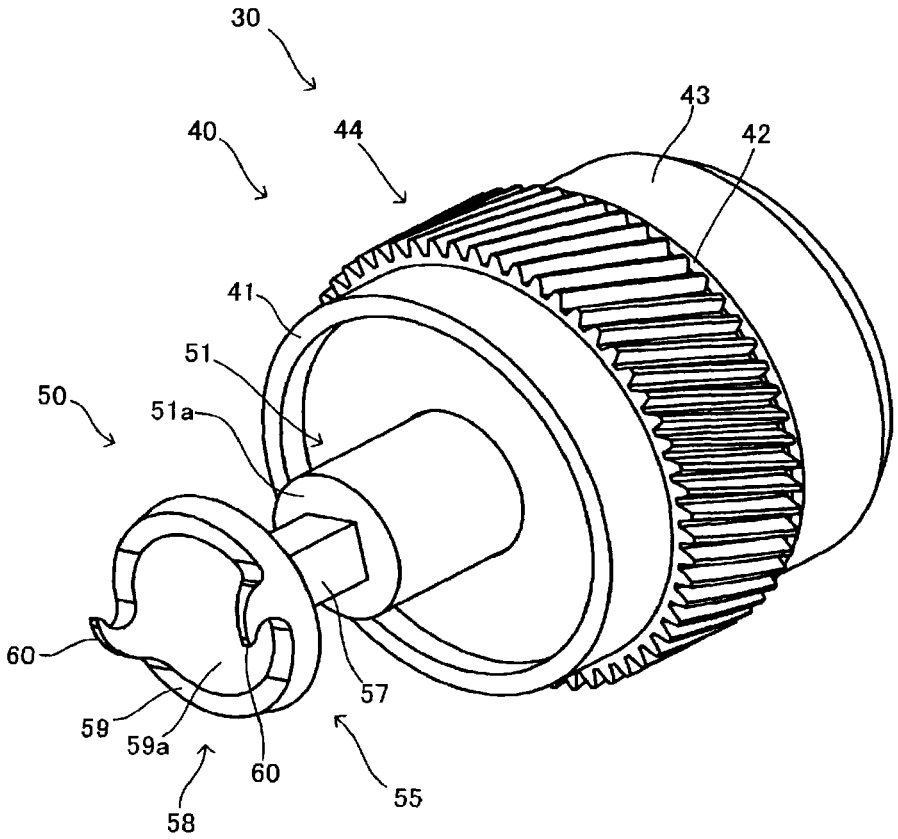
FIG. 4 is a perspective view of an end member 30.
Figure 5:
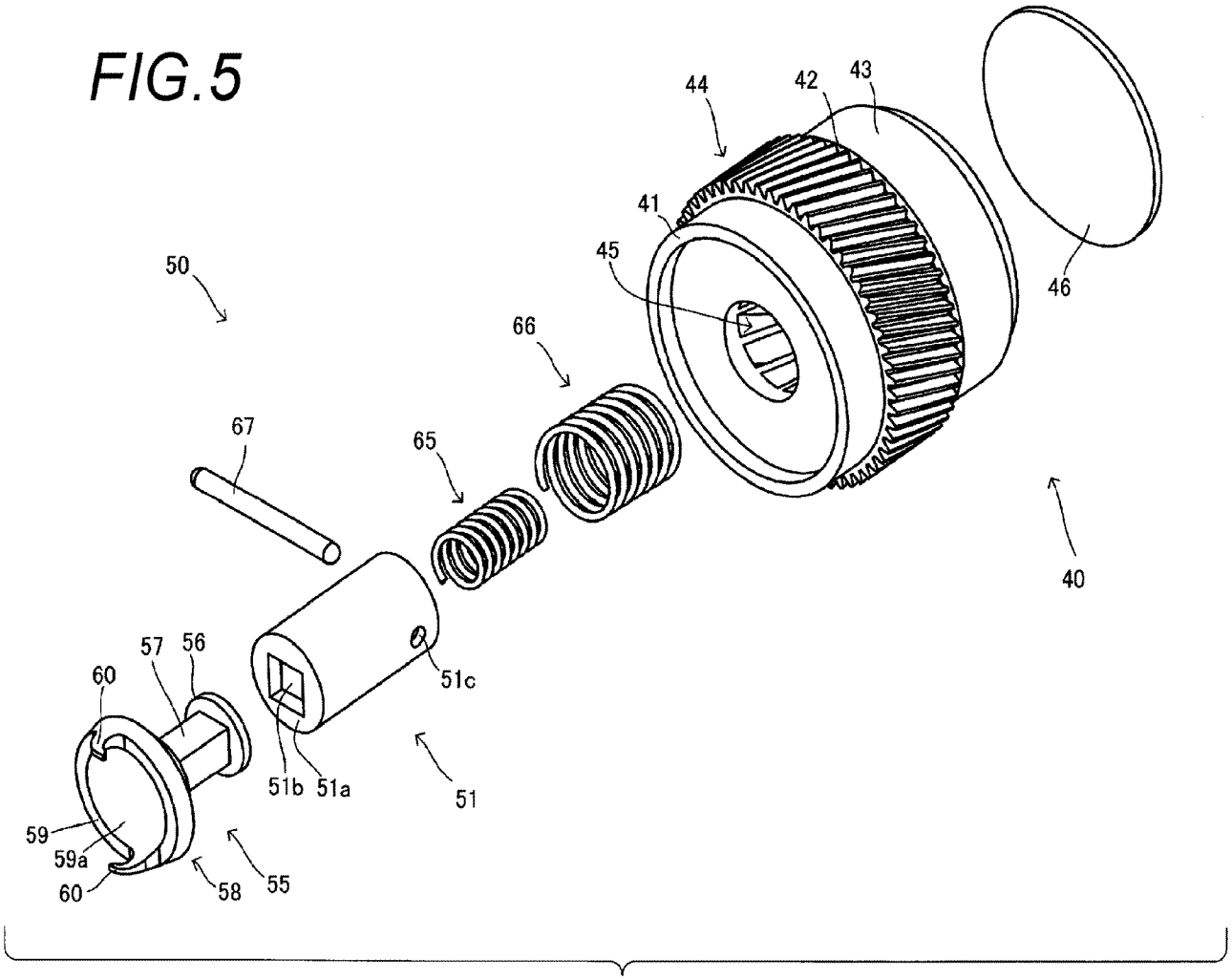
FIG. 5 is an exploded perspective view of the end member 30.

The end member 30 is a member which is attached to the end portion opposite to the lid member 20 among the end portions of the photosensitive drum 11, and is provided with a bearing member 40 and a shaft member 50. FIG. 4 is a perspective view of the end member 30, and FIG. 5 is an exploded perspective view of the end member 30.

Figure 6C:
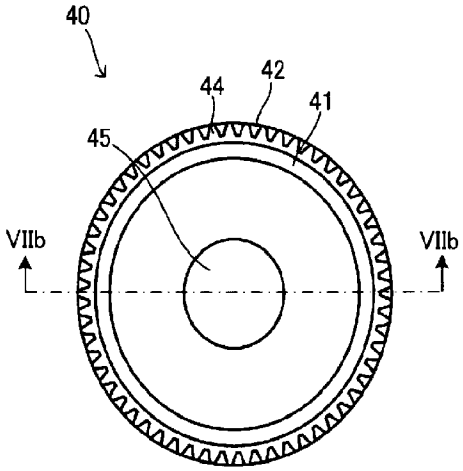
FIG. 6C is a plan view of the bearing member 40.
Figure 6B:
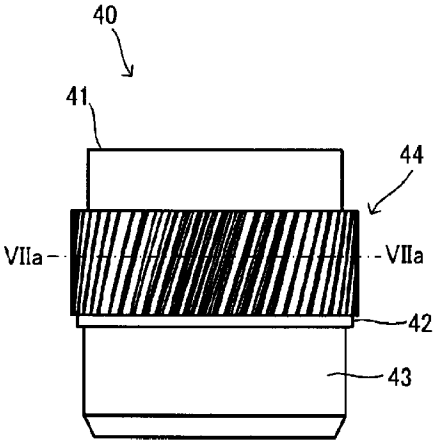
FIG. 6B is a front view of the bearing member 40.
Figure 6A:
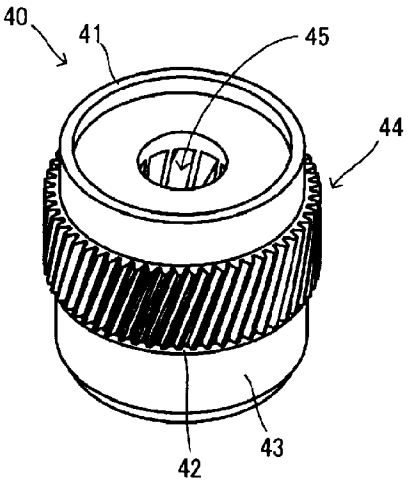
FIG. 6A is a perspective view of a bearing member 40.
Figure 7A:
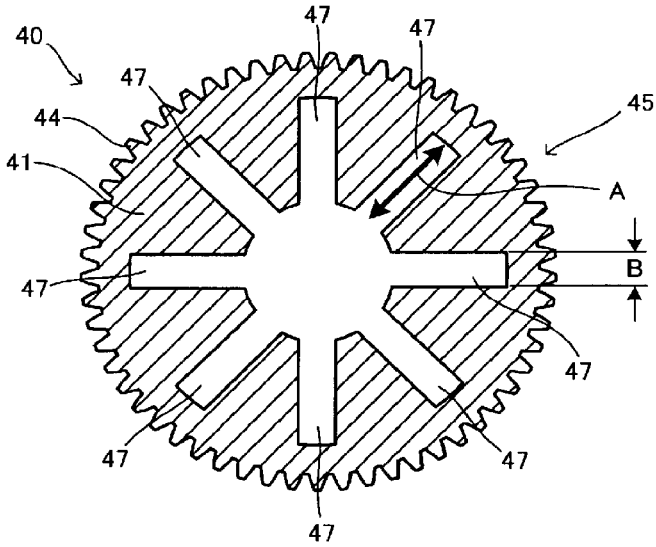
FIG. 7A is an end surface view orthogonal to the shaft line direction of the bearing member 40.
Figure 7B:
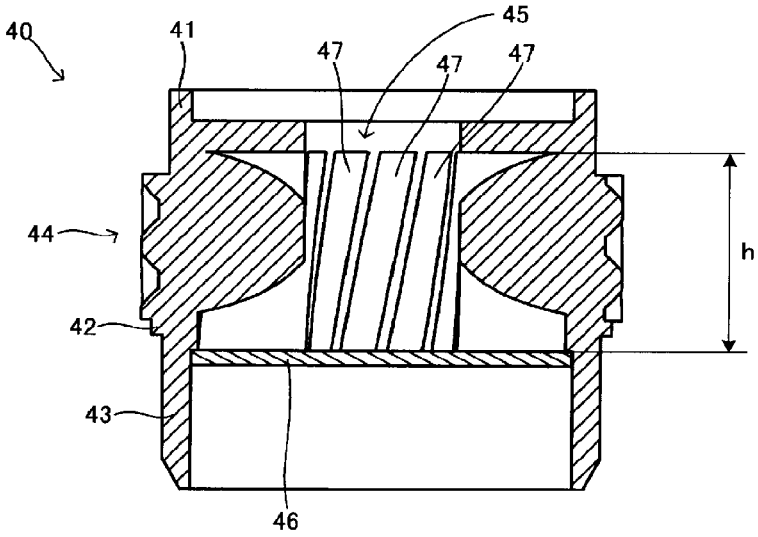
FIG. 7B is a sectional view along the shaft line direction of the bearing member 40.

The bearing member 40 is a member bonded to the end portion of the photosensitive drum 11 in the end member 30. FIG. 6A is a perspective view of the bearing member 40, FIG. 6B is a front view of the bearing member 40, and FIG. 6C is a plan view when viewed from a side on which the shaft member 50 is disposed in the bearing member 40. Furthermore, FIG. 7A is an end surface view along line illustrated by VIIa-VIIa in FIG. 6B. In other words, FIG. 7A is an end surface when the bearing member 40 is cut on a surface orthogonal to the shaft line of the bearing member 40. FIG. 7B is a sectional view along line illustrated by VIIb-VIIb in FIG. 6C. In other words, FIG. 7B includes the shaft line of the bearing member 40, and is a sectional view of the bearing member 40 in the direction along the shaft line.

In addition, in each drawing illustrated below, there is a case where the end surface (cut surface) is illustrated being hatched in the sectional views.

As can be ascertained from FIGS. 4 to 7B, the bearing member 40 is configured to include a tubular body 41, a contact wall 42, a fitting portion 43, a gear portion 44, and a shaft member holding portion 45.

The tubular body 41 is a cylindrical member as a whole, the contact wall 42 and the gear portion 44 are disposed on the outside thereof, and the shaft member holding portion 45 is formed on the inside thereof. In addition, regarding the part provided with at least the shaft member holding portion 45 on the inside of the tubular body 41, to the extent that the rotating shaft 51 (refer to FIG. 8A) of the shaft member 50 which will be described later can smoothly move in the shaft line direction and can rotate around the shaft line, the inner diameter of the tubular body 41 and the outer diameter of the rotating shaft 51 are substantially the same as each other.

The contact wall 42 which comes into contact with and is locked to the end surface of the photosensitive drum 11 stands from a part of the outer circumferential surface of the tubular body 41. Accordingly, in a posture in which the end member 30 is mounted on the photosensitive drum 11, the insertion depth of the end member 30 into the photosensitive drum 11 is regulated.

In addition, the fitting portion 43 of which one side is inserted into the photosensitive drum 11 by nipping the contact wall 42 of the tubular body 41, is achieved. The fitting portion 43 is inserted into the photosensitive drum 11, and is fixed to the inner surface of the photosensitive drum 11 by an adhesive. Accordingly, the end member 30 is fixed to the end portion of the photosensitive drum 11. Therefore, the outer diameter of the fitting portion 43 is substantially the same as the inner diameter of the photosensitive drum 11 within a range that the photosensitive drum 11 can be inserted into the cylindrical inside. A groove may be formed on the outer circumferential surface in the fitting portion 43. Accordingly, the groove is filled with the adhesive, and adhesiveness between the tubular body 41 (end member 30) and the photosensitive drum 11 is improved by an anchor effect or the like.

The gear portion 44 is formed on the outer circumferential surface of the tubular body 41 opposite to the fitting portion 43 nipping the contact wall 42. The gear portion 44 is a gear which transmits the rotating force to another member, such as the developing roller unit, and in the aspect, a helical gear is disposed. However, the type of the gear is not particularly limited, and a spur gear may be disposed, and both the helical gear and the spur gear may be disposed to be aligned in the shaft direction of the cylindrical body. In addition, it is not necessary to provide the gear.

The shaft member holding portion 45 is a part which is formed on the inside of the tubular body 41, and which has a function of ensuring a predetermined operation of the shaft member 50 and holding the shaft member 50 in the bearing member 40, and functions as one means for moving and rotating the rotating force receiving member 58 which will be described later. The shaft member holding portion 45 has a bottom plate 46 illustrated in FIGS. 5 and 7B, and a spiral groove 47 illustrated in FIGS. 7A and 7B.

The bottom plate 46 is disposed to block and partition the inside of the tubular body 41 which is a disk-like member. Accordingly, the shaft member 50 is supported. The attachment of the bottom plate 46 to the tubular body 41 can be performed by adhering or welding. In addition, the tubular body 41 and the bottom plate 46 may be integrally formed.

The spiral grooves 47 are a plurality of spiral grooves formed on the inner surface of the tubular body 41, and as illustrated by A in FIG. 7A, the depth direction is formed in a radial shape (radial direction) around the shaft line of the tubular body 41. Meanwhile, the longitudinal direction of the spiral groove 47 is the direction along the shaft line of the tubular body 41 as illustrated in FIG. 7B, and one end side and the other end side are twisted to be deviated in the direction along the inner circumference of the tubular body 41, and are formed in a spiral shape. In addition, as illustrated by B in FIG. 7A, the width direction of the spiral groove 47 is formed to be substantially the same as the diameter of a pin (a member which moves inside the part formed in a spiral shape) 67 to the extent that the end portion of the pin 67 of the shaft member 50 which will be described later is inserted, and the end portion of the pin 67 can smoothly move in the groove.

In addition, one end of the spiral groove 47 in the longitudinal direction is blocked by the bottom plate 46, and the other end opposite thereto is blocked without reaching the end surface of the tubular body 41.

In addition, as a standard which illustrates the extent of twisting of the spiral groove 47, "torsion" can be defined. In other words, the "torsion" is defined from the distance (size illustrated by h in FIG. 7) between the spiral grooves in the shaft line direction, and a total torsion angle which is an angle by which the spiral groove is twisted in the circumferential direction around the shaft line in the distance, and is expressed by the following equation.

Torsion (°/mm)=total torsion angle (°)/distance between the spiral grooves in the shaft line direction (mm)

Furthermore, at least one pair of plural spiral grooves 47 are provided to face each other nipping the shaft line of the tubular body 41. In the aspect, an example in which four pairs, that is, a total of eight spiral grooves 47 are formed, is employed, but one pair, that is, two spiral grooves may be formed. Meanwhile, two, three, five or more pairs of spiral grooves may be provided. When the spiral groove is injection-molded, the injection molding is performed by the releasing while rotating the mold after the injection of the material.

A material which configures the bearing member 40 is not particularly limited, but a resin, such as polyacetal, polycarbonate, or PPS, or metal can be used. Here, in order to improve the rigidity of the member in a case where the resin is used, the glass fiber or the carbon fiber may be mixed into the resin in accordance with the load torque. In addition, in order to make the attachment or the movement of the shaft member smooth, sliding properties may be improved by containing at least one type of a fluororesin, polyethylene, and silicon rubber in the resin. In addition, the resin may be coated with fluororesin or lubricant.

In a case of making the bearing member 40 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

Returning to FIGS. 4 and 5, the shaft member 50 of the end member 30 will be described. As can be ascertained from FIG. 5, the shaft member 50 is provided with the rotating shaft 51 and a tip end member 55. Furthermore, the shaft member 50 is provided with a tip end member elastic member 65, a rotating shaft elastic member 66, and the pin 67. Each of the tip end member elastic member 65 and the rotating shaft elastic member 66 in the aspect is a coiled spring.

Hereinafter, each of the members will be described.

Figure 8A:
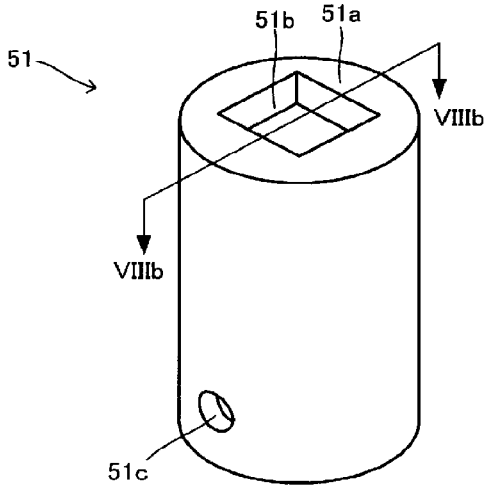
FIG. 8A is a perspective view of a rotating shaft 51.
Figure 8B:
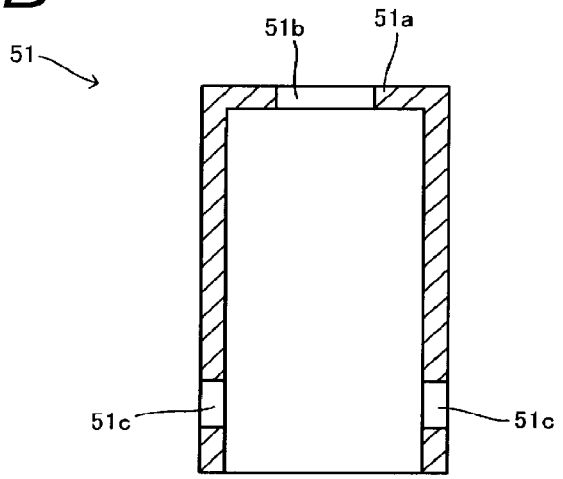
FIG. 8B is a sectional view of the rotating shaft 51.

The rotating shaft 51 is a rotating force transmission portion which transmits the rotating force received by the tip end member 55 to the bearing member 40, and is a shaft-like member which functions as means for moving and rotating the rotating force receiving member 58. FIG. 8A is a perspective view of the rotating shaft 51. FIG. 8B is a sectional view in the shaft line direction cut by line illustrated by VIIIb-VIIIb in FIG. 8A.

As can be ascertained from FIGS. 8A and 8B, the rotating shaft 51 is cylindrical. The cylindrical inner side has the size by which the tip end member elastic member 65 can be inserted. In the rotating shaft 51, a lid portion 51*a* is provided in one end portion, and an opening portion 51*b* narrowed with respect to the inner diameter of the cylinder is provided in the lid portion 51*a*. In addition, in the aspect, the opening portion 51*b* is rectangular. However, the shape of the opening portion is not limited to the rectangular shape, and a shape in which a shaft 57 (refer to FIG. 5) of the tip end member 55 inserted thereto does not idle, and is hooked to the opening portion 51*b* of the rotating shaft 51, and the rotating force can be transmitted, may be employed. Therefore, a shape other than a circular shape can be employed. Means thereof is not particularly limited if the rotating shaft 51 is interlocked to the rotation of the tip end member 55 while the movement of the tip end member 55 in the shaft line direction is possible, and for example, an additional portion, such as a pin, may be used.

In addition, in the rotating shaft 51, two pin through holes 51*c*, which are orthogonal to the shaft line of the cylinder, are provided in one diameter direction of the cylinder, and penetrate the inside and the outside of the cylinder, are formed in the end portion opposite to the end portion in which the lid portion 51*a* is disposed. The pin 67 (refer to FIG. 5) passes through the pin through hole 51*c*, as will be described later.

Figure 9A:
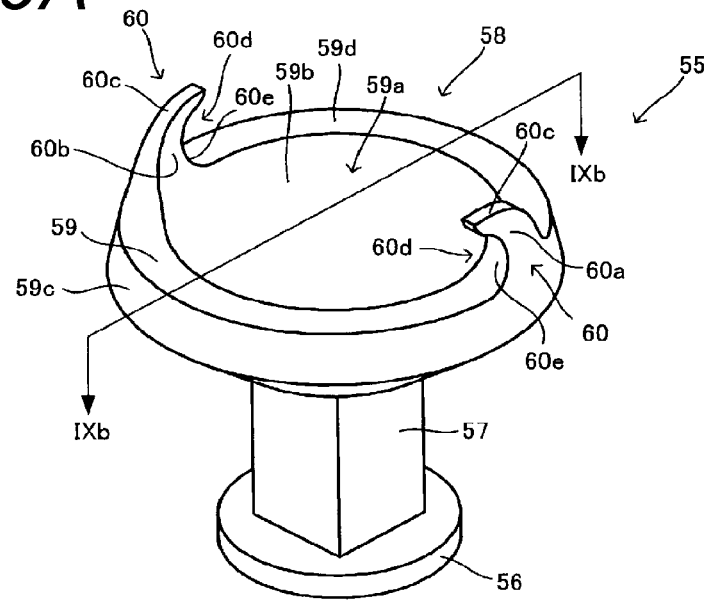
FIG. 9A is a perspective view of a tip end member 55.
Figure 9B:
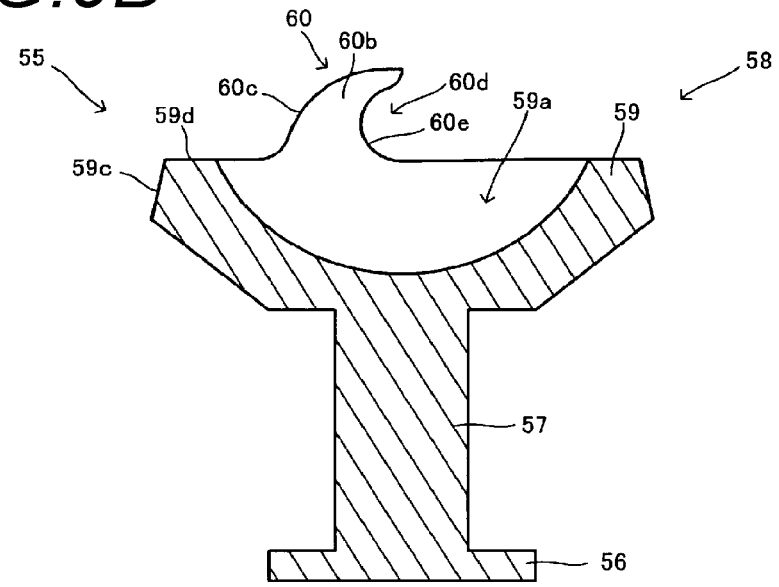
FIG. 9B is a sectional view of the tip end member 55.
Figure 10A:
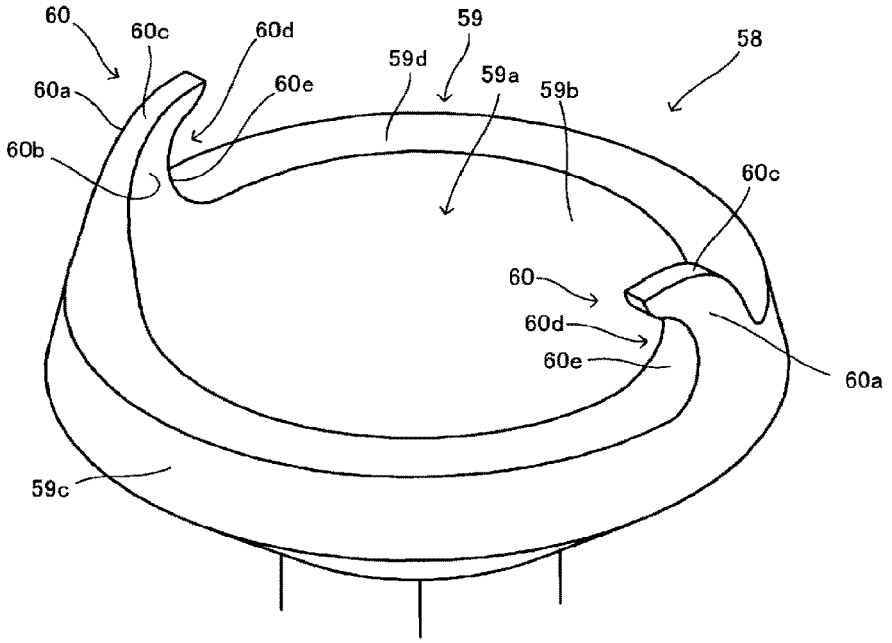
FIG. 10A is a perspective view of a rotating force receiving member 58.
Figure 10B:
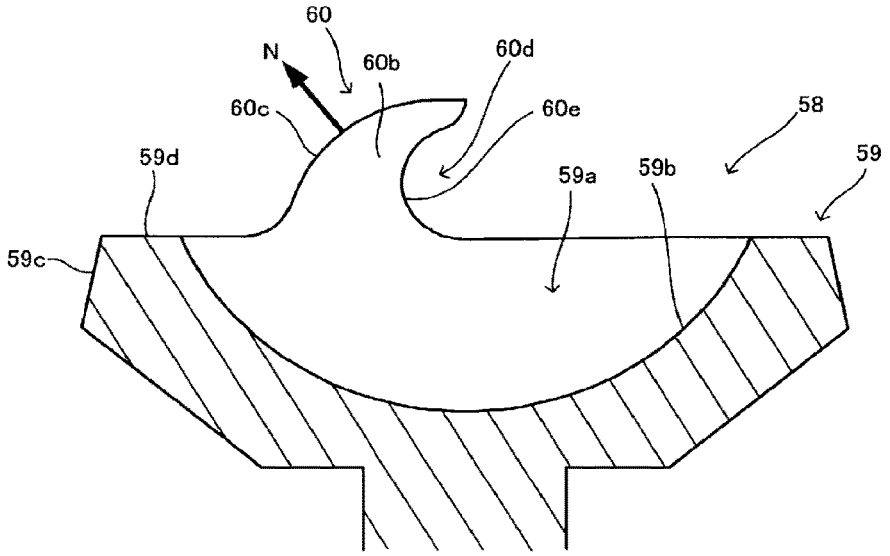
FIG. 10B is a sectional view of the rotating force receiving member 58.

The tip end member 55 is a member which receives the rotation driving force from the apparatus body 2 (refer to FIG. 1) and transmits the driving force to the rotating shaft 51. FIG. 9A is a perspective view of the tip end member 55. FIG. 9B is a sectional view in the shaft line direction of the tip end member 55 cut by line illustrated by IXb-IXb in FIG. 9A. FIG. 10A is a diagram which is enlarged focusing on the part of the rotating force receiving member 58 in FIG. 9A, and FIG. 10B is a diagram which is enlarged focusing on the part of the rotating force receiving member 58 in FIG. 9B.

As can be ascertained from FIGS. 9A and 9B, the tip end member 55 is configured to include the shaft 57, a holding member 56, and the rotating force receiving member 58.

The shaft 57 is a pillar-like member, and is a quadrangular prism having a rectangular section in the aspect. A sectional shape of the shaft 57 is formed to be substantially the same as or slightly smaller than the opening portion 51*b* of the above-described rotating shaft 51.

The holding member 56 is a plate-like member which is disposed in one end portion of the shaft 57. The holding member 56 and the shaft 57 are disposed in an aspect in which one surface of the holding member 56 overlaps one end surface of the holding member 56. Both the holding member 56 and the shaft 57 may be formed separately and be adhered and welded to each other, or may be integrally formed.

As illustrated in FIGS. 9A and 9B, the holding member 56 is formed to be greater than the shaft 57 in the direction orthogonal to the shaft line direction. The size and the shape are configured to be stored on the inner side of the above-described rotating shaft 51, and not to pass through the opening portion 51*b*. Accordingly, it is possible to hold the tip end member 55 in the rotating shaft 51. In the aspect, an outer shape of the holding member 56 is substantially the same aspect (that is, a circular shape) as the sectional shape of the inner side of the rotating shaft 51.

The rotating force receiving member 58 is disposed in the end portion opposite to the holding member 56 of the shaft 57, and is configured to include two engaging members 60 which stand from a columnar receiving member 59 and one end surface of the receiving member 59. The shaft 57 and the rotating force receiving member 58 may be formed separately and be adhered and welded to each other, or may be integrally formed.

The receiving member 59 is disposed coaxially to the shaft 57 by a member which is basically a columnar shape provided in the end portion opposite to the holding member 56 of the end portion of the shaft 57.

The receiving member 59 has an inclined surface 59*c* which is inclined in the direction along the shaft line direction in the outer circumferential portion thereof. As illustrated in FIGS. 9B and 10B, the inclined surface 59*c* is an inclination of which the diameter becomes smaller as closer to the engaging member 60 side, and an end portion thereof is connected to an end surface (edge portion 59*d*) provided with the engaging member 60 in the receiving member 59.

Furthermore, in the receiving member 59, a recessed portion 59*a* is formed on a surface on a side on which the engaging member 60 is formed. The recessed portion 59*a* is formed so that the tip end portion of the driving shaft 70 (refer to FIG. 15A) which will be described later enters here, and accordingly, the shaft line of the shaft member 50 (end member 30) and the shaft line of the driving shaft 70 match each other. In addition, it is preferable that a bottom surface 59*b* of the recessed portion 59*a* is a smoothly inclined surface or a bent surface from the viewpoint of smooth engagement to and disengagement from the driving shaft 70. From the related viewpoint, it is preferable that the recessed portion 59*a* becomes a part of a spherical surface in which the shaft line portion is considered as the deepest portion.

Two engaging members 60 are projection-like member, are disposed in the outer circumferential end portion on the surface opposite to the side which is connected to the shaft 57 in the receiving member 59, and are separated from the shaft line of the receiving member 59 at the same distance. Both engaging members 60 are disposed at symmetrical positions with respect to the shaft line. The interval between two engaging members 60 is formed to be substantially the same as or slightly greater than the diameter of a shaft portion 71 of the driving shaft 70 (refer to FIG. 15A). In addition, as can be ascertained with reference to FIG. 16A, the interval between two engaging members 60 is configured so that an engaging projection 72 is hooked to the engaging member 60, in a posture in which the shaft portion 71 of the driving shaft 70 is disposed between two engaging members 60. How the rotating force can be received from the driving shaft 70 will be described later.

Here, the engaging members 60 are configured as a pair of two engaging members 60. In the aspect, an example in which one pair of engaging members 60 is disposed is described, but two pairs (four members), three pairs (six members), or more pairs of engaging members may be provided.

The engaging member 60 has a shape illustrated in FIGS. 9A and 10B, but the shape of the surface which forms the engaging member 60 is as follows. A surface 60*a* serving as an outer circumferential side of the receiving member 59 on the surface of the engaging member 60, is continuous to the inclined surface 59*c* formed on the outer circumference of the receiving member 59. Therefore, the surface 60*a* is inclined or curved to be close to the shaft line according to the separation from the recessed portion 59*a*.

A surface 60*b* which faces the recessed portion 59*a* side on the surface of the engaging member 60, is continuous to the bottom surface 59*b* of the recessed portion 59*a*. Therefore, the surface 60*b* is inclined or curved to be separated from the shaft line according to the separation from the recessed portion 59*a*.

A surface 60*c* which is one surface which faces the receiving member 59 in the circumferential direction on the surface of the engaging member 60 is inclined or curved in the direction in which a normal line (for example, line illustrated by N in FIG. 10B) is separated from the receiving member 59 at any part.

A surface 60*e* which is the other one surface that is a surface opposite to the surface 60*c* on the surface of the engaging member 60, and faces the receiving member 59 in the circumferential direction, has an inclined or curved surface to form a recessed portion 60*d*. Therefore, the recessed portion 60*d* is a recessed portion which is recessed in the circumferential direction of the receiving member 59. A part of the engaging projection 72 of the driving shaft 70 on the inner side of the recessed portion 60*d* enters the recessed portion 60*d*, and the recessed portion 60*d* is formed to have the size by which the engaging projection 72 is engaged with the engaging member 60.

Here, in two engaging members 60, in the circumferential direction of the receiving member 59, the surfaces 60*e* of one engaging member 60 are aligned to face the surfaces 60*c* of the other engaging member 60. In addition, the recessed portion 60*d* is formed to be recessed in the rotational direction in which the driving force is transmitted, in the engaging member 60. Accordingly, as will be described later, it is possible to appropriately engage the engaging projection 72 of the driving shaft 70.

Returning to FIG. 5, other configuration elements provided in the shaft member 50 will be described. The tip end member elastic member 65 and the rotating shaft elastic member 66 are so-called elastic members, and any of the tip end member elastic member 65 and the rotating shaft elastic member 66 functions as means for moving and rotating the rotating force receiving member 58. In the aspect, both are the coiled springs. In addition, the pin 67 is the means for moving and rotating the rotating force receiving member 58, and is a rod-like member which functions as a projection that moves on the inner side of the spiral groove 47. The dispositions and the actions of each member will be described later.

A material which configures each member of the shaft member 50 is not particularly limited, but various types of resin or metal can be used.

In a case of making the shaft member 50 by the resin, for example, polyacetal, polycarbonate, polyphenylene sulfide (PPS), polyamide imide (PAI), polyetherether ketone (PEEK), polyether imide (PEI), 4F-perfluoro alkyl vinyl ether (PFA), polyether sulfone (PES), liquid crystal polymer (LCP) resin, or polyamide MXD6 (PA-MXD6), can be appropriately used. However, in order to improve the rigidity of the member, the glass fiber or the carbon fiber may be mixed into the resin in accordance with the load torque. In addition, by inserting metal into the resin, the rigidity may further be improved.

Meanwhile, in a case of making the shaft member 50 by metal, carving by cutting, aluminum the casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

In addition, from the viewpoint of having elasticity, the shaft member 50 and any member included in the shaft member 50, may be made by bending a metal plate, or may be made by making the metal, glass, or carbon fiber infiltrate into the resin.

Figure 11:
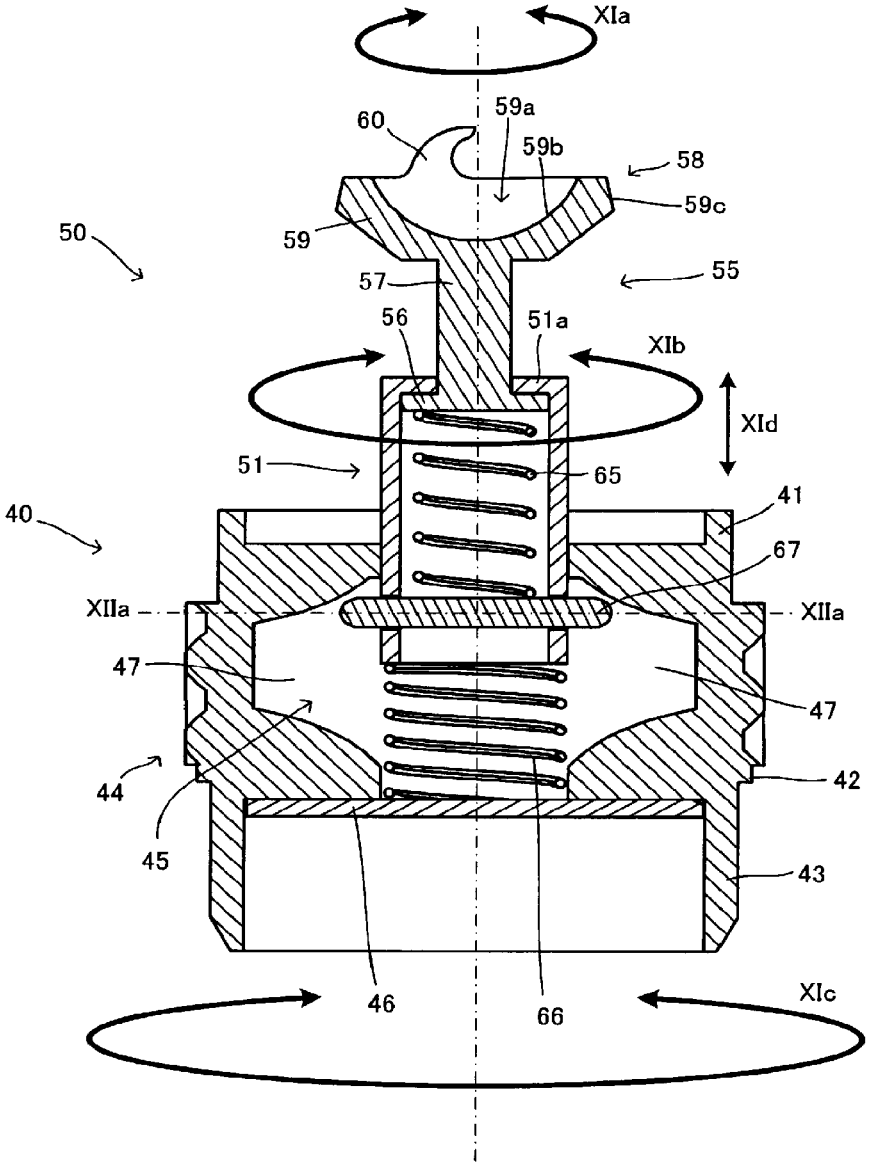
FIG. 11 is a sectional view of the end member 30.
Figure 12A:
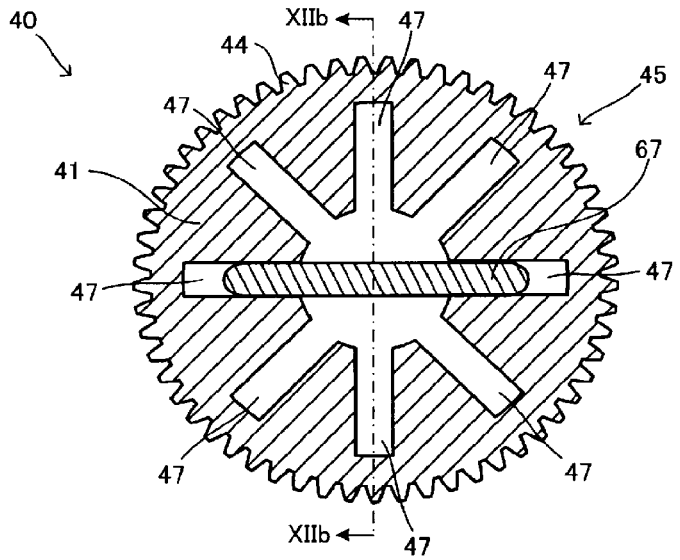
FIG. 12A is an end surface view orthogonal to the shaft line direction of the end member 30.
Figure 12B:
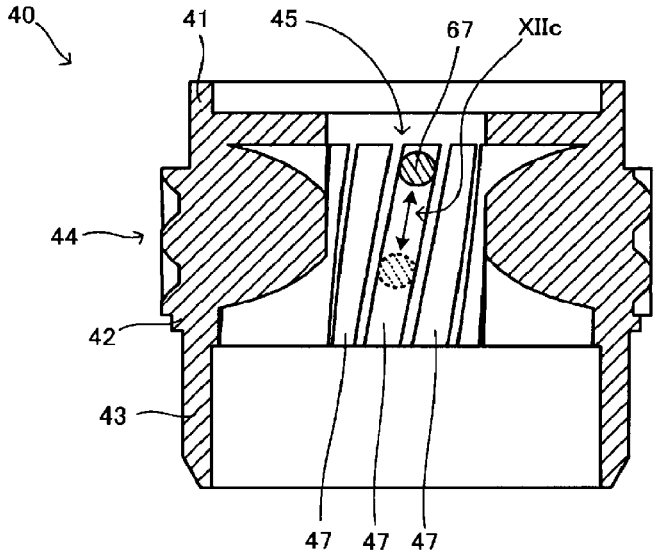
FIG. 12B is a sectional view along the shaft line direction of the end member 30.

By combining the bearing member 40 and the shaft member 50 with each other as follows, the end member 30 is made. In addition, by describing the combination, the size of each member and part, the structure, or the relationship of the sizes of the members and parts, are further understood. FIG. 11 is a sectional view in the shaft line direction of the end member 30. FIG. 12A is a sectional view of the end member 30 along line illustrated by XIIa-XIIa in FIG. 11. FIG. 12B is a sectional view of the end member 30 by line illustrated by XIIb-XIIb in FIG. 12A. However, in FIGS. 12A and 12B, for making it easy to understand, regarding the shaft member 50, only the pin 67 is illustrated.

As can be ascertained from FIG. 11, the shaft 57 of the tip end member 55 passes through the opening portion 51*b* of the rotating shaft 51. At this time, the holding member 56 of the tip end member 55 is included on the inner side of the rotating shaft 51, and the rotating force receiving member 58 of the tip end member 55 is disposed to protrude from the rotating shaft 51.

Meanwhile, the pin 67 passes to cross over the two pin through holes 51*c* of the rotating shaft 51. At this time, both ends of the pin 67 respectively protrude from the side surface of the rotating shaft 51, and function as projections.

In addition, the tip end member elastic member 65 is disposed between the holding member 56 of the tip end member 55 and the pin 67 on the inner side of the rotating shaft 51. Therefore, one side of the tip end member elastic member 65 comes into contact with the holding member 56, and the other side thereof comes into contact with the pin 67. Accordingly, the tip end member 55 is biased in the direction in which the tip end member elastic member 65 biases the tip end member 55 and makes the tip end member 55 protrude from the rotating shaft 51. However, since the holding member 56 cannot pass through the opening portion 51*b* of the rotating shaft 51, the tip end member 55 is held in a state of being biased without falling out of the rotating shaft 51.

In this manner, in the rotating shaft 51 combined by the tip end member 55, the tip end member elastic member 65, and the pin 67, the side on which the tip end member 55 is not disposed is inserted toward the bottom plate 46 side of the shaft member holding portion 45 formed on the inner side of the bearing member 40. At this time, as illustrated in FIGS. 12A and 12B, the end portion of the pin 67 protruded from the side surface of the rotating shaft 51 is inserted into the spiral groove 47 formed in the shaft member holding portion 45 of the bearing member 40.

In addition, as can be ascertained from FIG. 11, on the inner side of the bearing member 40, the rotating shaft elastic member 66 is disposed between the rotating shaft 51 and the bottom plate 46. Therefore, one side of the rotating shaft elastic member 66 comes into contact with the rotating shaft 51, and the other side of the rotating shaft elastic member 66 comes into contact with the bottom plate 46. Accordingly, the rotating shaft 51 is biased in the direction in which the rotating shaft elastic member 66 biases the rotating shaft 51 and makes the rotating shaft 51 including the tip end member 55 protrude from the bearing member 40. However, since the tip end of the pin 67 is inserted into the spiral groove 47 of the bearing member 40, and both ends of the spiral groove 47 are blocked as described above, the rotating shaft 51 is held in a state of being biased without falling out of the bearing member 40.

Above, in the posture in which each member is combined, the shaft lines of the bearing member 40, the rotating shaft 51, and the tip end member 55 match each other.

Figure 13:
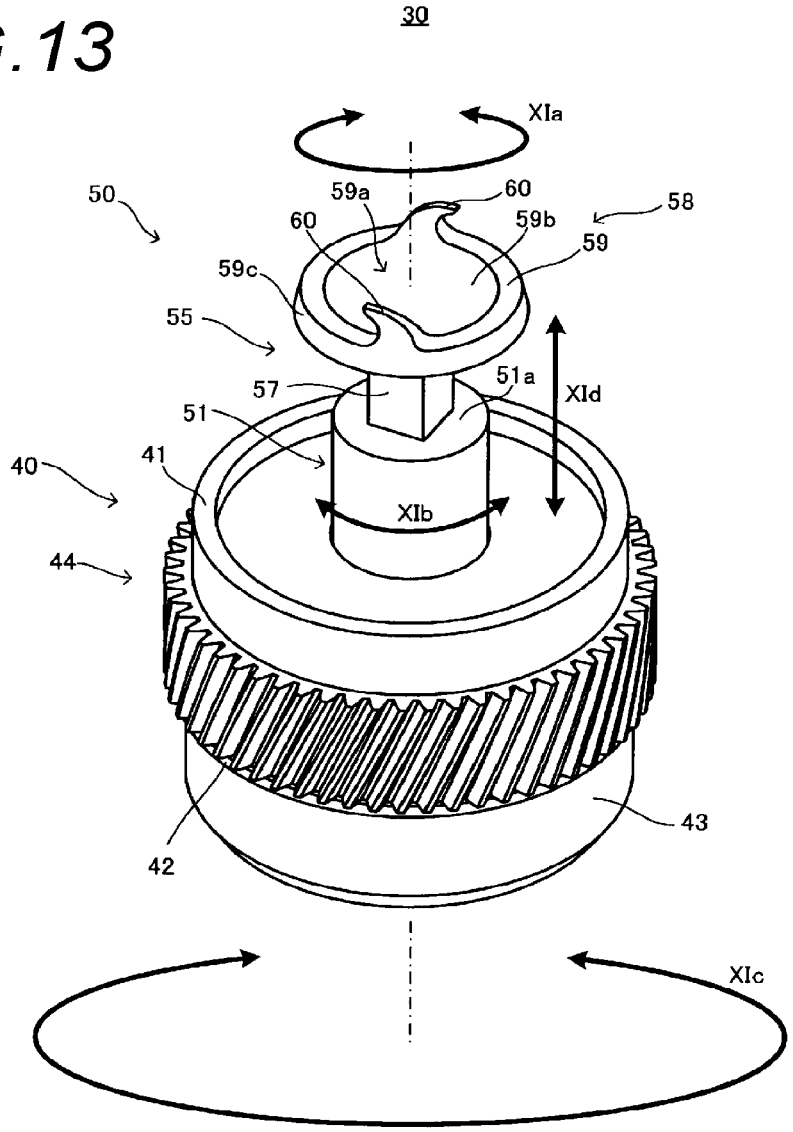
FIG. 13 is a perspective view of the end member 30.

Next, how the end member 30 can be deformed, move, and rotate, will be described. FIG. 13 is a perspective view in one posture of the end member 30.

In the postures illustrated in FIGS. 11 to 13, the entire shaft member 50 is in a posture of being protruded the most from the bearing member 40 within a possible range, by the tip end member elastic member 65 and the rotating shaft elastic member 66. When any external force is not applied to the shaft member 50, the end member 30 is in this posture.

From this posture, as illustrated by an arrow XIa in FIGS. 11 and 13, when the rotating force around the shaft line is applied to the rotating force receiving member 58 of the tip end member 55, following this, the shaft 57 rotates. Since the shaft 57 and the opening portion 51*b* of the rotating shaft 51 do not idle, the rotating force is transmitted to the rotating shaft 51, and as illustrated by an arrow XIb in FIGS. 11 and 13, the rotating shaft 51 also rotates.

When the rotating shaft 51 rotates in this manner, the pin 67 also rotates. Then, firstly, the pin 67 presses the side wall of the spiral groove 47, transmits the rotation to the bearing member 40, and as illustrated by an arrow XIc in FIGS. 11 and 13, the bearing member 40 rotates. Accordingly, the photosensitive drum 11 attached to the bearing member 40 also rotates around the shaft line.

Secondly, since the tip end of the pin 67 is inserted into the spiral groove 47, when the rotating shaft 51 rotates, as illustrated by an arrow XIIc in FIG. 12B, the pin 67 also moves in the shaft line direction. Accordingly, the rotating shaft 51 to which the pin 67 is attached, and the tip end member 55 attached thereto, also moves against the biasing force of the rotating shaft elastic member 66 as illustrated by an arrow XId in FIGS. 11 and 13, or in the biasing direction.

Therefore, in the end member 30, according to the rotation of the rotating force receiving member 58, the rotation around the shaft line of the end member 30 and the movement of the rotating shaft 51 and the tip end member 55 in the direction along the shaft line, are also performed.

Figure 14:
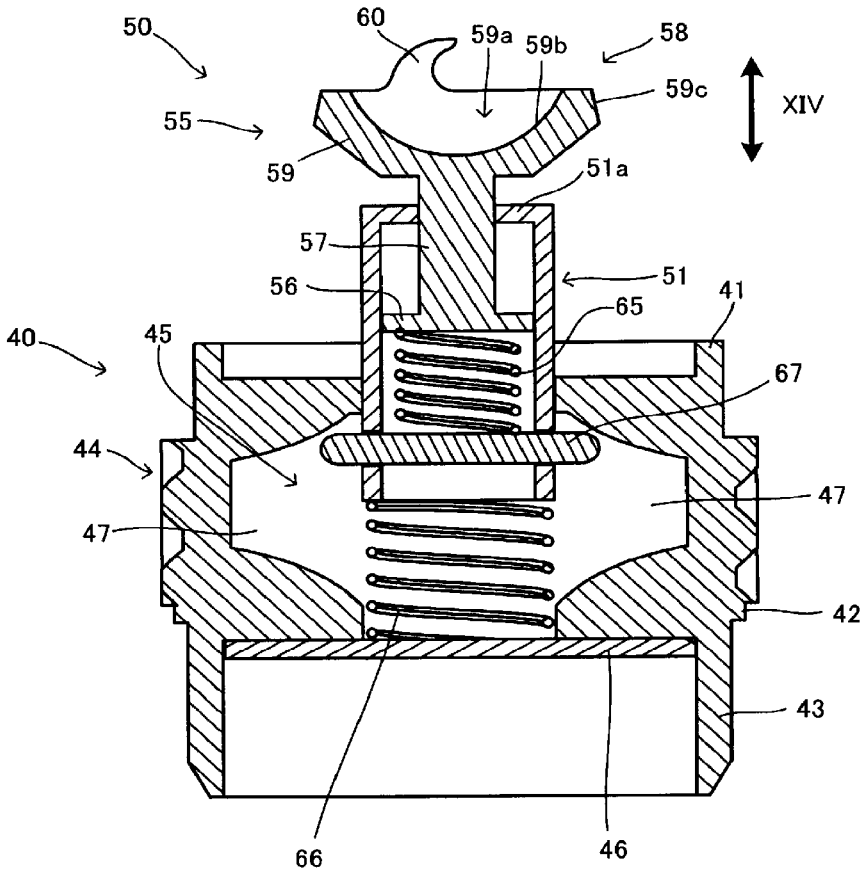
FIG. 14 is a sectional view of the end member 30.

In addition to the description above, the end member 30 can be deformed as follows. FIG. 14 is a diagram illustrating this. FIG. 14 is a diagram from the same viewpoint as that of FIG. 11. In other words, in the end member 30, when the force is applied to the rotating force receiving member 58 of the tip end member 55 in the shaft line direction, other members are not deformed as illustrated by an arrow XIV in FIG. 14, and only the tip end member 55 moves in the shaft line direction.

Figure 16A:
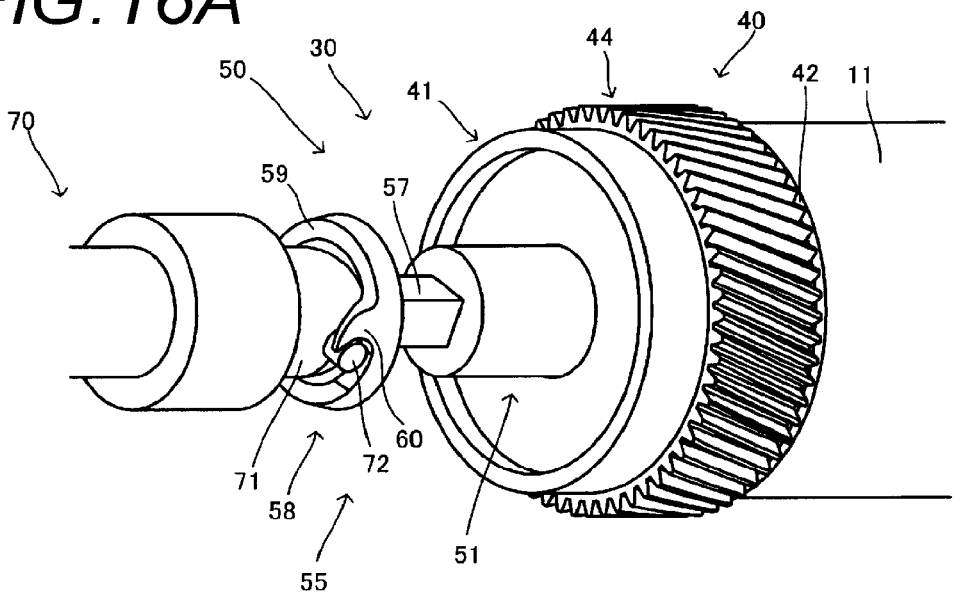
FIG. 16A is a perspective view of a situation in which the driving shaft 70 and the end member 30 are engaged with each other.
Figure 17:
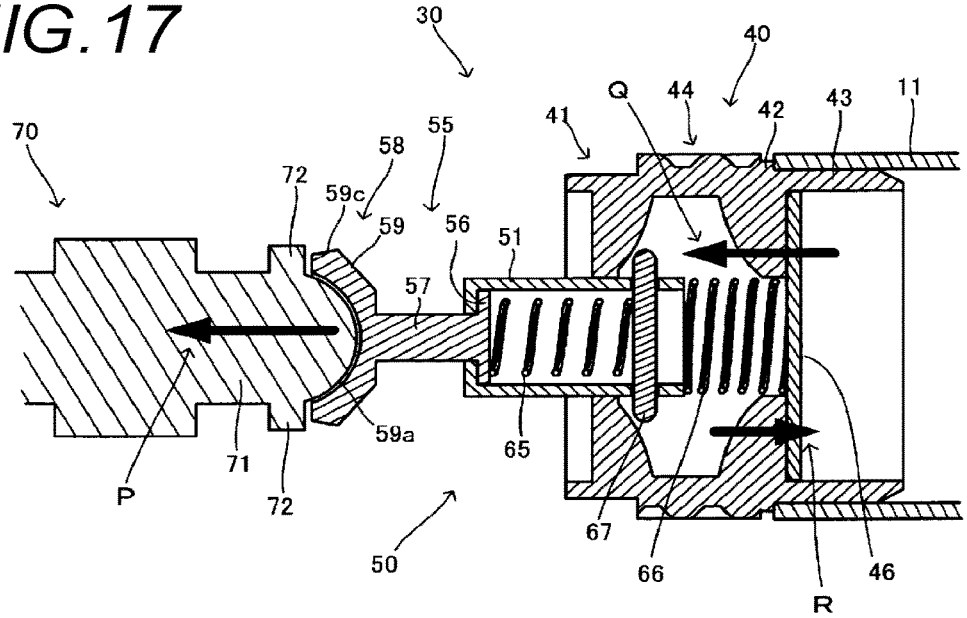
FIG. 17 is a sectional view along the shaft line direction of a situation in which the driving shaft 70 and the end member 30 are engaged with each other.

As illustrated in FIG. 3, in the above-described end member 30, the fitting portion 43 of the end member 30 is inserted and adhered to one end portion of the photosensitive drum 11 (refer to FIGS. 16A and 17). In addition, the lid member 20 is disposed in the other end portion of the photosensitive drum 11, and the photosensitive drum unit 10 can be made. In the photosensitive drum unit 10, the shaft lines of the end member 30, the photosensitive drum 11, and the lid member 20 match each other.

Next, the apparatus body 2 will be described. The apparatus body 2 in the aspect is a body of a laser printer. In the laser printer, the above-described process cartridge 3 operates in a mounted posture, and when the image is formed, the photosensitive drum 11 is rotated, and charging is performed by the charging roller. In this state, the photosensitive drum 11 is irradiated with the laser light which corresponds to image information by using various optical members provided here, and the electrostatic latent image which is based on the image information is obtained. The latent image is developed by the developing roller unit.

Meanwhile, the recording medium, such as a paper sheet, is set in the apparatus body 2, and is conveyed to a transfer position by a sending roller or a conveying roller, which is provided in the apparatus body 2. A transfer roller 1*a* (refer to FIG. 2) is disposed at the transfer position, voltage is applied to the transfer roller following the passage of the recording medium, and the image is transferred to the recording medium from the photosensitive drum 11. After this, the image is fixed to the recording medium as heat and voltage are applied to the recording medium. In addition, the recording medium on which the image from the apparatus body 2 is formed is discharged by a discharge roller.

In this manner, in a posture in which the process cartridge 3 is mounted, the apparatus body 2 applies the rotation driving force to the photosensitive drum unit 10. Here, how the rotation driving force is applied to the photosensitive drum unit 10 from the apparatus body 2 in a posture in which the process cartridge 3 is mounted, will be described.

Figure 15A:
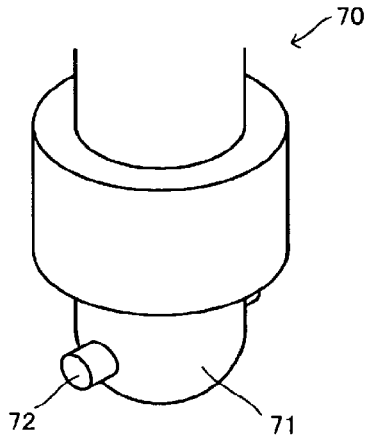
FIG. 15A is a perspective view of a driving shaft 70.
Figure 15B:
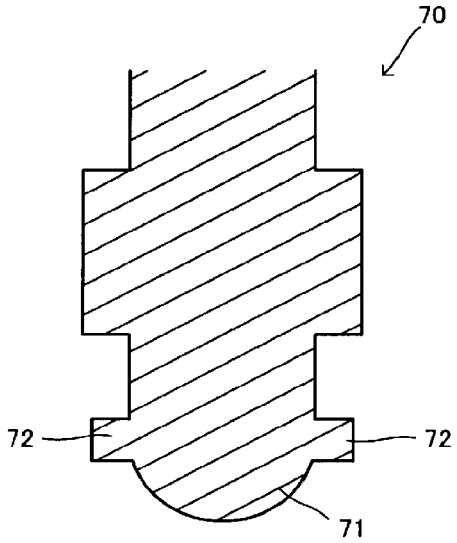
FIG. 15B is a sectional view of the driving shaft 70.

The rotation driving force to the process cartridge 3 is applied by the driving shaft 70 which serves as a rotating force imparting portion of the apparatus body 2. FIG. 15A is a perspective view of the shape of the tip end portion of the driving shaft 70. In addition, FIG. 15B is a sectional view along the shaft line direction of the driving shaft 70. As can be ascertained from the drawings, the driving shaft 70 is configured to include the shaft portion 71 and the engaging projection 72.

The shaft portion 71 is a shaft member which rotates around the shaft line. In the aspect, as can be ascertained from FIGS. 15A and 15B, the tip end thereof is formed in a hemispherical shape. In addition, the tip end portion of the shaft portion 71 has a size to be capable of being disposed between two engaging members 60 for example, refer to FIG. 4) of the rotating force receiving member 58 of the above-described shaft member 50. In this manner, as a smooth shape in which angle portions are removed in the tip end portion, the driving shaft 70 and the shaft member 50 are smoothly engaged with each other corresponding to the shape of the receiving member 59 of the rotating force receiving member 58.

On the side opposite to the tip end side illustrated in FIG. 15A of the shaft portion 71, a gear train is formed to be capable of rotating the shaft portion 71 around the shaft line, and is connected to a motor which is a driving source via the gear train.

The engaging projections 72 are two pillar-like members which are provided to be close to the tip end of the shaft portion 71, and extend in the direction orthogonal to the shaft line of the shaft portion 71. In addition, the two engaging projections 72 are disposed in one same diameter direction on the section of the shaft portion 71.

Here, the shaft portion 71 of the driving shaft 70 is disposed to protrude substantially perpendicularly to the moving direction for attaching and detaching the process cartridge 3 to and from the apparatus body 2 illustrated by I in FIG. 1. In addition to this, the shaft portion 71 only rotates without moving in the shaft line direction. Therefore, in attaching and detaching the process cartridge 3, it is necessary to mount and disengage the shaft member 50 to and from the driving shaft 70. In addition, according to the above-described end member 30, it becomes easy to mount and disengage the shaft member 50 to and from the driving shaft 70. A specific aspect of the attachment and detachment will be described later.

Figure 16B:
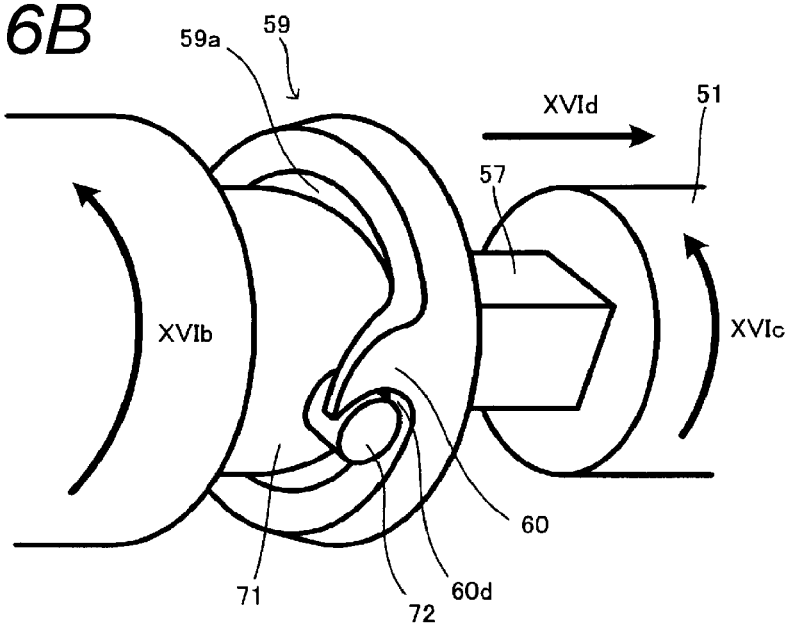
FIG. 16B is an enlarged perspective view of the engaged part.

In a posture in which the process cartridge 3 is mounted on the apparatus body 2, the driving shaft 70 and the rotating force receiving member 58 provided in the shaft member 50 of the end member 30 are engaged with each other, and the rotating force is transmitted. FIG. 16A is a perspective view illustrating a situation in which the rotating force receiving member 58 of the end member 30 is engaged with the driving shaft 70. In addition, FIG. 16B is an enlarged view illustrating the engaged situation. Furthermore, FIG. 17 is a sectional view along the shaft line direction.

As can be ascertained from FIGS. 16A, 16B, and 17, in the posture in which the driving shaft 70 and the rotating force receiving member 58 are engaged with each other, the shaft line of the driving shaft 70 and the shaft line of the shaft member 50 are disposed to abut against each other to match each other. At this time, the tip end of the shaft portion 71 of the driving shaft 70 gets into between two engaging members 60 of the rotating force receiving member 58, and is disposed on the inner side of the recessed portion 59*a* of the receiving member 59.

In addition, the engaging projection 72 of the driving shaft 70 is engaged to be hooked to the engaging member 60 of the rotating force receiving member 58 from the side surface. At this time, the engaging projection 72 gets into the inner side of the recessed portion 60*d* of the engaging member 60.

In this posture, as illustrated in by an arrow XVIb in FIG. 16B, when the driving shaft 70 rotates in the rotating force transmitting direction, the engaging projection 72 enters the recessed portion 60*d* of the engaging member 60, and is hooked to the engaging member 60, and the rotating force is transmitted as illustrated by an arrow XVIc in FIG. 16B. At this time, the rotating shaft 51 moves in the direction illustrated by XVId in FIG. 16B by the actions of the spiral groove 47 of the bearing member 40 and the pin 67. However, since the engaging projection 72 of the driving shaft 70 gets into and is engaged with the recessed portion 60*d* of the engaging member 60 of the rotating force receiving member 58, the engagement of the engaging projection 72 and the recessed portion 60*d* is not released, and stable linking is maintained. A force which moves in the direction illustrated by an arrow XVId is a force which pulls the driving shaft 70, and the force acts to further stabilize the rotation.

However, at this time, the pulling force by the spiral groove 47 is weaker than the force by which the engaging member 60 is engaged with the driving shaft 70. More specifically, it is preferable to configure as follows.

As schematically illustrated in FIG. 17, it is preferable that the following established expression in a pulling force by the engaging member illustrated by P, a biasing force of the rotating shaft elastic member illustrated by Q, and a force in the shaft line direction by the spiral groove illustrated by R, is the condition of the rotation driving.

$$R \leq P+Q$$

Here, P is a force which moves in the direction of approaching the driving shaft of the apparatus body during the driving rotation by the shape of the engaging member of the tip end member, Q is a force which is generated by the rotating force elastic member, and moves in the direction of approaching the driving shaft of the apparatus body, and R is a force which is generated by the spiral groove of the body during the rotation driving, and is moved in the direction of separating the rotating shaft from the driving shaft of the apparatus body.

Next, an example of operations of the driving shaft 70 and the photosensitive drum unit 10 when the process cartridge 3 is mounted on the apparatus body 2, and are in a posture illustrated in FIGS. 16A, 16B, and 17. The description of the first example is illustrated in FIGS. 18 and 19, and the description of the second example is illustrated in FIGS. 20 and 21.

Figure 18A:
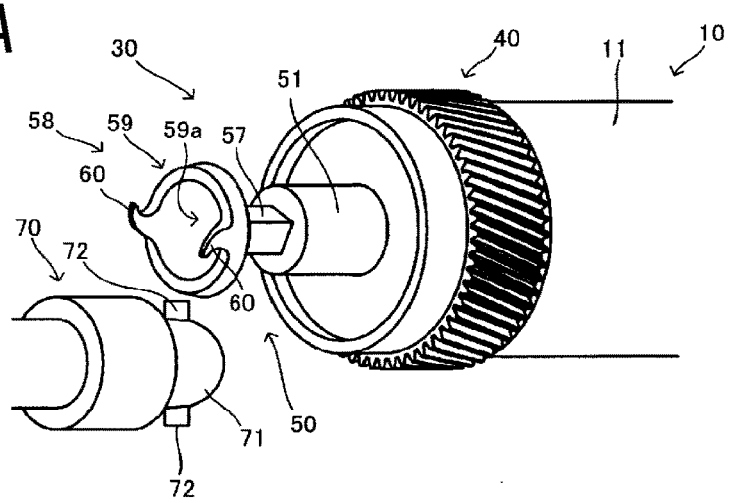
FIG. 18A is a perspective view illustrating a situation in which the driving shaft 70 and the photosensitive chum unit 10 are engaged with each other.
Figure 18B:
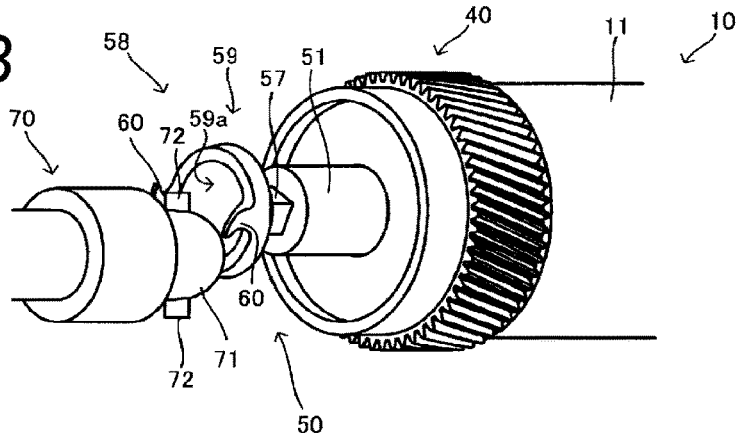
FIG. 18B is a perspective view illustrating another situation in which the driving shaft 70 and the photosensitive drum unit 10 are engaged with each other.
Figure 18C:
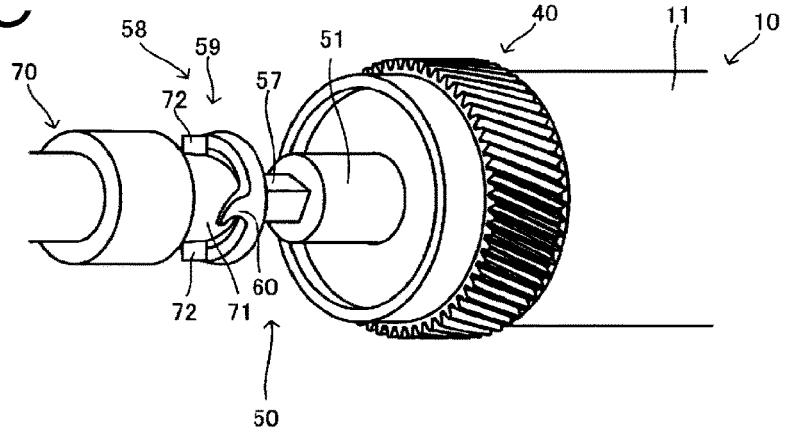
FIG. 18C is a perspective view illustrating still another situation in which the driving shaft 70 and the photosensitive drum unit 10 are engaged with each other.

Regarding the first example, FIG. 18 is a perspective view following the order of a process in which the driving shaft 70 is engaged with the rotating force receiving member 58 by FIGS. 18A to 18C. FIG. 19 is a sectional view of the posture of FIG. 18B along the shaft line direction.

First, from the direction orthogonal to the shaft line direction of the driving shaft 70 as illustrated in FIG. 18B from the state illustrated in FIG. 18A, the photosensitive drum unit 10 approaches. At this time, the end member 30 is oriented toward the driving shaft 70 side, the shaft line has an orientation parallel to the shaft line of the driving shaft 70, and the photosensitive drum unit 10 approaches the driving shaft 70 while moving in the direction orthogonal to the shaft line. At this time, the shaft member 50 is in a posture illustrated in FIG. 11.

Figure 19:
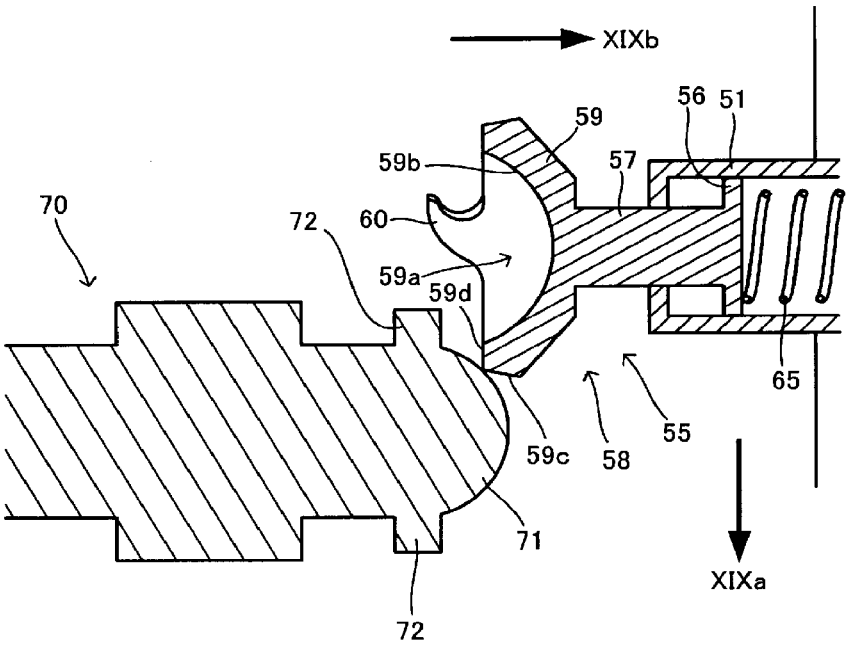
FIG. 19 is a sectional view along the shaft line direction in the situation of FIG. 18B.

In a situation illustrated in FIGS. 18B and 19, the driving shaft 70 comes into contact with the outer circumferential surface of the receiving member 59 of the rotating force receiving member 58. At this time, as illustrated in FIG. 19, the tip end member 55 moves in the direction illustrated by an arrow XIXb, with respect to the movement in the direction illustrated by an arrow XIXa of the photosensitive drum unit 10 (modification described in FIG. 14). Therefore, the tip end of the driving shaft 70 climbs over the edge portion 59*d* of the rotating force receiving member 58, and a posture illustrated in FIG. 18C is achieved. After this, as the driving shaft 70 is rotated, a posture illustrated in FIG. 16A is achieved.

Here, as illustrated in FIGS. 18B and 19, as the inclined surface 59*c* is provided in the outer circumferential portion of the receiving member 59, the tip end member 55 more smoothly moves (movement in the direction of the arrow XIXb).

Figure 20A:
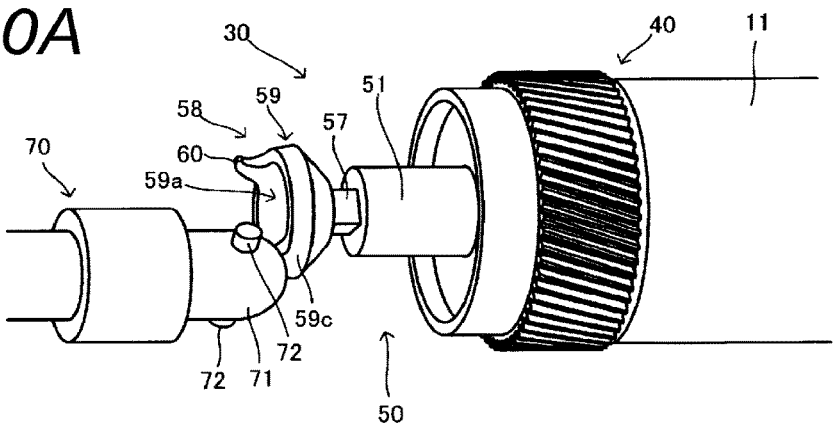
FIG. 20A is a perspective view illustrating a situation in which the driving shaft 70 and the photosensitive drum unit 10 are engaged with each other.
Figure 20B:
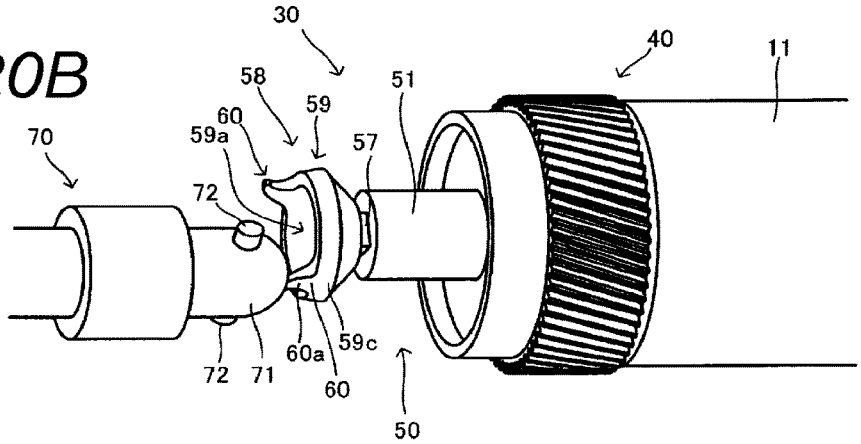
FIG. 20B is a perspective view illustrating another situation in which the driving shaft 70 and the photosensitive drum unit 10 are engaged with each other.
Figure 20C:
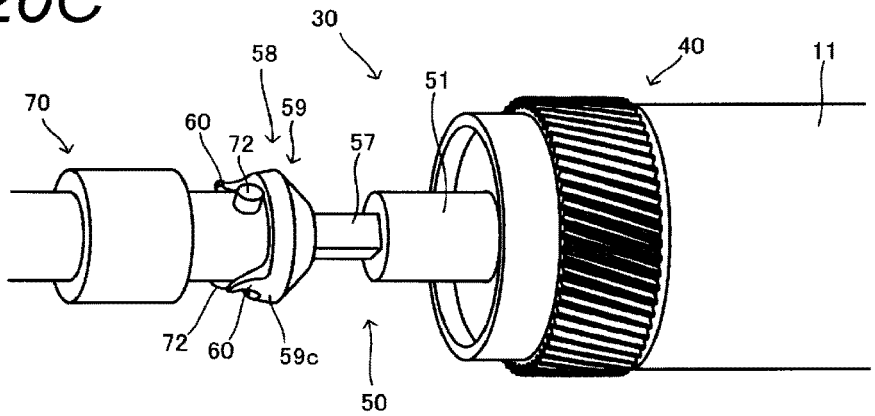
FIG. 20C is a perspective view illustrating still another situation in which the driving shaft 70 and the photosensitive drum unit 10 are engaged with each other.
Figure 21:
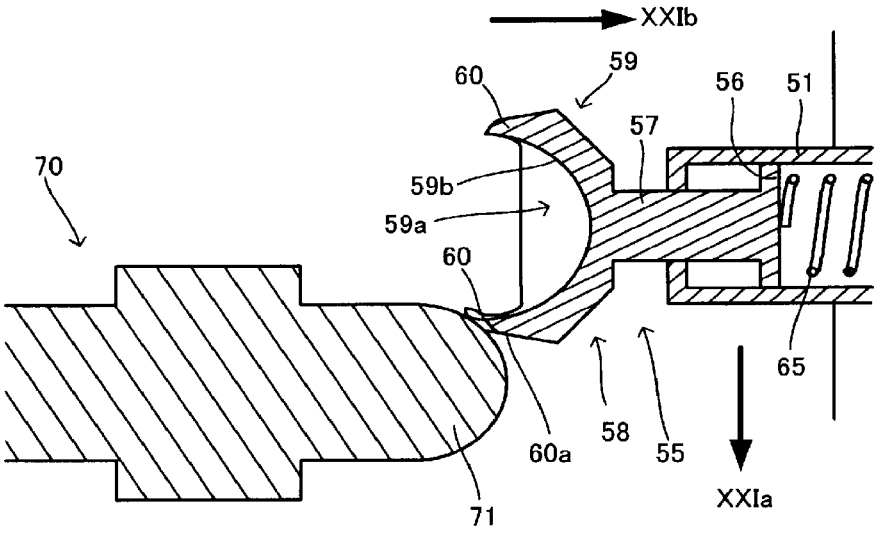
FIG. 21 is a sectional view along the shaft line direction in the situation of FIG. 20B.

Regarding the second example, FIG. 20 is a perspective view of an order of a process in which the driving shaft 70 is engaged with the rotating force receiving member 58 in FIGS. 20A to 20C. FIG. 21 is a sectional view of the posture of FIG. 20B along the shaft line direction.

First, from the direction orthogonal to the shaft line direction of the driving shaft 70 as illustrated in FIG. 20B from the state illustrated in FIG. 20A, the photosensitive drum unit 10 approaches. At this time, the end member 30 is oriented toward the driving shaft 70 side, the shaft line has an orientation parallel to the shaft line of the driving shaft 70, and the photosensitive drum unit 10 approaches the driving shaft 70 while moving in the direction orthogonal to the shaft line. At this time, the shaft member 50 is in a posture illustrated in FIG. 11.

In a situation illustrated in FIGS. 20B and 21, the driving shaft 70 comes into contact with surface 60*a* which is the outer circumferential surface of the engaging member 60 of the rotating force receiving member 58. At this time, as illustrated in FIG. 21, the tip end member 55 moves in the direction illustrated by an arrow XXIb, with respect to the movement in the direction illustrated by an arrow XXIa of the photosensitive drum unit 10 (modification described in FIG. 14). Therefore, the tip end of the driving shaft 70 climbs over the engaging member 60 of the rotating force receiving member 58, and a posture illustrated in FIG. 20C is achieved. After this, as the driving shaft 70 is rotated, a posture illustrated in FIG. 16A is achieved.

Here, as illustrated in FIGS. 20B and 21, as the surfaces 60*a* and 60*c* which are the inclined surfaces are provided in the engaging member 60, the tip end member 55 more smoothly moves (movement in the direction of the arrow XXIb).

Figure 22A:
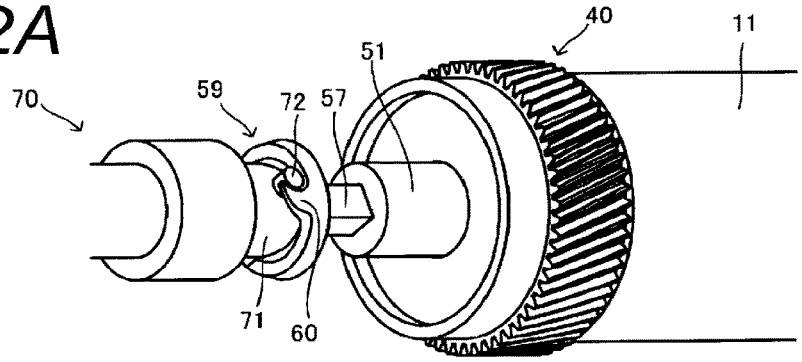
FIG. 22A is a perspective view illustrating a situation in which the photosensitive drum unit 10 is disengaged from the driving shaft 70.
Figure 22B:
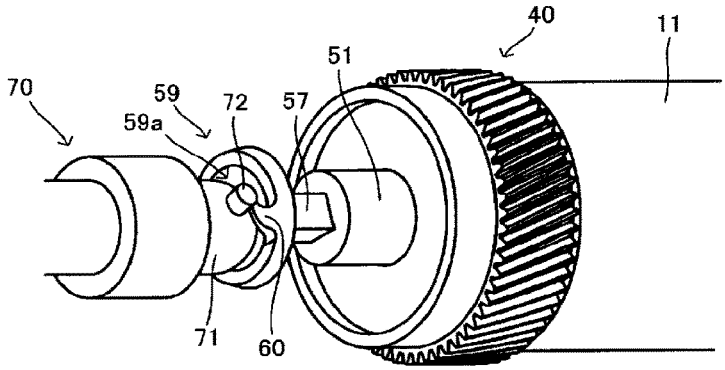
FIG. 22B is a perspective view illustrating another situation in which the photosensitive drum unit 10 is disengaged from the driving shaft 70.
Figure 22C:
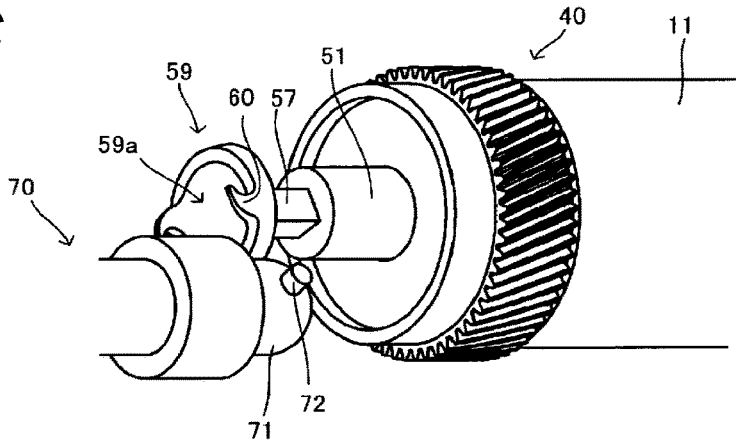
FIG. 22C is a perspective view illustrating still another situation in which the photosensitive drum unit 10 is disengaged from the driving shaft 70.
Figure 23:
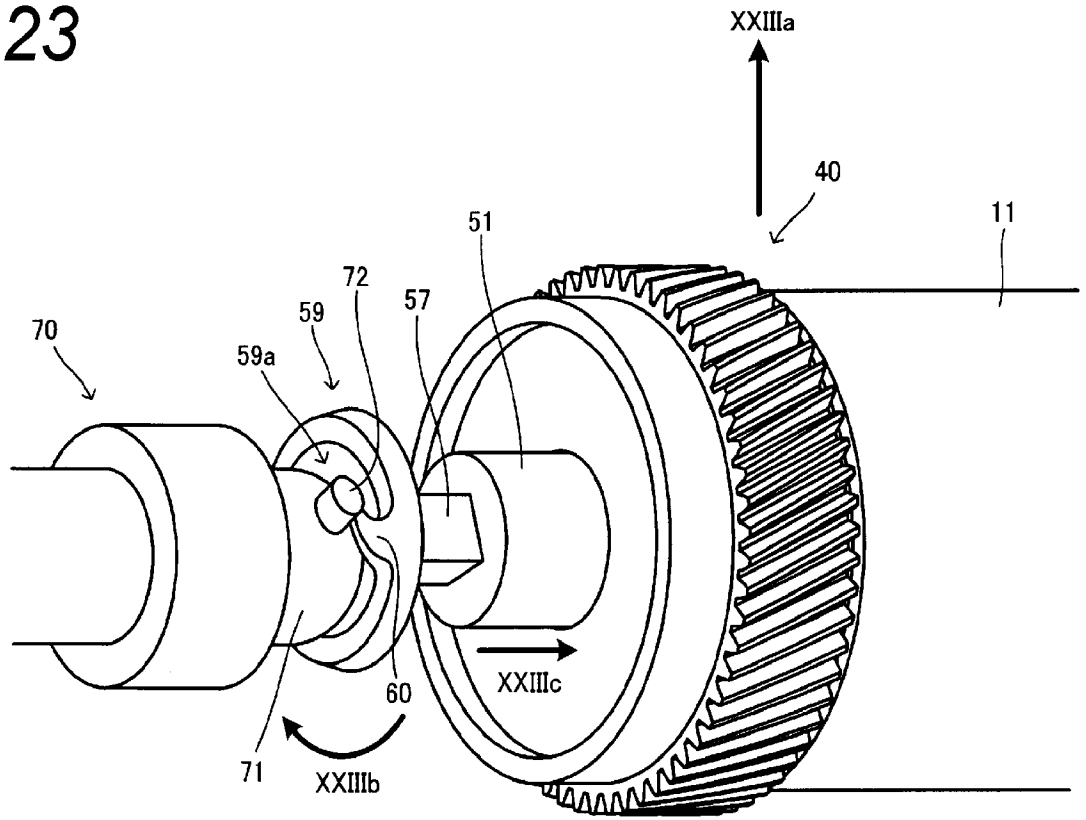
FIG. 23 is a diagram enlarging FIG. 22B.

Next, an example of operations of the driving shaft 70 and the photosensitive drum unit 10 when the process cartridge 3 is disengaged from a posture in which the process cartridge 3 is mounted on the apparatus body 2, will be described. Views for the description are illustrated in FIGS. 22 and 23. FIG. 22 is a perspective view following the order of a process in which the rotating force receiving member 58 is disengaged from the driving shaft 70 in FIG. 22A to 22C. FIG. 23 is an enlarged view of FIG. 22B.

First, in the direction orthogonal to the shaft line direction of the driving shaft 70 as illustrated in FIG. 22B from the state illustrated in FIG. 22A, the photosensitive drum unit 10 is moved in the pulling direction. When pulling the photosensitive drum unit 10 in this manner, one of two engaging members 60 is engaged in the direction of interrupting the pulling. Therefore, until here, smooth disengagement is not possible. However, in the aspect, when the photosensitive drum unit 10 is moved in the direction illustrated by an arrow XXIIIa in FIG. 23, the rotating force receiving member 58 moves in the direction illustrated by an arrow XXIIIb in FIG. 23 due to the relationship between one engaging member 60 and the engaging projection 72 of the driving shaft 70. Then, the tip end member 55 rotates, and while being interlocked to the rotation, the rotating shaft 51 also rotates. Therefore, by the above-described action of the spiral groove 47, the rotating shaft 51 and the tip end member 55 move in the direction illustrated by an arrow XXIIIc in FIG. 23. The engaging member 60 is disengaged from the engaging projection 72 due to the rotation and the movement of the rotating force receiving member 58, and as illustrated in FIG. 22C, the disengagement is completed.

Here, since the bottom surface 59*b* of the recessed portion 59*a* of the receiving member 59 and the surface 60*b* of the engaging member 60 are formed to be inclined, more smooth disengagement becomes possible.

As described above, the process cartridge 3 is mounted on the apparatus body 2 to be pushed from the direction which is different from the shaft line direction of the driving shaft 70 of the apparatus body 2, and the disengagement is also smoothly performed.

In addition, according to the end member 30, due to the rotation in the shaft line direction and the movement in the direction orthogonal to the shaft line direction without a necessity to oscillate the shaft member 50, smoother attachment to and detachment from the driving shaft 70 become possible with respect to the end member 30. In addition, productivity is also improved from the viewpoint that it is possible to set a large tolerance to the dimension with respect to the shaft member which requires oscillation.

In addition, as described above, interruption of the attachment and detachment by the members is unlikely to occur in the middle of the attachment and detachment of the process cartridge, and smoother attachment and detachment are performed.

In addition, except for an inevitable aspect caused by dimension rattling, the shaft member is configured to be regulated not to be inclined. Specifically, for example, the dimensions of each member are configured not to exceed the rattling to the extent of not hindering the smooth operation, and not to prevent generate a void.

Figure 24A:
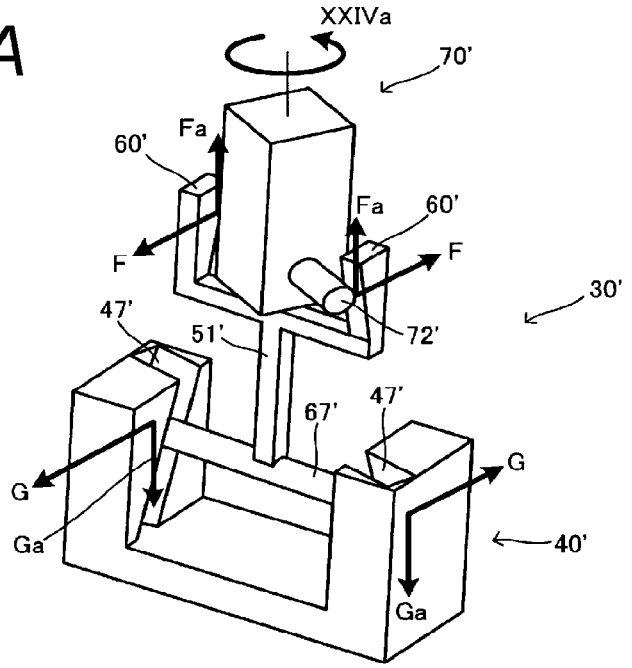
FIG. 24A is a schematic view illustrating a force generated in a posture in which a rotating force is transmitted.
Figure 24B:
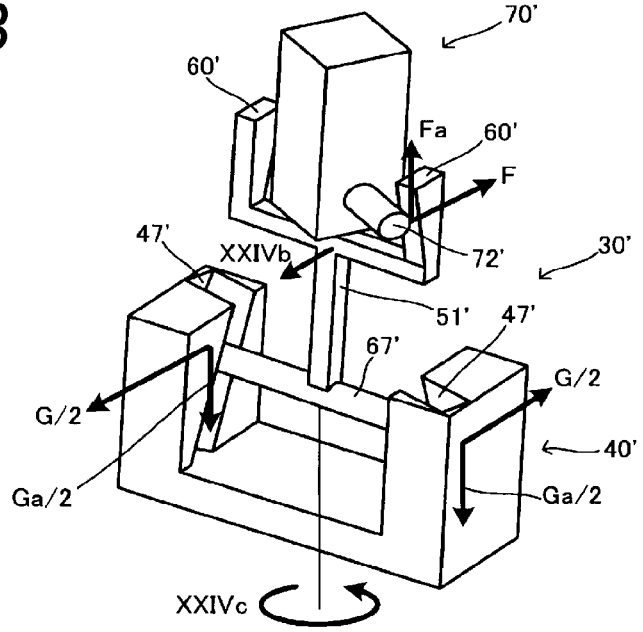
FIG. 24B is a schematic view illustrating a force generated in a situation in which the process cartridge is disengaged.

Next, a modification example will be described. As described above, the process cartridge 3 can be smoothly attached to and detached from the apparatus body 2. Meanwhile, furthermore, the following configuration is possible for making more smooth attachment and detachment possible. FIG. 24 is a schematic view illustrating an idea. FIG. 24A is a schematic view of the posture which corresponds to FIG. 16A in a view of a state where the rotating force is transmitted to an end member 30' of the process cartridge from a driving shaft 70' of the apparatus body, and FIG. 24B is a schematic view of a posture which corresponds to FIG. 23 in a view of a situation in which the end member 30' of the process cartridge is disengaged from the driving shaft 70' of the apparatus body.

In FIG. 24A, in a posture in which an engaging projection 72' of the driving shaft 70' is engaged with two engaging members 60' of the end member 30', the engaging projection 72' rotates as illustrated by an arrow XXIVa around the shaft line of the driving shaft 70'. In addition, the rotating force transmitted to the engaging member 60' rotates a shaft 51', and further, rotates a pin 67' around the shaft line of a shaft 51'. Both ends of the pin 67' are inserted into a spiral groove 47' of a bearing member 40'. Here, in the description, in the engaging member 60', an inclined surface which is inclined in the direction in which the engaging member 60' is unlikely to be disengaged from the driving shaft 70', the engaging projection 72' comes into contact with the inclined surface, and the rotating force is transmitted.

In the posture illustrated in FIG. 24A, a force which is illustrated by F in FIG. 24A acts on the engaging member 60' from the engaging projection 72' by the rotation of the driving shaft 70', and at this time, as described above, since the engaging member 60' is in contact with the engaging projection 72' on the inclined surface, a component of force acts upward on the paper surface as illustrated by Fa. Since the same components of force Fa are generated in each of two engaging members 60', when the components of force are combined, 2·Fa is obtained.

Meanwhile, the pin 67' presses a side wall of the spiral groove 47' by the transmitted rotating force, by a force illustrated by G in FIG. 24A. However, since the side wall of the spiral groove 47' is an inclined surface which is inclined with respect to the direction along the shaft line of the end member 30', a component of force acts downward on the paper surface as illustrated by Ga. The component of force Ga is a force in the orientation opposite to the above-described component of force Fa. Since the same components of force Ga are generated at each of both ends of the pin 67', when the components of force are combined, 2·Ga is obtained.

In a situation of FIG. 24A, from the viewpoint that the rotating force is stably transmitted, since it is necessary that the engaging member 60' and the driving shaft 70' are not disengaged from each other, 2·Fa>2·Ga, that is, the following is preferable.

$$Fa > Ga \quad (1)$$

Meanwhile, in FIG. 24B, in a posture in which the engaging projection 72' of the driving shaft 70' is engaged with two engaging members 60' of the end member 30', the end member 30' is moved in the direction of the arrow XXIVb. Then, it is possible to assume that the force F is applied to one of two engaging members 60'. In addition, accordingly, the pin 67' is considered to rotate in the direction of the arrow XXIVc around the shaft line of the shaft 51'.

Then, in the posture illustrated in FIG. 24B, the force acts as illustrated by F in FIG. 24B with respect to the engaging member 60' from the engaging projection 72', and at this time, as described above, since the engaging member 60' is in contact with the engaging projection 72' on the inclined surface, the component of force acts upward on the paper surface as illustrated by Fa. Since the component of force Fa is generated in one engaging member 60', the total force is also Fa.

Meanwhile, the pin 67' presses the side wall of the spiral groove 47' of the bearing member 40' by the transmitted rotating force, but since the force at this time is a half of that in a case of FIG. 24A, the pin 67' presses the side wall by a force of G/2. In addition, since the side wall of the spiral groove 47' is an inclined surface, the component of force acts downward on the paper surface as illustrated by Ga/2. In other words, the component of force Ga/2 is a force in the orientation opposite to the above-described Fa. Since the components of force Ga/2 are generated at each of both ends of the pin 67', when the components of force are combined, Ga is obtained.

In the situation of FIG. 24B, from the viewpoint that the end member 30' and the driving shaft 70' are easily disengaged from each other, the following is preferable.

$$Fa<Ga \quad (2)$$

Here, when comparing the expression (1) and the expression (2), preferable force relationships are opposite to each other. Accordingly, there is a concern that it is difficult to achieve both ensuring the smooth rotating force transmission and more simple attachment and detachment of the process cartridge. Meanwhile, for example, it is possible to solve the problem by the following aspect.

Figure 25:
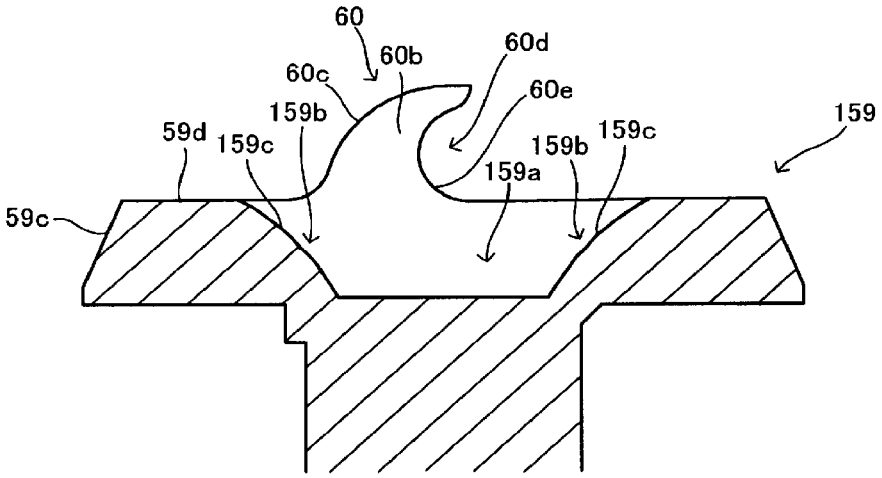
FIG. 25 is a diagram illustrating a receiving member 159.

FIG. 25 is a diagram illustrating a first modification example. FIG. 25 is a sectional view along the shaft line direction illustrating a part of a receiving member 159 provided in the modification example. FIG. 10B is a corresponding view. Parts other than the receiving member 159 correspond to the description of the end member 30 of the first aspect. In addition, in FIG. 25, parts which are the same as those of the receiving member 59 are given the same reference numerals.

In the aspect, a recessed portion 159*a* is formed on the end surface on the side on which the engaging member 60 is formed in the receiving member 159. The recessed portion 159*a* is formed so that the tip end portion of the driving shaft 70 (refer to FIG. 15A) enters here. In addition, as can be ascertained from FIG. 25, a side surface 159*b* of the recessed portion 159*a* is inclined to be widened to the opening side, and further, a projected portion 159*c* is provided.

Figure 26A:
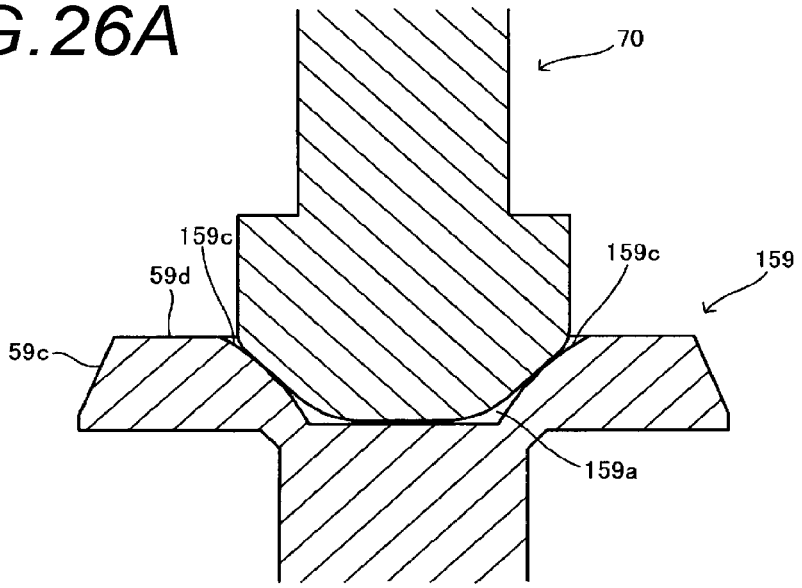
FIG. 26A is a diagram illustrating a posture in which the receiving member 159 is engaged with the driving shaft 70 and transmits the rotating force.

The receiving member 159 acts as follows. FIG. 26 is a situation in which the receiving member 159 is engaged with the driving shaft 70. FIG. 26A illustrates a posture in which the rotating force is transmitted, and FIG. 26B illustrates a situation in which the driving shaft 70 is disengaged from the receiving member 159.

In the posture in which the rotating force is transmitted, as illustrated in FIG. 26A, the receiving member 159 and the driving shaft 70 are engaged with each other as usual, the rotating force is transmitted. At this time, it is possible to configure to satisfy the above-described expression (1).

Figure 26B:
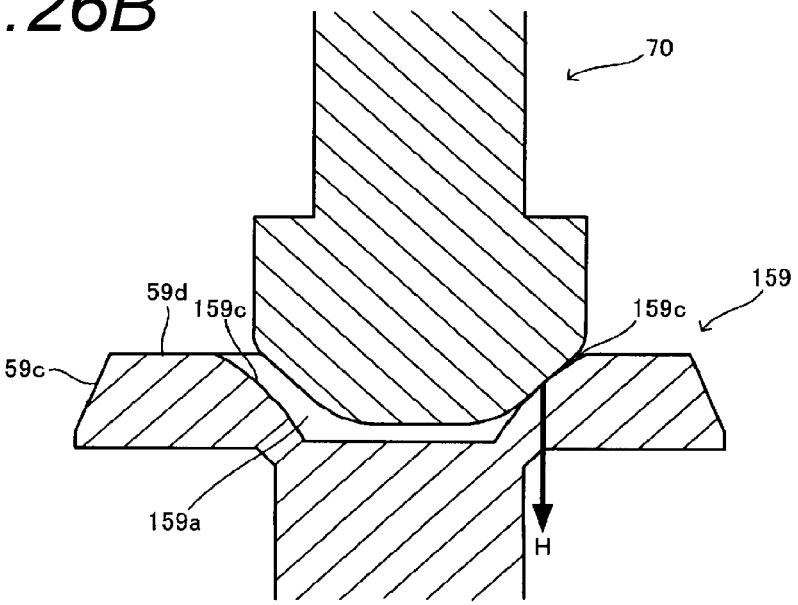
FIG. 26B is a diagram illustrating a situation in which the driving shaft 70 is disengaged from the receiving member 159.

Meanwhile, in a situation where the receiving member 159 (that is, the process cartridge) is disengaged from the driving shaft 70, as illustrated in FIG. 26B, when the process cartridge is moved, the tip end portion of the driving shaft 70 slides on a surface of the projected portion 159*c*. At this time, since the projected portion 159*c* is projected, as illustrated by H in FIG. 26B, a large force is generated in the same direction as that of Ga in the shaft line direction. Therefore, in the modification example, instead of the expression (2), an expression (3) can be employed.

$$Fa \cdot H<Ga \quad (3)$$

According to this, it is possible to establish both the expression (1) and the expression (3), and to more reliably ensure the stabilized transmission of the rotation driving force and smooth disengagement of the process cartridge from the driving shaft 70.

Figure 27:
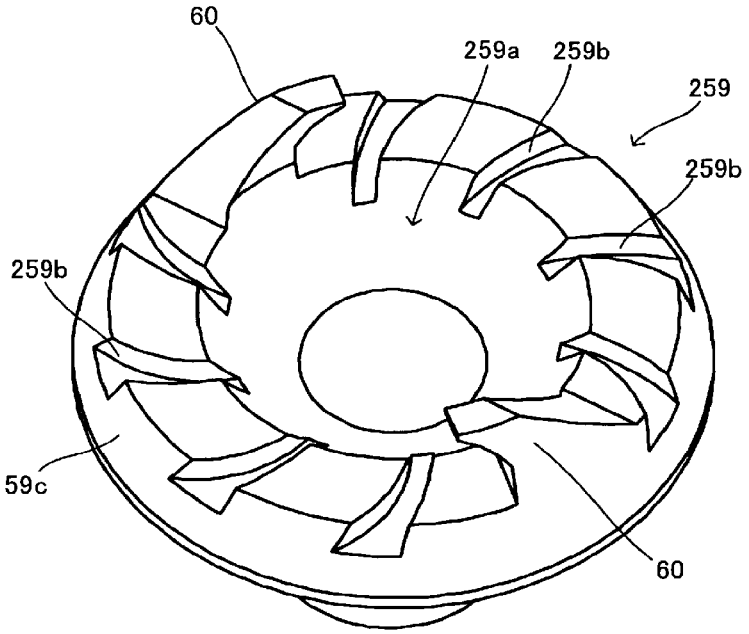
FIG. 27 is a perspective view illustrating a receiving member 259.

FIG. 27 is a diagram illustrating a second modification example. FIG. 27 is a perspective view illustrating a part of the receiving member 259 provided in the modification example, corresponds to FIG. 10A. Parts other than the receiving member 259 correspond to the description of the end member 30 of the above-described first aspect. In addition, in FIG. 27, the same parts as those in the receiving member 59 are given the same reference numerals.

In the aspect, the recessed portion 259*a* is formed on the end surface on the side on which the engaging member 60 of the receiving member 259 is formed. The recessed portion 259*a* is formed so that the tip end portion of the driving shaft 70 (refer to FIG. 15A) enters. In addition, on the side surface of the recessed portion 259*a*, as can be ascertained from FIG. 27, a spiral groove 259*b* which extends in a radial shape when viewed from the shaft line, and is formed to be curved in the circumferential direction around the shaft line, is provided.

Figure 28A:
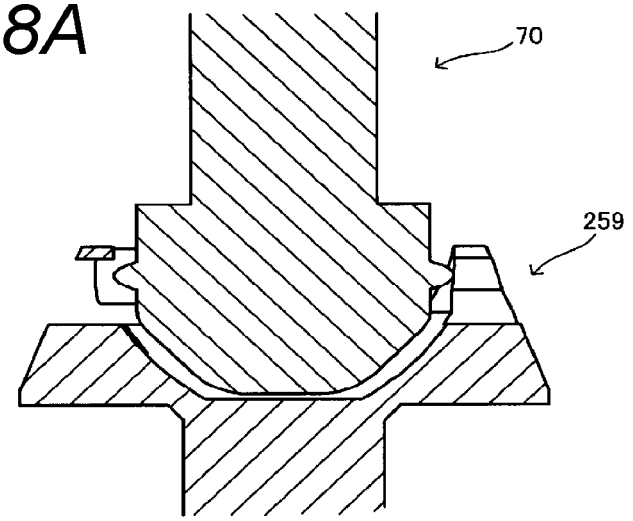
FIG. 28A is a diagram illustrating a posture in which the receiving member 259 is engaged with the driving shaft 70 and transmits the rotating force.
Figure 28B:
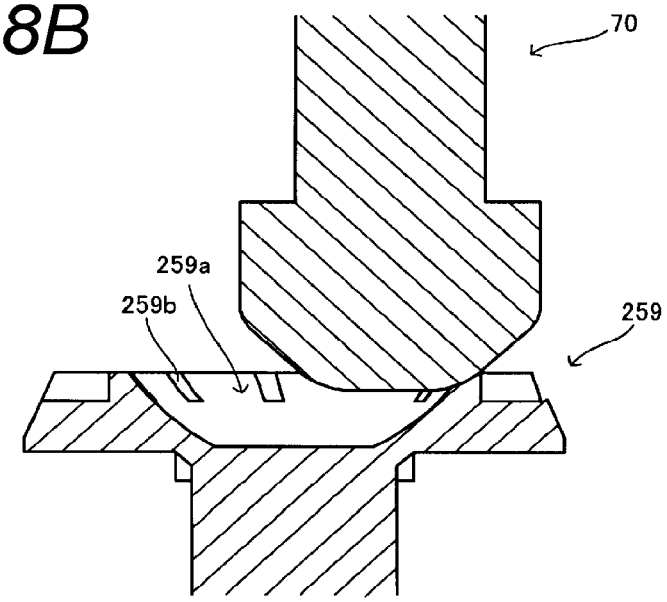
FIG. 28B is a diagram illustrating a situation in which the driving shaft 70 is disengaged from the receiving member 259.
Figure 29:
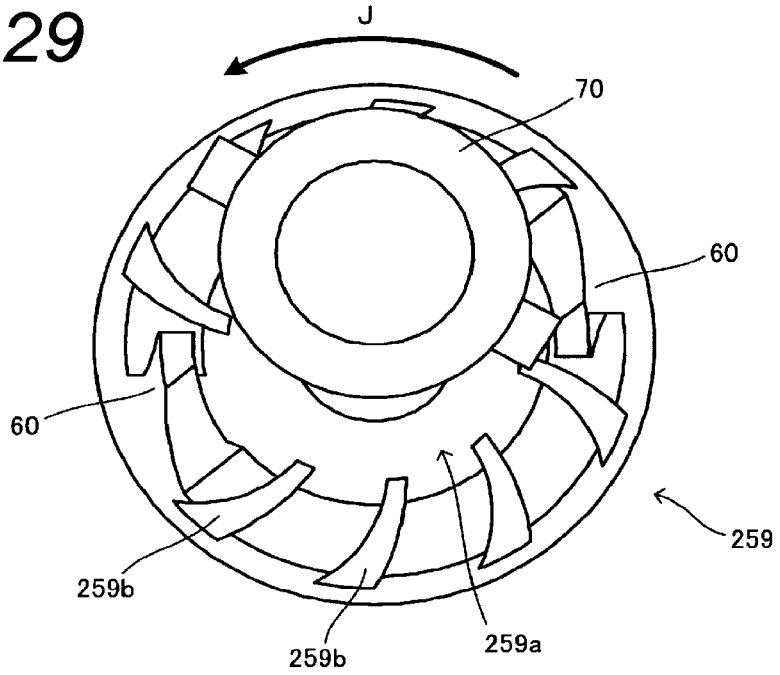
FIG. 29 is another view illustrating a situation in which the driving shaft 70 is disengaged from the receiving member 259.
Figure 30:
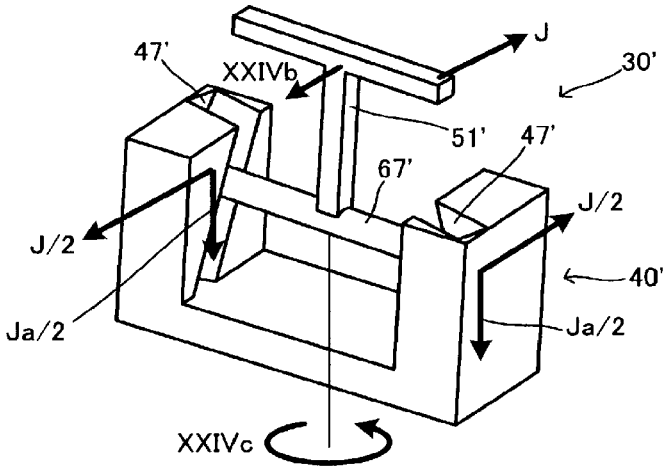
FIG. 30 is a diagram illustrating a force generated when the driving shaft 70 is disengaged from the receiving member 259.

The receiving member 259 acts as follows. FIGS. 28A 28B, 29 and 30 are situations in which the receiving member 259 is engaged with the driving shaft 70. FIG. 28A is a posture in which the rotating force is transmitted, and FIGS. 28B and 29 are situations in which the driving shaft 70 is disengaged from the receiving member 259. FIG. 30 is a diagram illustrating a force generated in the disengaged situation. FIG. 30 is a schematic view in accordance with FIG. 24B.

In the situation in which the rotating force is transmitted, as illustrated in FIG. 28A, the receiving member 259 and the driving shaft 70 are engaged with each other as usual, and the rotating force is transmitted. At this time, it is possible to configure to satisfy the above-described expression (1).

Meanwhile, in the situation in which the receiving member 259 (that is, process cartridge) is disengaged from the driving shaft 70, as illustrated in FIGS. 28B and 29, when the process cartridge is moved, the tip end portion of the driving shaft 70 slides on the spiral groove 259*b*. Accordingly, as illustrated by J in FIG. 29, the rotating force is generated. The J is generated at a part different from the engaging member 60' as illustrated in FIG. 30, the shaft 51' is rotated, and further, the pin 67' is rotated around the shaft line of the shaft 51'. In addition, the pin 67' presses the side wall of the spiral groove 47' of the bearing member 40' by the transmitted rotating force, but the force at this time presses the side wall by a force of J/2 as illustrated in FIG. 30. In addition, since the side wall of the spiral groove 47' is the inclined surface, the component of force acts downward on the paper surface as illustrated by Ja/2. In other words, the component of force Ja/2 is a force in the orientation opposite to the above-described Fa. Since the components of force Ja/2 are generated at each of both ends of the pin 67', when the components of force are combined, Ja is obtained. The Ja is a force which acts in the same orientation as Ga illustrated in FIG. 24B. Therefore, in the modification example, in addition to the relationship of F and G generated by the engaging member 60 as illustrated in FIG. 24B, the above-described force acts based on the J, and instead of the expression (2), an expression (4) can be employed.

$$Fa<Ga+Ja \quad (4)$$

According to the modification example, it is possible to establish both the expression (1) and the expression (4), and to more reliably ensure the stabilized transmission of the rotation driving force and the smooth disengagement of the process cartridge from the driving shaft 70. In addition, since it is preferable that the driving shaft is likely to operate along the spiral groove for generating J more efficiently, it is preferable that the friction of both members is higher. Therefore, the spiral groove may be made by rubber (urethane rubber or the like), and may be made by rubber coating.

Figure 31:
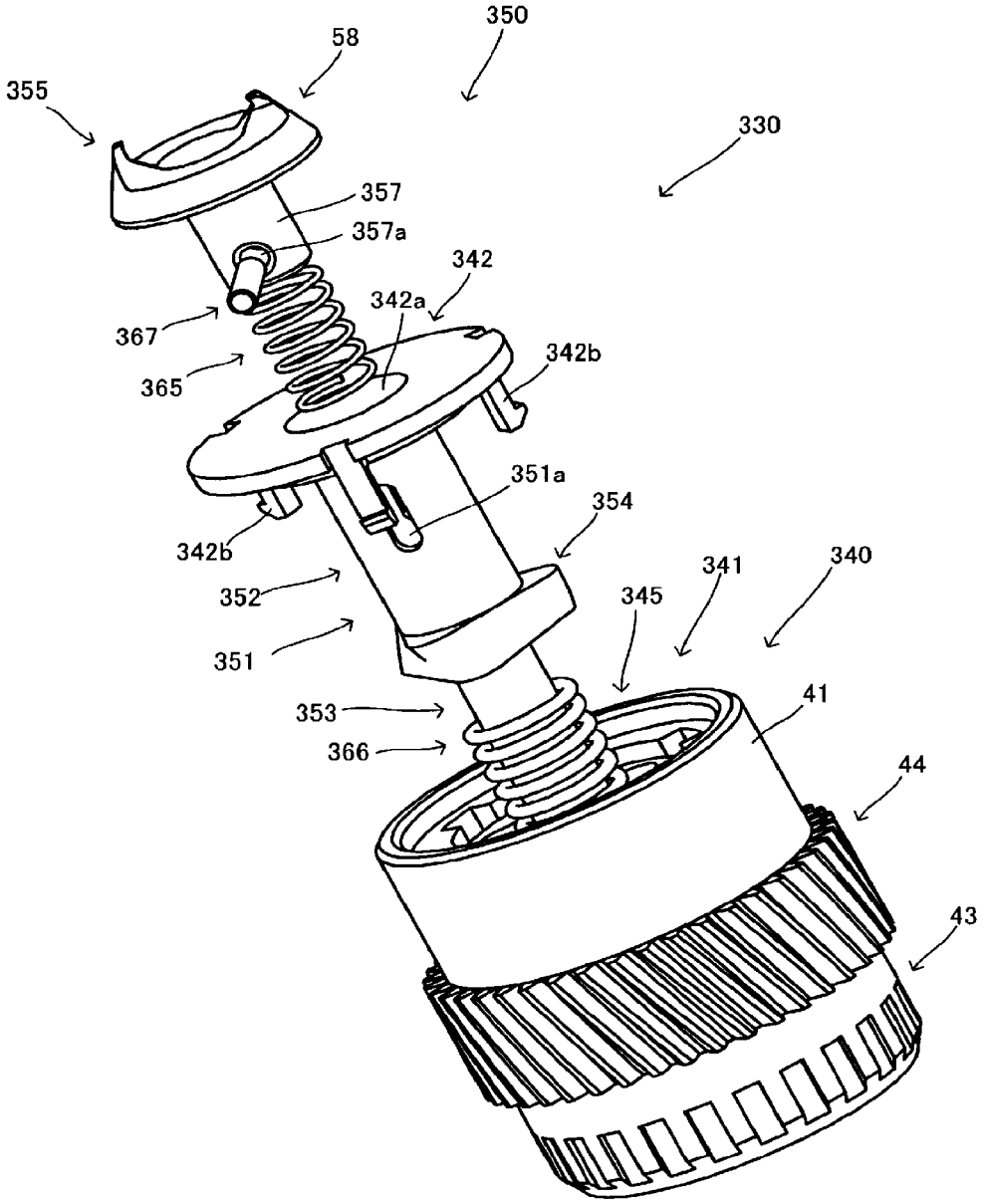
FIG. 31 is an exploded perspective view of an end member 330.
Figure 32:
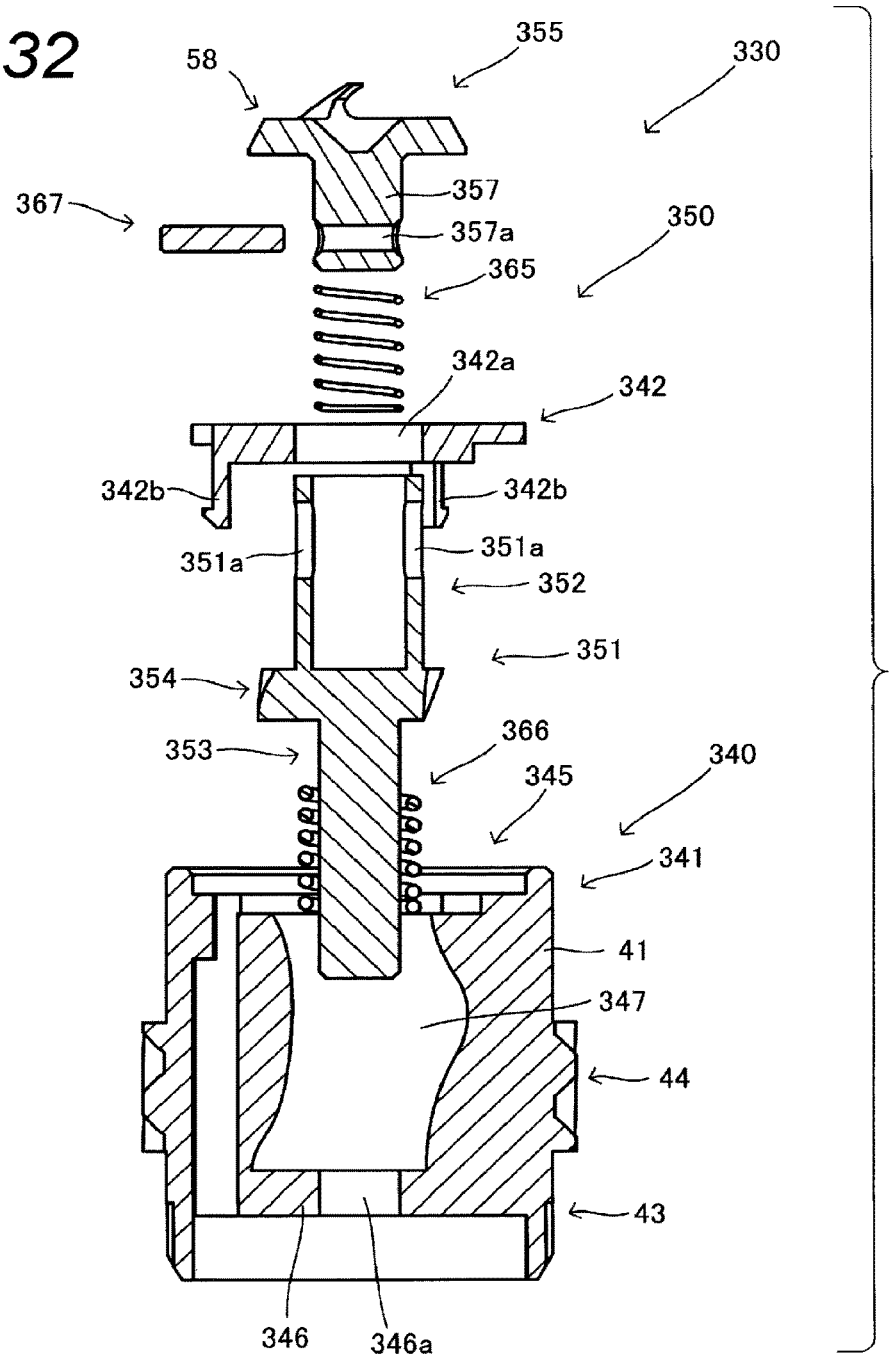
FIG. 32 is an exploded sectional view along the shaft line direction of the end member 330.

Next, the second aspect will be described. FIG. 31 is an exploded perspective view of an end member 330 included in the second aspect. FIG. 32 is an exploded sectional view of the end member 330 along the shaft line direction. The end member 330 is similar to the end member 30, is a member attached to the end portion opposite to the lid member 20 in the end portion of the photosensitive drum 11, and is provided with a bearing member 340 and a shaft member 350.

Figure 33A:
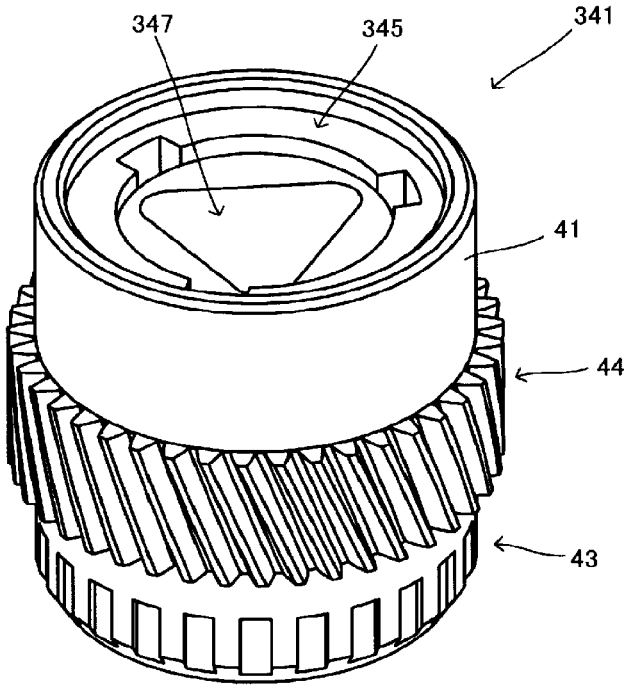
FIG. 33A is a perspective view of a body 341 of a bearing member 340.
Figure 33B:
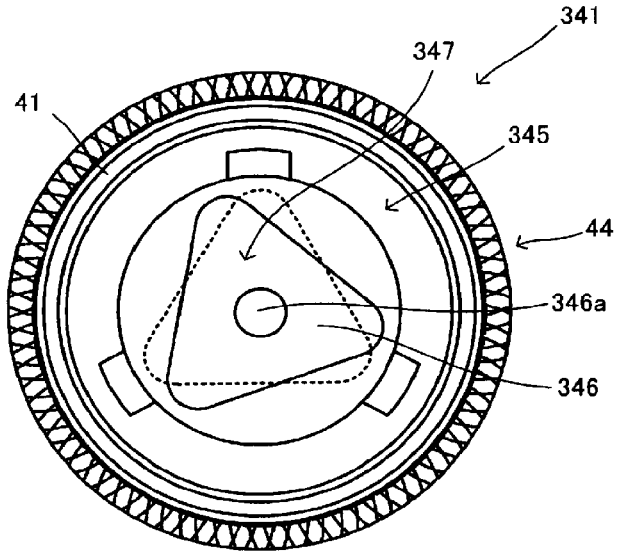
FIG. 33B is a plan view of the body 341 of the bearing member 340.

The bearing member 340 is a member which is bonded to the end portion of the photosensitive drum 11 in the end member 330. FIG. 33A is a perspective view of a body 341 of the bearing member 340, and FIG. 33B is a plan view of the body 341.

The bearing member 340 includes the body 341 and a lid member 342, and as illustrated in FIGS. 31 to 33B, the body 341 includes the tubular body 41, the fitting portion 43, the gear portion 44, and a shaft member holding portion 345.

Since the tubular body 41, the fitting portion 43, and the gear portion 44 are similar to those of the above-described end member 30, the same reference numerals will be given, and the description thereof will be omitted.

The shaft member holding portion 345 is a part which is formed on the inner side of the tubular body 41, and which has a function of ensuring a predetermined operation of the shaft member 350 and holding the shaft member 350 in the bearing member 340, and functions as one means for moving and rotating the rotating force receiving member 58. The shaft member holding portion 345 includes a bottom plate 346 and a spiral portion 347 which is a space in which a section is twisted in the shaft line direction.

The bottom plate 346 is a disk-like member, and is disposed to block and partition at least a part of the inner side of the tubular body 41. Accordingly, the shaft member 350 is supported. In the aspect, a hole 346*a* is formed in the center portion thereof. The attachment of the bottom plate 346 to the tubular body 41 can be performed by adhering or welding. In addition, the tubular body 41 and the bottom plate 346 may be integrally formed.

The spiral groove 347 is a space formed on the inner surface of the tubular body 41, and as can be ascertained from FIGS. 32 and 33B, in the aspect, a section which is orthogonal to the shaft line direction is substantially triangular, and the section is formed to gradually rotate around the shaft line along the shaft line direction, and becomes a shape of a so-called twisted triangular prism (in FIG. 33B, an opening edge of the spiral portion is illustrated by a solid line, and an example of a section in the depth in the shaft line direction is illustrated by a dotted line).

In addition, a part of one end of the spiral portion 347 in the longitudinal direction is blocked by the bottom plate 346, and a part of the other end opposite thereto is blocked by a lid member 342.

The lid member 342 is a disk-like member which is disposed on the side opposite to the bottom plate 346 nipping the shaft member holding portion 345, and is provided with a hole 342*a* at the center thereof. In the aspect, a claw 342*b* is provided, is engaged with the body 341, and is fixed in a so-called snap-fit manner. However, means of fixing the lid is not limited thereto, and the adhesive or welding by heat or ultrasound wave can be used as another means.

A material which configures each member of the bearing member 340 is not particularly limited, but various types of resin or metal can be used.

In a case of making the bearing member 340 by the resin, for example, polyacetal, polycarbonate, polyphenylene sulfide (PPS), polyamide imide (PAI), polyetherether ketone (PEEK), polyether imide (PEI), 4F-perfluoro alkyl vinyl ether (PFA), polyether sulfone (PES), liquid crystal polymer (LCP) resin, or polyamide MXD6 (PA-MXD6), can be appropriately used. However, in order to improve the rigidity of the member, the glass fiber, the carbon fiber, or the inorganic filler may be mixed into the resin in accordance with the load torque. In addition, by inserting metal into the resin, the rigidity may further be improved. In addition, in order to make the attachment or the movement of the shaft member smooth, sliding properties may be improved by containing at least one type of a fluororesin, polyethylene, and silicon rubber in the resin. In addition, the resin may be coated with fluororesin or lubricant.

Meanwhile, in a case of making the bearing member 340 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

In addition, from the viewpoint of having elasticity, the bearing member 340 and any member included in the bearing member 340, may be made by bending a metal plate, or may be made by making the metal, glass, or carbon fiber infiltrate into the resin.

As can be ascertained from FIGS. 31 and 32, the shaft member 350 is provided with a rotating shaft 351 and a tip end member 355. Furthermore, the shaft member 350 is provided with a tip end member elastic member 365, a rotating shaft elastic member 366, and a pin 367. Any of the tip end member elastic member 365 and the rotating shaft elastic member 366 in the aspect is a coiled spring.

Hereinafter, each of the members will be described.

Figure 34:
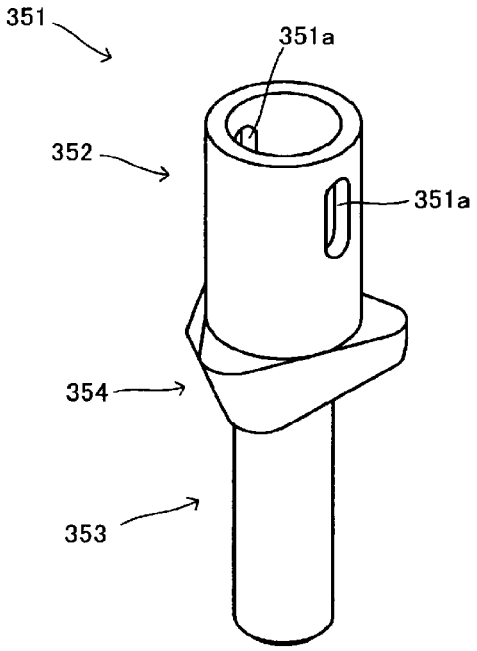
FIG. 34 is a perspective view of a shaft member 350.

The rotating shaft 351 is a rotating force transmission portion which transmits the rotating force received by the tip end member 355 to the bearing member 340, and is a shaft-like member which functions as means for moving and rotating the rotating force receiving member 58. FIG. 34 is a perspective view of the rotating shaft 351.

As can be ascertained from FIGS. 31, 32, and 34, in the rotating shaft 351, a cylindrical member 352 and a columnar member 353 are coaxially linked to each other. The inner side of the cylinder has the size by which the tip end member elastic member 365 can be inserted. In the rotating shaft 351, two long holes 351*a* which penetrate in the direction orthogonal to the shaft line direction are formed at the cylindrical parts. Two long holes 351*a* are disposed on one diameter of the cylindrical member 352. In addition, the long hole 351*a* considers the shaft line direction as the longitudinal direction.

In addition, in the outer circumferential portion of the rotating shaft 351, at a boundary part between the cylindrical member 352 and the columnar member 353, a spiral pillar-like portion 354 which is twisted corresponding to the shape of the above-described spiral portion 347, is provided.

The tip end member 355 is a member which receives the rotation driving force from the apparatus body 2 (refer to FIG. 1) and transmits the driving force to the rotating shaft 351. As can be ascertained from FIGS. 31 and 32, the tip end member 355 is configured to include a shaft 357 and the rotating force receiving member 58.

The shaft 357 is a pillar-like member, and is a column in the aspect. In addition, in the shaft 357, a hole 357*a* which penetrates in the direction orthogonal to the shaft line is formed.

Since the rotating force receiving member 58 is similar to the above-described end member 30, the description thereof will be omitted.

Returning to FIG. 31, another configuration provided in the shaft member 350 will be described. The tip end member elastic member 365 and the rotating shaft elastic member 366 are so-called elastic members, and any of the tip end member elastic member 365 and the rotating shaft elastic member 366 functions as means for moving and rotating the rotating force receiving member 58. In the aspect, both are the coiled springs. In addition, the pin 367 is the means for holding the tip end member 355 to be movable in the rotating shaft 351.

A material which configures each member of the shaft member 350 is not particularly limited, but various types of resin or metal can be used.

In a case of making the shaft member 350 by the resin, for example, polyacetal, polycarbonate, polyphenylene sulfide (PPS), polyamide imide (PAI), polyetherether ketone (PEEK), polyether imide (PEI), 4F-perfluoro alkyl vinyl ether (PFA), polyether sulfone (PES), liquid crystal polymer (LCP) resin, or polyamide MXD6 (PA-MXD6), can be appropriately used. However, in order to improve the rigidity of the member, the glass fiber, the carbon fiber, or the inorganic filler may be mixed into the resin in accordance with the load torque. In addition, by inserting metal into the resin, the rigidity may further be improved.

Meanwhile, in a case of making the shaft member 350 by metal, carving by cutting, aluminum the casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

In addition, from the viewpoint of having elasticity, the shaft member 350 and any member included in the shaft member 350, may be made by bending a metal plate, or may be made by making the metal, glass, or carbon fiber infiltrate into the resin.

By combining the bearing member 340 and the shaft member 350 with each other as follows, the end member 330 is made. In addition, by describing the combination, the size of each member and part, the structure, or the relationship of the sizes of the members and parts, are further understood.

As can be ascertained from FIG. 32, the shaft 357 of the tip end member 355 is disposed on the inner side of the cylindrical member 352 of the rotating shaft 351, and the pin 367 passes through the long hole 351*a* of the rotating shaft 351 and the hole 357*a* of the tip end member 355. Accordingly, the tip end member 355 is held in the rotating shaft 351. At this time, the tip end member elastic member 365 is disposed on the inner side of the cylindrical member 352, and accordingly, the tip end member 355 is biased in the projecting direction from the rotating shaft 351.

In this manner, in the rotating shaft 351 combined by the tip end member 355, the tip end member elastic member 365, and the pin 367, the columnar member 353 which is on the side on which the tip end member 355 is not disposed is inserted toward the bottom plate 346 side of the shaft member holding portion 345 formed on the inner side of the body 341 of the bearing member 340. At this time, the spiral pillar-like portion 354 of the rotating shaft 351 is disposed on the inner side of the spiral portion 347 of the shaft member holding portion 345. In addition, the columnar member 353 passes through the hole 346*a* of the bottom plate 346. In addition, the rotating shaft elastic member 366 is disposed between the bottom plate 346 and the spiral pillar-like portion 354, and biases the rotating shaft 351 toward the tip end member 355 side.

In addition, the lid member 342 is disposed, and the rotating shaft 351 is held in the bearing member 340. At this time, since the cylindrical member 352 in the rotating shaft 351 is disposed in the hole 342*a* of the lid member 342, and the spiral pillar-like portion 354 cannot pass through the hole 342*a*, the spiral pillar-like portion 354 is held on the inner side of the bearing member 340, and the rotating shaft 351 is held in a state of being biased without falling out of the bearing member 340.

Above, in the posture in which each member is combined, the shaft lines of the bearing member 340, the rotating shaft 351, and the tip end member 355 match each other.

According to the above-described end member 330, the relationship between the spiral portion 347 and the spiral pillar-like portion 354 acts in accordance with the example of the relationship between the spiral groove 47 and the pin 67 in the end member 30, and the end member 330 can also operate similar to the end member 30.

Figure 35:
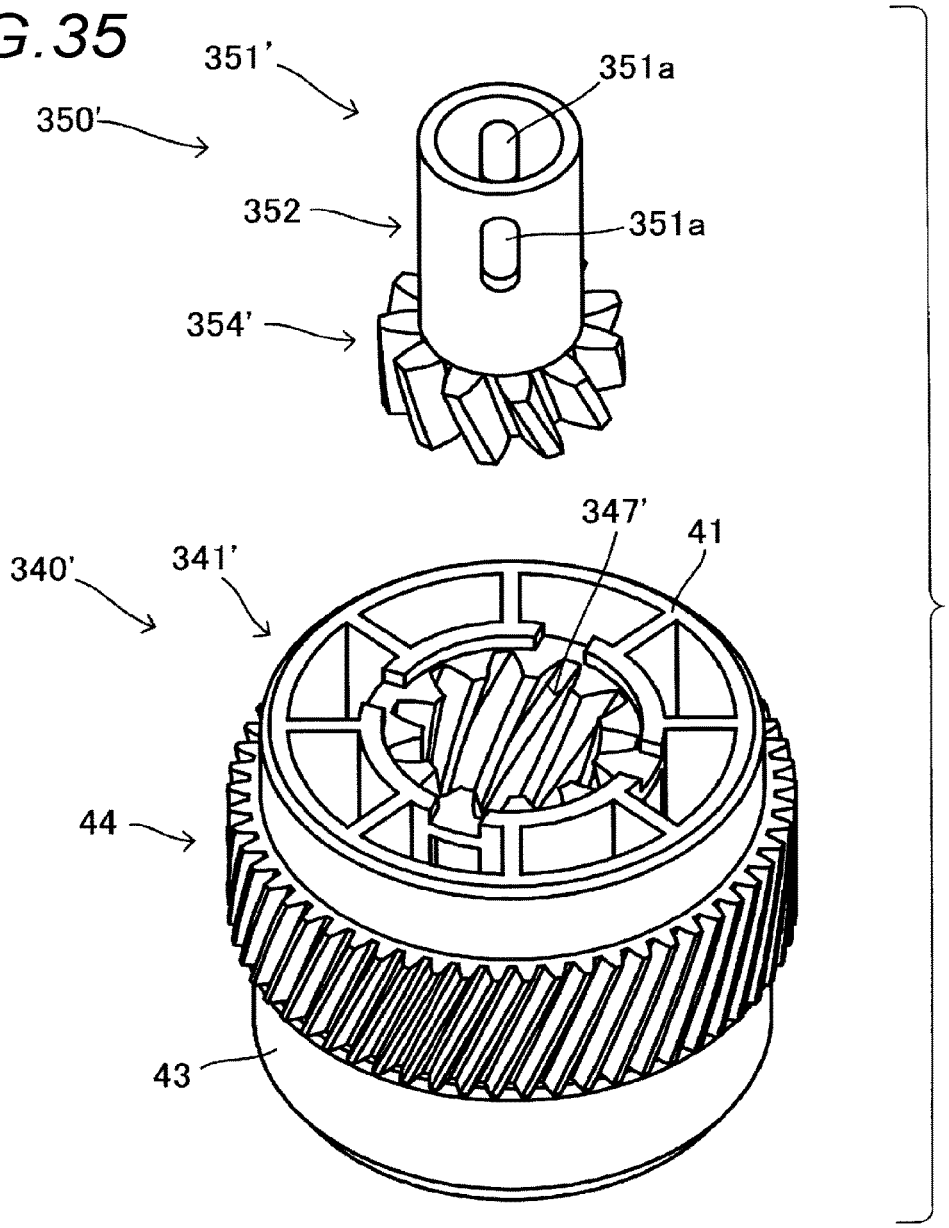
FIG. 35 is an exploded perspective view illustrating a modification example.

FIG. 35 is an exploded perspective view of a part of the end member 330' according to a modification example. For making it easy to understand, FIG. 35 illustrates only a body 341' of the bearing member 340' and a rotating shaft 351' of a shaft member 350'. Since other members are similar to the members described above, the description thereof will be omitted.

In the modification example, a spiral pillar-like portion 354' is formed of a helical gear, and a spiral portion 347' is formed of an internal gear. Even in this aspect, the pillar-like portion 354' acts in accordance with an example of a relationship between the spiral portion 347 and the spiral pillar-like portion 354 in the end member 330, and the same operation as that of the end member 30 is possible.

In the helical gear and the internal gear, the number of teeth is not particularly limited, and can be appropriately adjusted.

In addition to the example, a so-called gear shape, such as a spur gear or the like of which the thickness is thin is employed instead of the helical gear in the pillar-like portion 354', and a spiral portion in which a gear-like teeth can move in the groove can be configured instead of the spiral portion 347'. At this time, regarding the aspect of the spiral portion, the rotation and the movement in the shaft line direction of the shaft member can be regulated depending on the degree of twist per 1 mm along the shaft line direction. In addition, in addition to the gear-like teeth or the like, a projection-like part, such as a pin, can be formed and employed.

Figure 36:
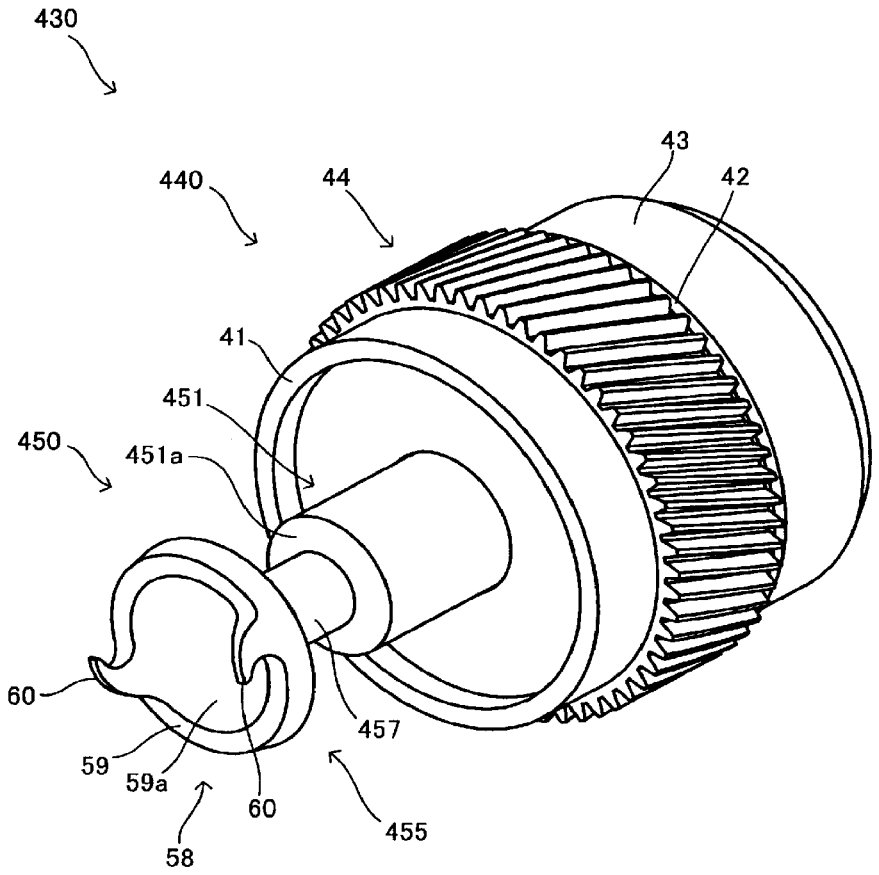
FIG. 36 is a perspective view of an end member 430.
Figure 37:
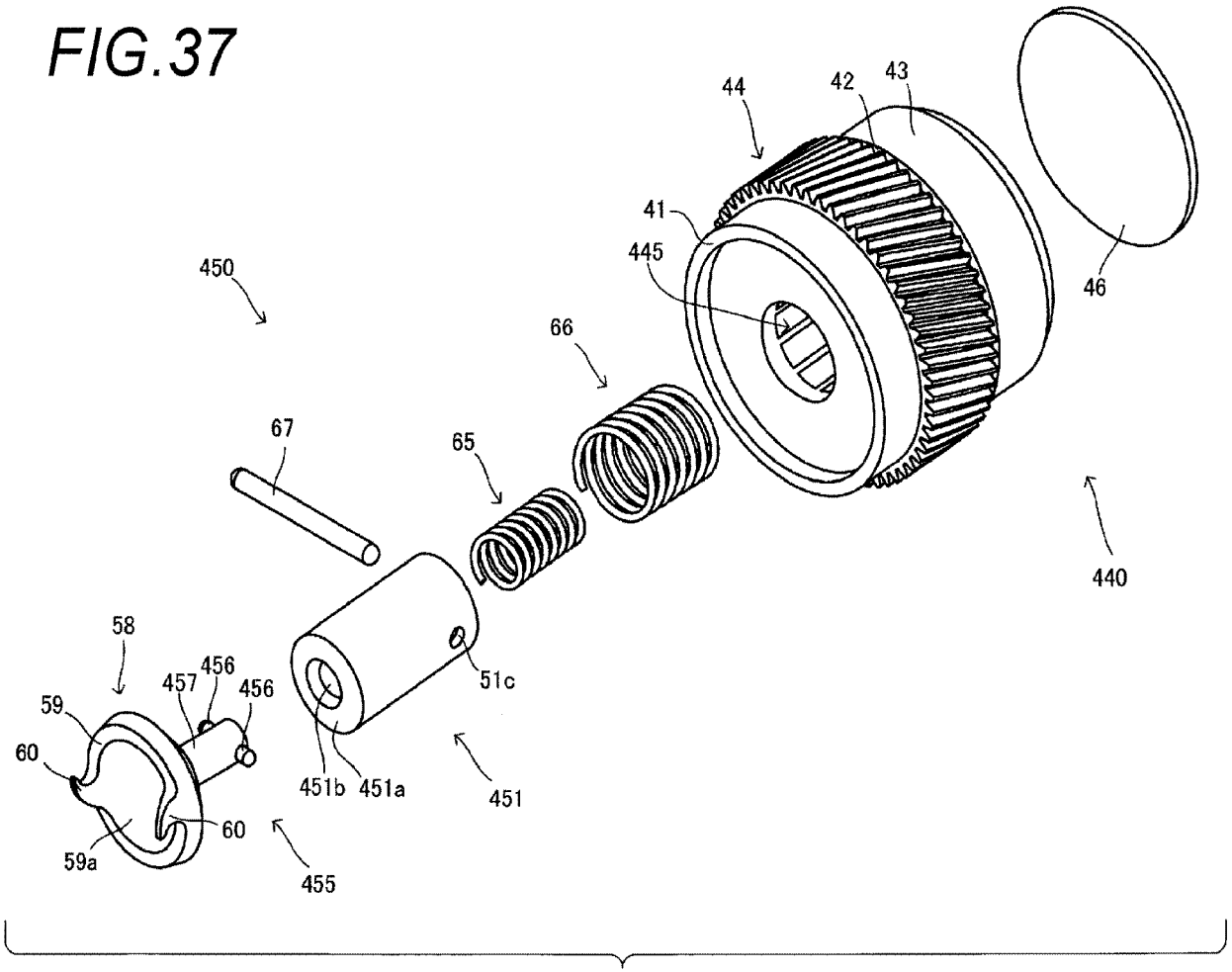
FIG. 37 is an exploded perspective view of the end member 430.

FIG. 36 is a diagram illustrating the third aspect, and is a perspective view of an end member 430. In the end member 430, the same configuration elements as those of the end member 30 will be given the same reference numerals as those of the end member 30, and the description thereof will be omitted. The end member 430 is a member attached to the end portion opposite to the lid member 20 in the end portion of the photosensitive drum 11, and is provided with a bearing member 440 and a shaft member 450. FIG. 37 is an exploded perspective view of the end member 430.

Figure 38:
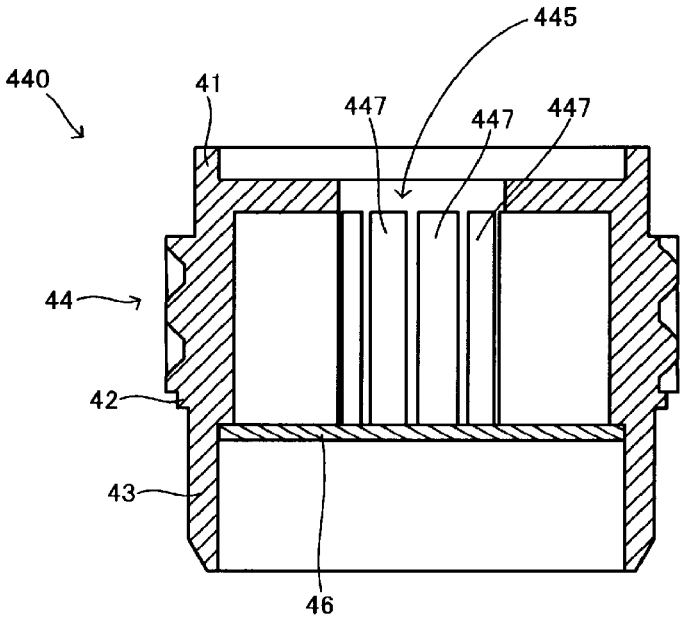
FIG. 38 is a sectional view in the shaft line direction of a bearing member 440.

The bearing member 440 is a member which is bonded to the end portion of the photosensitive drum 11 in the end member 430. FIG. 38 is a sectional view along the shaft line direction of the bearing member 440.

As can be ascertained from FIGS. 36 to 38, the bearing member 440 is configured to include the tubular body 41, the contact wall 42, the fitting portion 43, the gear portion 44, and a shaft member holding portion 445.

The shaft member holding portion 445 is a part which is formed on the inner side of the tubular body 41, and which has a function of ensuring a predetermined operation of the shaft member 450, and holding the shaft member 450 in the bearing member 440, and functions as one of means for moving and rotating the rotating force receiving member 58. The shaft member holding portion 445 includes the bottom plate 46 and a straight line groove 447.

The straight line grooves 447 are a plurality of straight line-like grooves formed on the inner surface of the tubular body 41, and the depth direction thereof is formed in a radial shape (radial direction) around the shaft line of the tubular body 41, similar to that of the above-described spiral groove 47, for example, as illustrated by A in FIG. 7A. Meanwhile, the longitudinal direction of the straight line groove 447 is parallel to the shaft line of the tubular body 41. In addition, the width direction of the straight line groove 447 is formed to be substantially the same as the diameter of the pin 67 to the extent that the end portion of the pin 67 is inserted, and the end portion of the pin 67 can smoothly move in the groove, similar to the above-described spiral groove 47, for example, as illustrated by B in FIG. 7A.

In addition, one end of the straight line groove 447 in the longitudinal direction is blocked by the bottom plate 46, and the other end opposite thereto is blocked without reaching the end surface of the tubular body 41.

Furthermore, a plurality of straight line grooves 447 are provided as at least one opposing pair nipping the shaft line of the tubular body 41. Therefore, two or more pairs may be provided.

Next, the shaft member 450 of the end member 430 will be described. As can be ascertained from FIG. 37, the shaft member 450 is provided with a rotating shaft 451 and a tip end member 455. Furthermore, the shaft member 450 is provided with the tip end member elastic member 65, the rotating shaft elastic member 66, and the pin 67. Any of the tip end member elastic member 65 and the rotating shaft elastic member 66 in the aspect is a coiled spring.

Figure 39A:
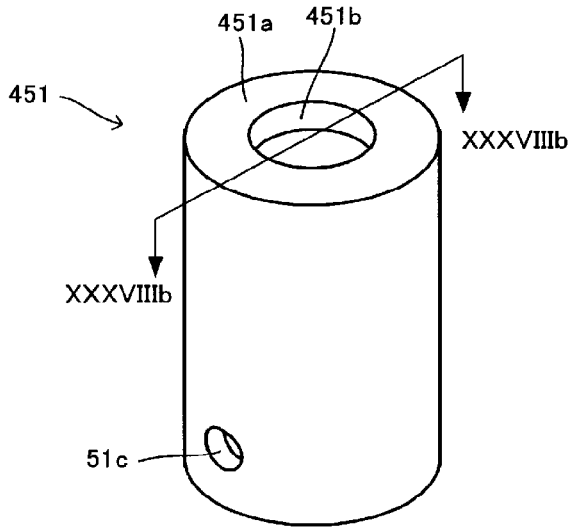
FIG. 39A is a perspective view of a rotating shaft 451.

The rotating shaft 451 is a rotating force transmission portion which transmits the rotating force received by the tip end member 455 to the bearing member 440, and is a shaft-like member which functions as means for moving and rotating the rotating force receiving member 58. FIG. 39A is a perspective view of the rotating shaft 451, and FIG. 39B is a sectional view cut in the shaft line direction by a line illustrated by XXXVIIIb-XXXVIIIb in FIG. 39A.

Figure 39B:
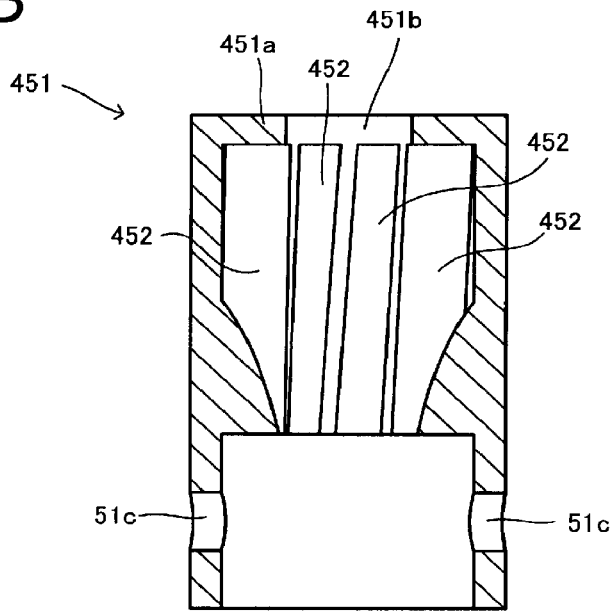
FIG. 39B is a sectional view in the shaft line direction of the rotating shaft 451.

As can be ascertained from FIGS. 39A and 39B, the rotating shaft 451 is cylindrical. The inner side of the cylinder has the size by which the tip end member elastic member 65 can be inserted. In the rotating shaft 451, a lid portion 451*a* is provided in one end portion, and a narrowed opening portion 451*b* is formed in the lid portion 451*a*. In addition, in the aspect, the opening portion 451*b* is circular.

In addition, in the rotating shaft 451, two pin through holes 51*c*, which are orthogonal to the shaft line of the cylinder, are provided in one diameter direction of the cylinder, and penetrate the inside and the outside of the cylinder, are formed in the end portion opposite to the end portion in which the lid portion 451*a* is disposed. The pin 67 (refer to FIG. 37) passes through the pin through hole 51*c*.

Furthermore, in the aspect, a plurality of spiral grooves (a part formed in a spiral shape) 452 are formed on the inner surface of the cylinder of the rotating shaft 451. The spiral groove 452 is a spiral groove, the depth direction thereof is formed in a radial shape (radial direction) around the shaft line of the rotating shaft 451, similar to that of the above-described spiral groove 47, for example, as illustrated by A in FIG. 7A. Meanwhile, the longitudinal direction of the spiral groove 452 is the direction along the shaft line of the rotating shaft 451, and one end side and the other end side are twisted to be deviated in the direction along the inner circumference of the rotating shaft 451, and are formed in a spiral shape. In addition, the width direction of the spiral groove 452 is formed to be substantially the same as the diameter of the projection 456 to the extent that the end portion of the projection (a member which moves in the spiral groove) 456 of the tip end member 455 which will be described later is inserted, and the end portion of the projection 456 can smoothly move in the groove, similar to the above-described spiral groove 47, for example, as illustrated by B in FIG. 7A.

In addition, one end of the spiral groove 452 in the longitudinal direction is blocked by the lid portion 451*a*.

Furthermore, the plurality of spiral grooves 452 are provided as at least one opposing pair nipping the shaft line of the rotating shaft 451. In the aspect, an example in which three pairs, that is, a total of six spiral grooves 452 are formed, is employed, but one pair, that is, a total of two spiral grooves may be formed. Meanwhile, two pairs or four or more pairs of spiral grooves may be provided. When the spiral groove is injection-molded, the injection molding is performed by the releasing while rotating the mold after the injection of the material.

Figure 40:
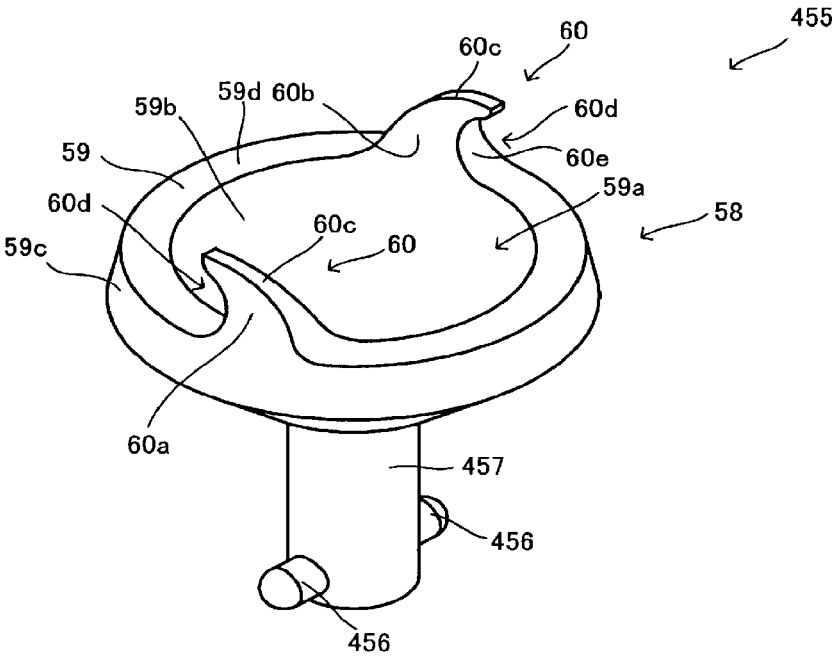
FIG. 40 is a perspective view of a tip end member 455.

The tip end member 455 is a member which receives the rotation driving force from the apparatus body 2 (refer to FIG. 1) and transmits the driving force to the rotating shaft 451. FIG. 40 is a perspective view of the tip end member 455.

As can be ascertained from FIG. 40, the tip end member 455 is configured to include a shaft 457, the projection 456, and the rotating force receiving member 58.

The shaft 457 is a pillar-like member, and is a column in the aspect. The sectional shape thereof is substantially the same as or slightly smaller than the opening portion 451*b* of the above-described rotating shaft 451.

The projections 456 are two projections which are provided on the side opposite to the side on which the rotating force receiving member 58 is disposed in the shaft 457, and protrude from the side surface of the shaft 457. Two projections 456 are disposed at symmetrical positions nipping the shaft line of the shaft 457.

Figure 41:
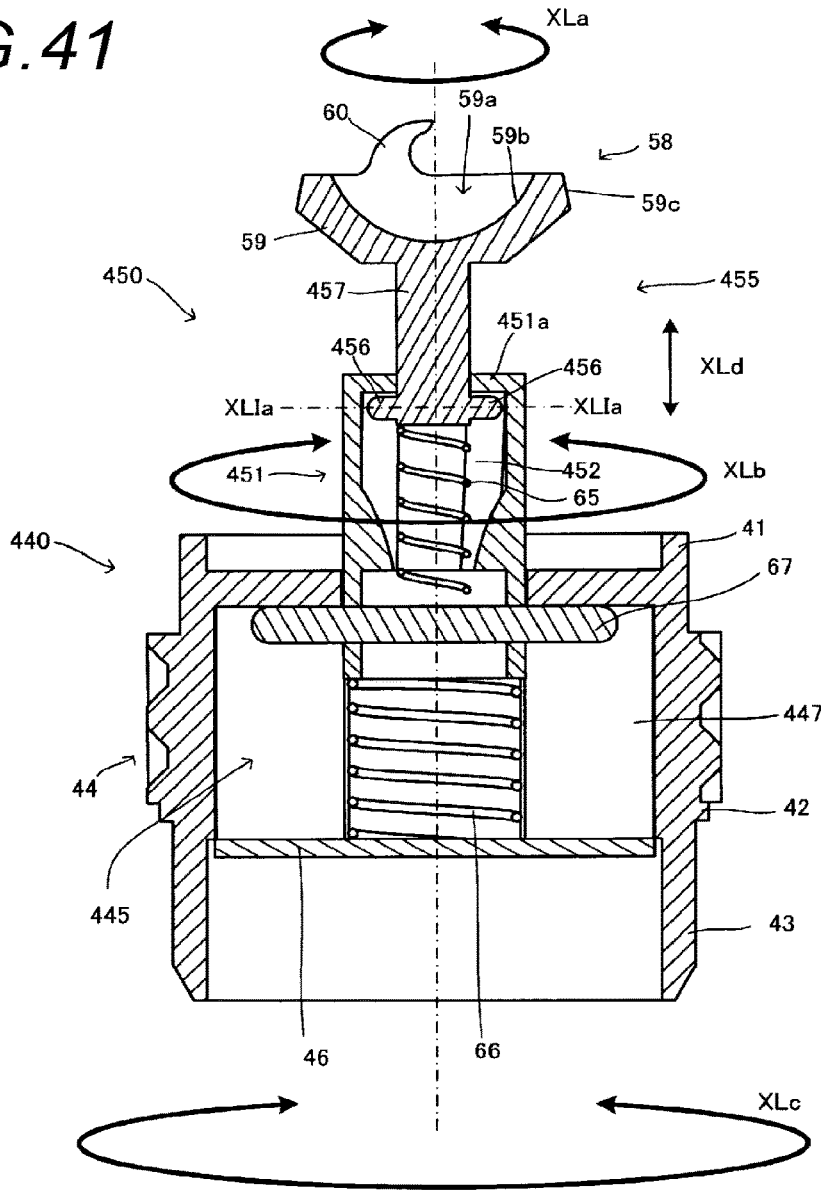
FIG. 41 is a sectional view in the shaft line direction of the end member 430.
Figure 42A:
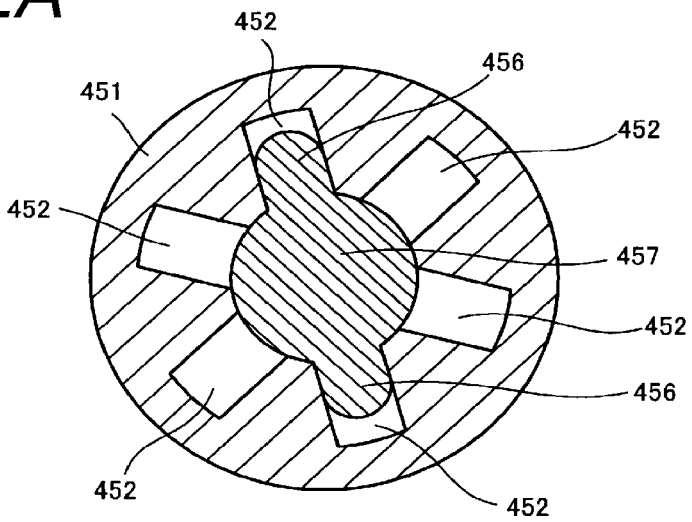
FIG. 42A is an end surface view orthogonal to the shaft line direction of the end member 430.
Figure 42B:
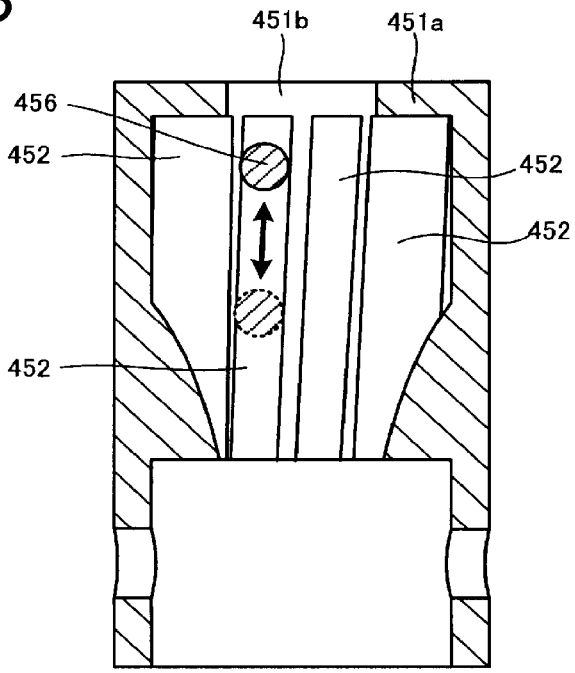
FIG. 42B is a diagram illustrating a relationship between the rotating shaft 451 and a projection 456.

By combining the bearing member 440 and the shaft member 450 with each other as follows, the end member 430 is made. In addition, by describing the combination, the size of each member and part, the structure, or the relationship of the sizes of the members and parts, are further understood. FIG. 41 is a sectional view in the shaft line direction of the end member 430. FIG. 42A is an end surface view of the end member 430 along line illustrated by XLIa-XLIa in FIG. 41, and FIG. 42B is a sectional view in the shaft line direction of the rotating shaft 451, and is a diagram illustrating the relationship between the rotating shaft 451 and the projection 456.

As can be ascertained from FIG. 41, the shaft 457 of the tip end member 455 passes through the opening portion 451*b* of the rotating shaft 451. At this time, the projection 456 of the tip end member 455 is included on the inner side of the rotating shaft 451, and the rotating force receiving member 58 of the tip end member 455 is disposed to protrude from the rotating shaft 451. In addition, as can be ascertained from FIGS. 42A and 42B, the projection 456 of the tip end member 455 is disposed in the spiral groove 452 of the rotating shaft 451.

Meanwhile, the pin 67 passes to cross over the two pin through holes 51*c* of the rotating shaft 451. At this time, both ends of the pin 67 respectively protrude from the side surface of the rotating shaft 451, and function as projections.

In addition, the tip end member elastic member 65 is disposed between the shaft 457 of the tip end member 455 and the pin 67 on the inner side of the rotating shaft 451. Therefore, one side of the tip end member elastic member 65 comes into contact with the shaft 457, and the other side thereof comes into contact with the pin 67. Accordingly, the tip end member 455 is biased in the direction in which the tip end member elastic member 65 biases the tip end member 455 and makes the tip end member 455 protrude from the rotating shaft 451. However, since the projection 456 cannot pass through the opening portion 451*b* of the rotating shaft 451, the tip end member 455 is held in a state of being biased without falling out of the rotating shaft 451.

In this manner, in the rotating shaft 451 combined by the tip end member 455, the tip end member elastic member 65, and the pin 67, the side on which the tip end member 455 is not disposed is inserted toward the lid member 46 side of the shaft member holding portion 445 formed on the inner side of the bearing member 440. At this time, as illustrated in FIG. 41, the end portion of the pin 67 protruded from the side surface of the rotating shaft 451 is inserted into the straight line groove 447 formed in the shaft member holding portion 445 of the bearing member 440.

In addition, as can be ascertained from FIG. 41, on the inner side of the bearing member 440, the rotating shaft elastic member 66 is disposed between the rotating shaft 451 and the lid member 46. Therefore, one side of the rotating shaft elastic member 66 comes into contact with the rotating shaft 451, and the other side of the rotating shaft elastic member 66 comes into contact with the lid member 46. Accordingly, the rotating shaft 451 is biased in the direction in which the rotating shaft elastic member 66 biases the rotating shaft 451 and makes the rotating shaft 451 including the tip end member 455 protrude from the bearing member 440. However, since the tip end of the pin 67 is inserted into the straight line groove 447 of the bearing member 440, and both ends of the straight line groove 447 are blocked as described above, the rotating shaft 451 is held in a state of being biased without falling out of the bearing member 440.

Above, in the posture in which each member is combined, the shaft lines of the bearing member 440, the rotating shaft 451, and the tip end member 455 match each other.

Next, how the end member 430 can be deformed, move, and rotate, will be described.

In the postures illustrated in FIG. 41, the entire shaft member 450 is in a posture of being protruded the most from the bearing member 440 within a possible range, by the tip end member elastic member 65 and the rotating shaft elastic member 66. When any external force is not applied to the shaft member 450, the end member 430 is in this posture.

From this posture, as illustrated by an arrow XLa in FIG. 41, when the rotating force around the shaft line is applied to the rotating force receiving member 58 of the tip end member 455, following this, the shaft 457 rotates, and further, the projection 456 also rotates around the shaft line. Accordingly, since the projection 456 is engaged with the side surface of the spiral groove 452, the side surface is pressed, and as illustrated by an arrow XLb in FIG. 41, the rotating shaft 451 also rotates. Furthermore, in the rotating shaft 451, since the pin 67 is engaged with the straight line groove 447 of the bearing member 440, as illustrated by an arrow XLc in FIG. 41, the bearing member 440 also rotates. Therefore, the end member 430 rotates around the shaft line.

Meanwhile, when the tip end member 455 rotates as illustrated by an arrow XLa in FIG. 41, since the projection 456 moves in the spiral groove 452 as illustrated by a straight line arrow in FIG. 42B, a force which moves the tip end member 455 in the shaft line direction is also generated, and the tip end member 455 also moves in the shaft line direction as illustrated by an arrow XLd in FIG. 41.

Figure 43:
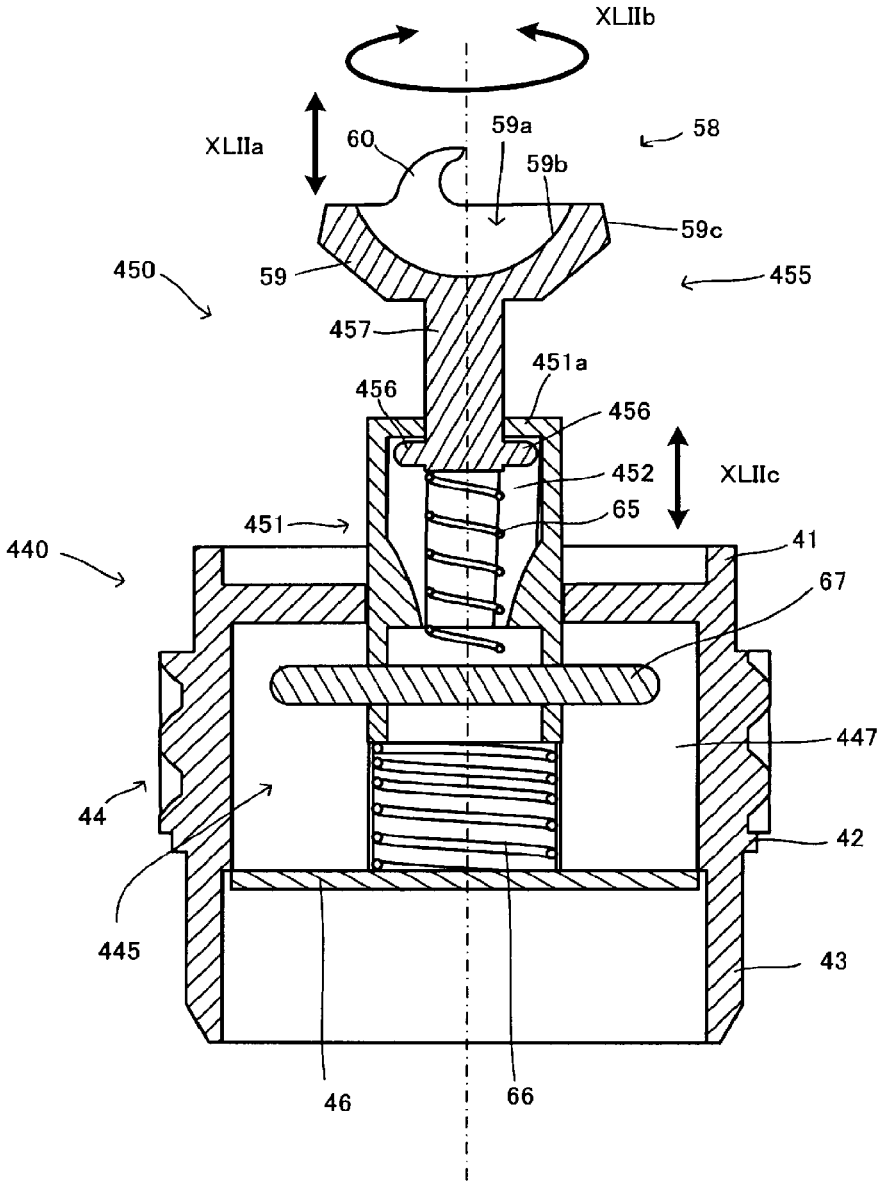
FIG. 43 is a sectional view in the shaft line direction of the end member 430.

In addition to the description above, the end member 430 can also be deformed as follows. FIG. 43 is a diagram illustrating this. In other words, in the end member 430, when the force is applied in the shaft line direction to the rotating force receiving member 58 of the tip end member 455 as illustrated by an arrow XLIIa in FIG. 43, and when the projection 456 of the tip end member 455 moves in the spiral groove 452, the tip end member 455 rotates around the shaft line as illustrated by an arrow XLIIb in FIG. 43, and the rotating shaft 451 moves in the shaft line direction as illustrated by an arrow XLIIc in FIG. 43.

According to the movement and the rotation by the end member 430, similar effects to those of the end member 30 are achieved.

Figure 44:
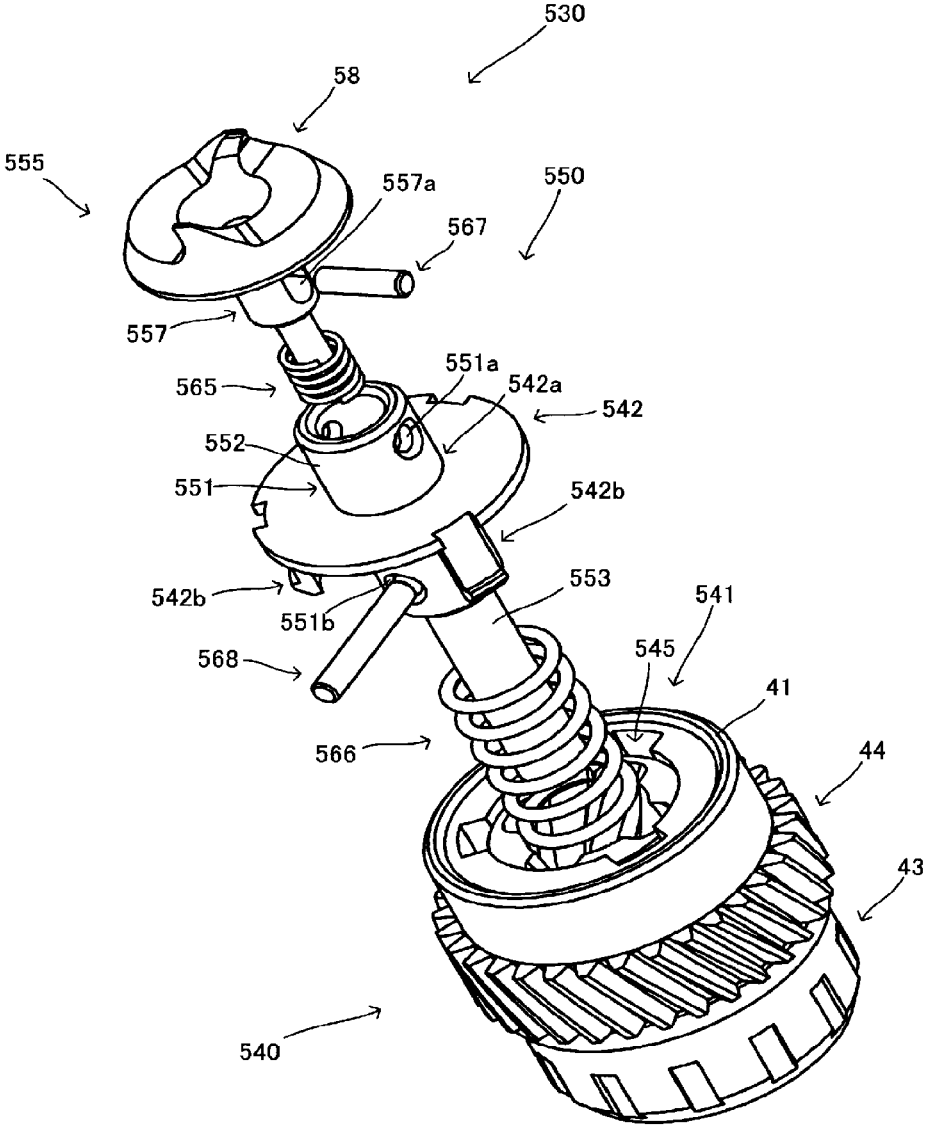
FIG. 44 is an exploded perspective view of an end member 530.
Figure 45:
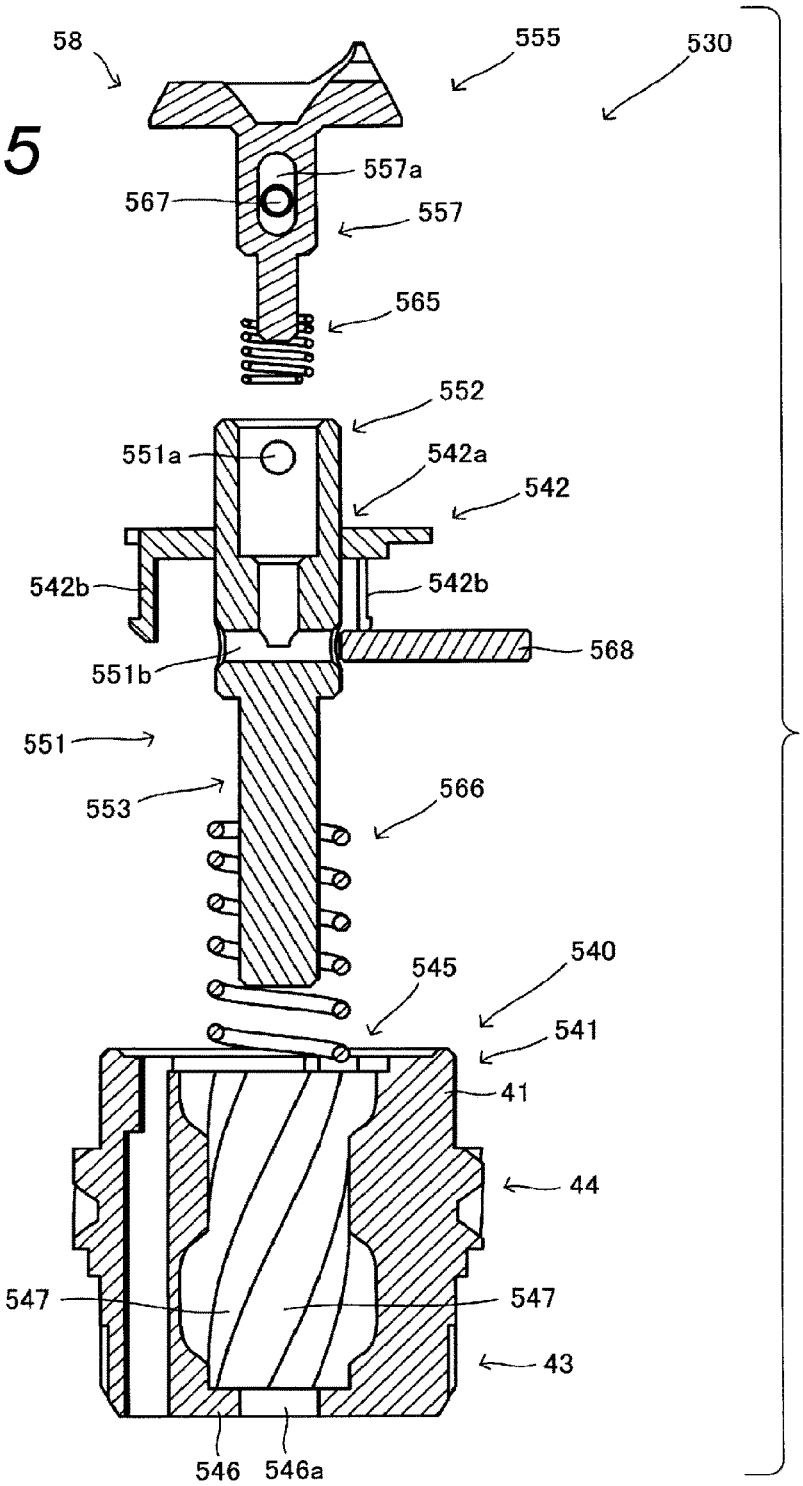
FIG. 45 is an exploded sectional view of the end member 530.
Figure 46:
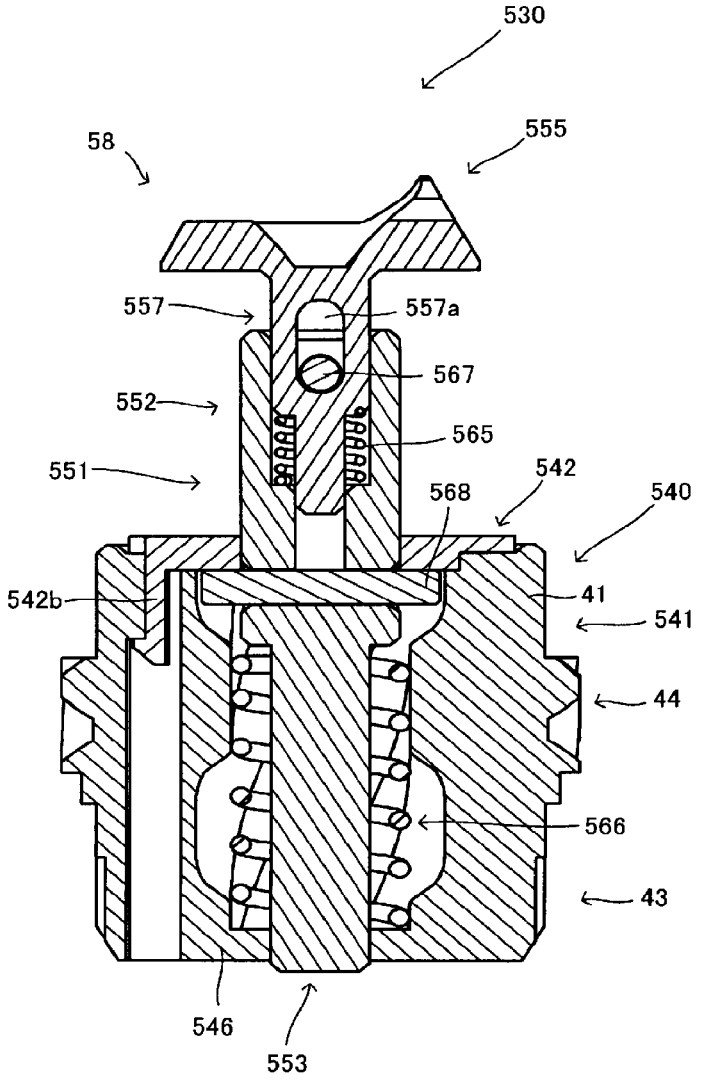
FIG. 46 is a sectional view of the end member 530.

Next, the fourth aspect will be described. FIG. 44 is an exploded perspective view of an end member 530 included in the fourth aspect. FIG. 45 is an exploded sectional view along the shaft line direction of the end member 530. FIG. 46 is a sectional view along the shaft line direction of the end member 530 in which each member is combined. Similar to the end member 30, the end member 530 is a member attached to the end portion opposite to the above-described lid member 20 in the end portion of the photosensitive drum 11, and is provided with a bearing member 540 and a shaft member 550.

The bearing member 540 is a member which is bonded to the end portion of the photosensitive drum 11 in the end member 530. The bearing member 540 includes a body 541 and a lid member 542, and the body 541 includes the tubular body 41, the fitting portion 43, the gear portion 44, and a shaft member holding portion 545.

Since the tubular body 41, the fitting portion 43, and the gear portion 44 are similar to those in the above-described end member 30, the same reference numerals will be given, and the description thereof will be omitted.

The shaft member holding portion 545 is a part which is formed on the inner side of the tubular body 41, and which has a function of ensuring a predetermined operation of the shaft member 550, and holding the shaft member 550 in the bearing member 540, and functions as one of means for moving and rotating the rotating force receiving member 58. The shaft member holding portion 545 includes a bottom plate 546 and a spiral groove 547 which functions as a spiral portion.

The bottom plate 546 is a disk-like member, and is disposed to block and partition at least a part of the inner side of the tubular body 41. Accordingly, a rotating shaft elastic member 566 is supported. In the aspect, a hole 546*a* is formed in the center portion thereof, a columnar member 553 of a rotating shaft 551 is inserted into the hole 546*a*, and the inclination of the rotating shaft 551 is regulated.

The attachment of the bottom plate 546 to the tubular body 41 can be performed by adhering or welding. In addition, the tubular body 41 and the bottom plate 546 may be integrally formed.

The spiral grooves 547 are a plurality of spiral grooves which function as a part formed in a spiral shape, and are formed on the inner surface of the tubular body 41, and can be formed in accordance with the spiral groove 547 according to the same idea as that of the spiral groove 547 of the above-described end member 30. One end of the spiral groove 547 in the longitudinal direction is blocked by the bottom plate 546, and the other end opposite thereto is blocked by the lid member 542.

The lid member 542 is a disk-like member which is disposed on the side opposite to the bottom plate 546 nipping the shaft member holding portion 545, and the hole 542*a* is formed at the center thereof. In the aspect, a claw 542*b* is provided, is engaged with the body 541, and is fixed in a so-called snap-fit manner. However, means of fixing the lid member is not limited thereto, and the adhesive or welding by heat or ultrasound wave can be used as another means.

A material which configures each member of the bearing member 540 is not particularly limited, but various types of resin or metal can be used.

In a case of making the bearing member 540 by the resin, for example, polyacetal, polycarbonate, polyphenylene sulfide (PPS), polyamide imide (PAT), polyetherether ketone (PEEK), polyether imide (PEI), 4F-perfluoro alkyl vinyl ether (PFA), polyether sulfone (PES), liquid crystal polymer (LCP) resin, or polyamide MXD6 (PA-MXD6), can be appropriately used. However, in order to improve the rigidity of the member, the glass fiber, the carbon fiber, or the inorganic filler may be mixed into the resin in accordance with the load torque. In addition, by inserting metal into the resin, the rigidity may further be improved.

In addition, in order to make the attachment or the movement of the shaft member smooth, sliding properties may be improved by containing at least one type of a fluororesin, polyethylene, and silicon rubber in the resin. In addition, the resin may be coated with fluororesin or lubricant.

Meanwhile, in a case of making the bearing member 540 by metal, carving by cutting, aluminum the casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

In addition, from the viewpoint of having elasticity, the bearing member 540 and any member included in the bearing member 540, may be made by bending a metal plate, or may be made by making the metal, glass, or carbon fiber infiltrate into the resin.

The shaft member 550 is provided with the rotating shaft 551 and a tip end member 555. Furthermore, the shaft member 550 is provided with a tip end member elastic member 565, the rotating shaft elastic member 566, a pin 567 and a pin 568. Any of the tip end member elastic member 565 and the rotating shaft elastic member 566 in the aspect is a coiled spring.

Hereinafter, each of the members will be described.

The rotating shaft 551 is a rotating force transmission portion which transmits the rotating force received by the tip end member 555 to the bearing member 540, and is a shaft-like member which functions as means for moving and rotating the rotating force receiving member 58.

In the rotating shaft 551, a cylindrical member 552 and the columnar member 553 are coaxially linked to each other. The inner side of the cylinder has the size by which a shaft 557 of the tip end member 555 and the tip end member elastic member 565 can be inserted. In the rotating shaft 551, two long holes 551*a* which penetrate in the direction orthogonal to the shaft line direction are formed at the cylindrical parts. Two long holes 551*a* are disposed on one diameter of the cylindrical member 552.

In addition, in the rotating shaft 551, a hole 551*b* which penetrates in the direction orthogonal to the shaft line direction is formed in the end portion on the columnar member 553 side in the end portion in the shaft line direction of the cylindrical member 552. Two holes 551*a* are disposed on one diameter of the cylindrical member 552.

The tip end member 555 is a member which receives the rotation driving force from the apparatus body 2 (refer to FIG. 1) and transmits the driving force to the rotating shaft 551. The tip end member 555 is configured to include the shaft 557 and a rotating force receiving member 58.

The shaft 557 is a pillar-like member, and is a column in the aspect. In addition, in the shaft 557, a long hole 557*a* which penetrates in the direction orthogonal to the shaft line is formed. The longitudinal direction of the long hole 557*a* is the direction along the shaft line. In addition, in the aspect, the end portion opposite to the rotating force receiving member 58 in the shaft 557 is formed to be narrow.

Since the rotating force receiving member 58 is similar to the above-described end member 30, the description thereof will be omitted.

The tip end member elastic member 565 and the rotating shaft elastic member 566 are so-called elastic members, and any of the tip end member elastic member 565 and the rotating shaft elastic member 566 functions as means for moving and rotating the rotating force receiving member 58. In the aspect, the tip end member elastic member 565 and the rotating shaft elastic member 566 are coiled springs. In addition, a pin 567 is means for holding the tip end member 555 to be movable along the shaft line direction in the rotating shaft 551. In addition, the pin 568 is means for holding the rotating shaft 551 in the bearing member 540, moving and rotating along the spiral groove 547, and moving and rotating the rotating shaft 551.

A material which configures each member of the shaft member 550 is not particularly limited, but various types of resin or metal can be used.

In a case of making the shaft member 550 by the resin, for example, polyacetal, polycarbonate, polyphenylene sulfide (PPS), polyamide imide (PAI), polyetherether ketone (PEEK), polyether imide (PEI), 4F-perfluoro alkyl vinyl ether (PFA), polyether sulfone (PES), liquid crystal polymer (LCP) resin, or polyamide MXD6 (PA-MXD6), can be appropriately used. However, in order to improve the rigidity of the member, the glass fiber, the carbon fiber, or the inorganic filler may be mixed into the resin in accordance with the load torque. In addition, by inserting metal into the resin, the rigidity may further be improved.

Meanwhile, in a case of making the shaft member 550 by metal, carving by cutting, aluminum die casting, zinc die casting, a metal powder injection molding method (so-called MIM method), or a metal powder sintering lamination method (so-called 3D printing), can be employed. In addition, regardless of the material of the metal, iron, stainless steel, aluminum, brass, copper, zinc, or an alloy of the materials, may be used. In addition, it is possible to improve functionality (lubrication properties or corrosion resistance) of the surface by performing various types of plating.

In addition, from the viewpoint of having elasticity, the shaft member 550 and any member included in the shaft member 550, may be made by bending a metal plate, or may be made by making the metal, glass, or carbon fiber infiltrate into the resin.

By combining the bearing member 540 and the shaft member 550 with each other as follows, the end member 530 is made. In addition, by describing the combination, the size of each member and part, the structure, or the relationship of the sizes of the members and parts, are further understood.

As can be ascertained from FIG. 46, the shaft 557 of the tip end member 555 is disposed on the inner side of the cylindrical member 552 of the rotating shaft 551, and the pin 567 passes through the long hole 551*a* of the rotating shaft 551 and the hole 557*a* of the tip end member 555. Accordingly, the tip end member 555 is held in the rotating shaft 551. At this time, the tip end member elastic member 565 is disposed on the inner side of the cylindrical member 552, and accordingly, the tip end member 555 is biased in the projecting direction from the rotating shaft 551.

In this manner, in the rotating shaft 551 combined by the tip end member 555, the tip end member elastic member 565, and the pin 567, the columnar member 553 which is on the side on which the tip end member 555 is not disposed is inserted toward the bottom plate 546 side of the shaft member holding portion 545 formed on the inner side of the body 541 of the bearing member 540. At this time, the pin 568 is inserted into the hole 551*b* of the rotating shaft 551, and each of both ends of the pin 568 is disposed to protrude from the side surface of the rotating shaft 551. In addition, the protruded end portion of the pin 568 is disposed in the groove of the spiral groove 547 of the bearing member 540. In addition, the columnar member 553 passes through the hole 546*a* of the bottom plate 546. In addition, the rotating shaft elastic member 566 is disposed between the bottom plate 546 and the columnar member 553, and the rotating shaft 551 is biased toward the tip end member 555 side.

In addition, the lid member 542 is disposed, and the rotating shaft 551 is held in the bearing member 540. At this time, since the cylindrical member 552 in the rotating shaft 551 is disposed in a hole 542*a* of the lid member 542, and the pin 568 cannot pass through the hole 542*a*, the rotating shaft 551 is held in a state of being biased without falling out of the bearing member 540.

Above, in the posture in which each member is combined, the shaft lines of the bearing member 540, the rotating shaft 551, and the tip end member 555 match each other.

According to the above-described end member 530, the relationship between the spiral groove 547 and the pin 568 acts in accordance with the example of the relationship between the spiral groove 547 and the pin 67 in the end member 30, and the end member 530 can also operate similar to the end member 30. In addition, the tip end member 555 can move in the shaft line direction with respect to the rotating shaft 551 regardless of the rotation of the shaft member 550.

Figure 47:
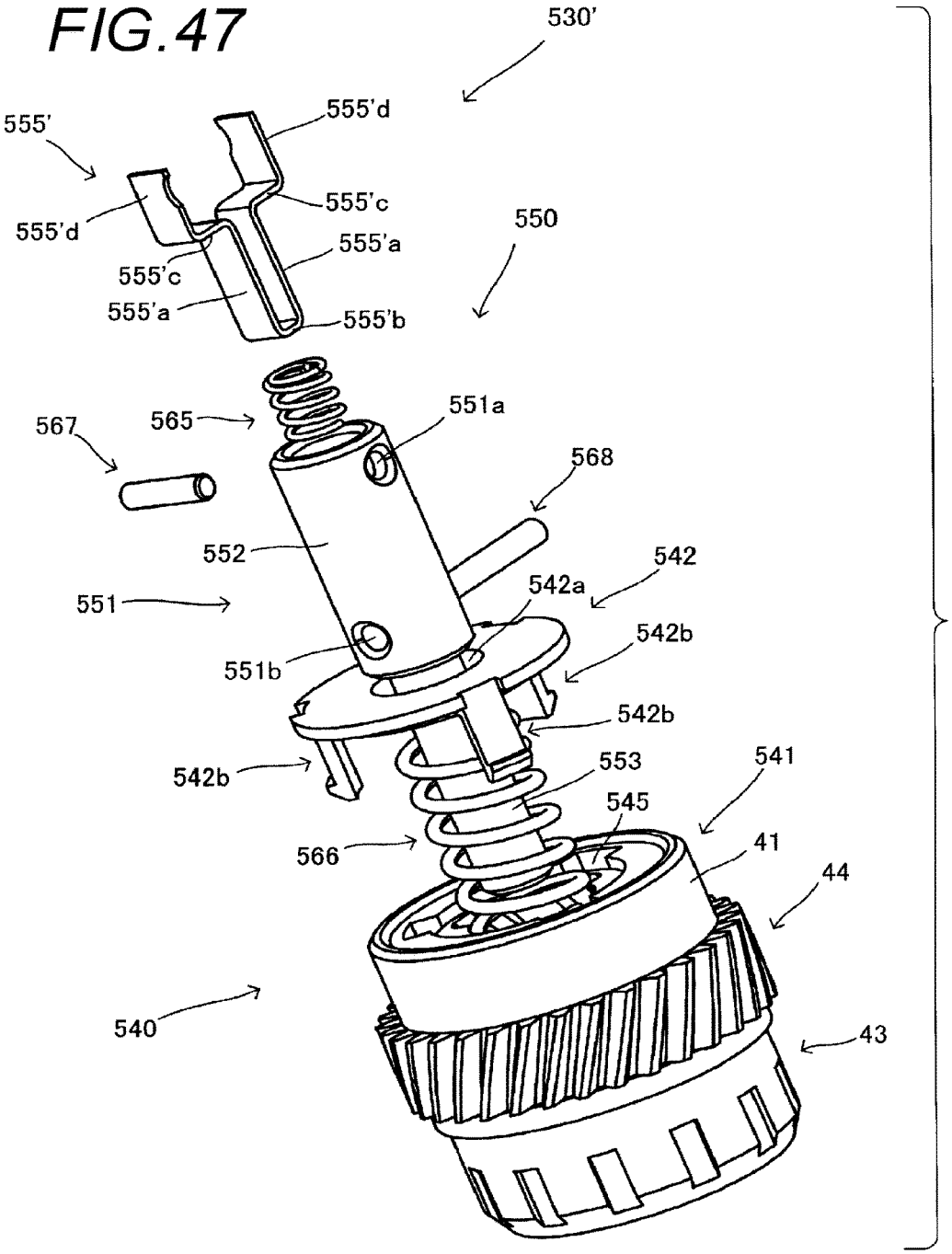
FIG. 47 is an exploded perspective view of an end member 530'.
Figure 48:
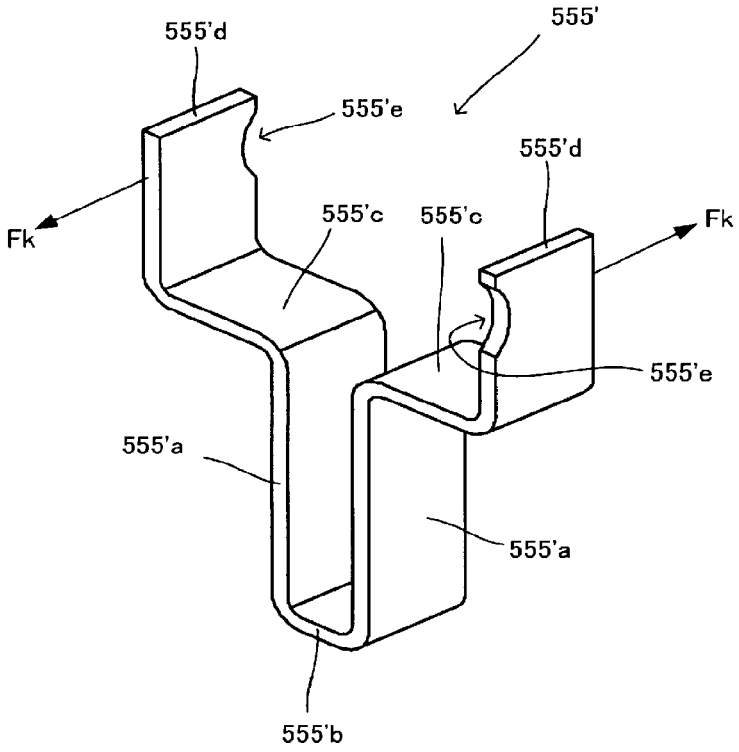
FIG. 48 is a perspective view of a tip end member 555'.

FIG. 47 is an exploded perspective view of an end member 530' which is a modification example of the end member 530. In the end member 530' of the example, instead of the tip end member 555 of the end member 530, a tip end member 555' is employed. Here, the tip end member 555' will be described. FIG. 48 is a perspective view of the tip end member 555'. Other parts are the same as the end member 530.

As can be ascertained from FIGS. 47 and 48, the tip end member 555' has an aspect in which one long plate is formed to be folded, and functions as the rotating force receiving member. The shape is as follows.

The tip end member 555' includes two base plates 555'*a* in which plate surfaces on one side are disposed substantially in parallel at a predetermined interval, and end portions on one side of two base plates 555'*a* are linked to each other by a linking plate 555'*b*. Interval expansion plates 555'*c* which are plate-like members that extend in the direction of being separated, are disposed from each of the end portions (other end portions) opposite to the side which is linked by the linking plate 555'*b* of two base plates 555'*a*. In addition, an engaging plate 555'*d* which functions as an engaging member that extends in the direction of being separated from the base plate 555'*a*, is disposed from the tip end of the interval expansion plate 555'*c*. Therefore, two engaging plates 555'*d* are substantially parallel at a predetermined interval so that the plate surfaces thereof oppose each other.

Here, in the engaging plate 555'*d*, a hollow 555'*e* is provided at least in one end portion in the plate width direction. Here, the engaging projection 72 of the above-described driving shaft 70 (refer to FIG. 15A) is disposed to bump into the hollow 555'*e*. Therefore, two hollows 555'*e* are disposed on the opposite side in the plate width direction. In addition, the interval of two engaging plate 555'*d* is the interval by which the tip end of the shaft portion 71 of the driving shaft 70 can get into.

The tip end member 555' is formed of a material having excellent elasticity. For example, stainless steel or phosphor bronze can be employed. In addition, the metal maximizes an elastic limit by low sound annealing (tempering treatment), and can improve spring properties.

Figure 49:
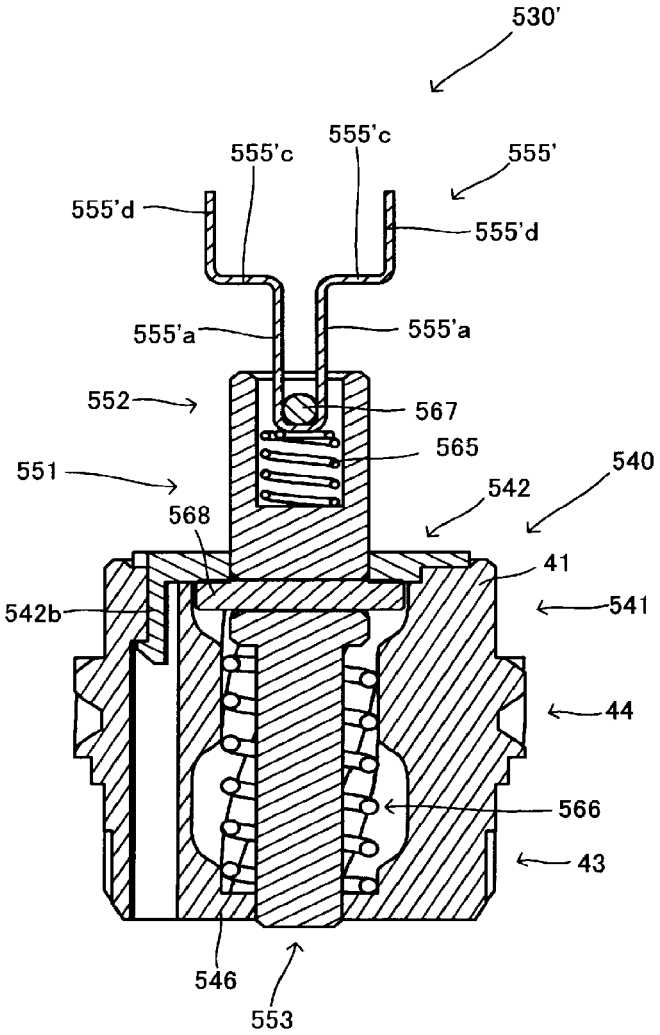
FIG. 49 is a sectional view along a shaft line of the end member 530'.

FIG. 49 is a sectional view along the shaft line of the end member 530'. As can be ascertained from FIG. 49, in the aspect, as the pin 567 is inserted into between two base plates 555'*a* of the tip end member 555', the pin 567 is held in the cylindrical member 552.

Figure 50:
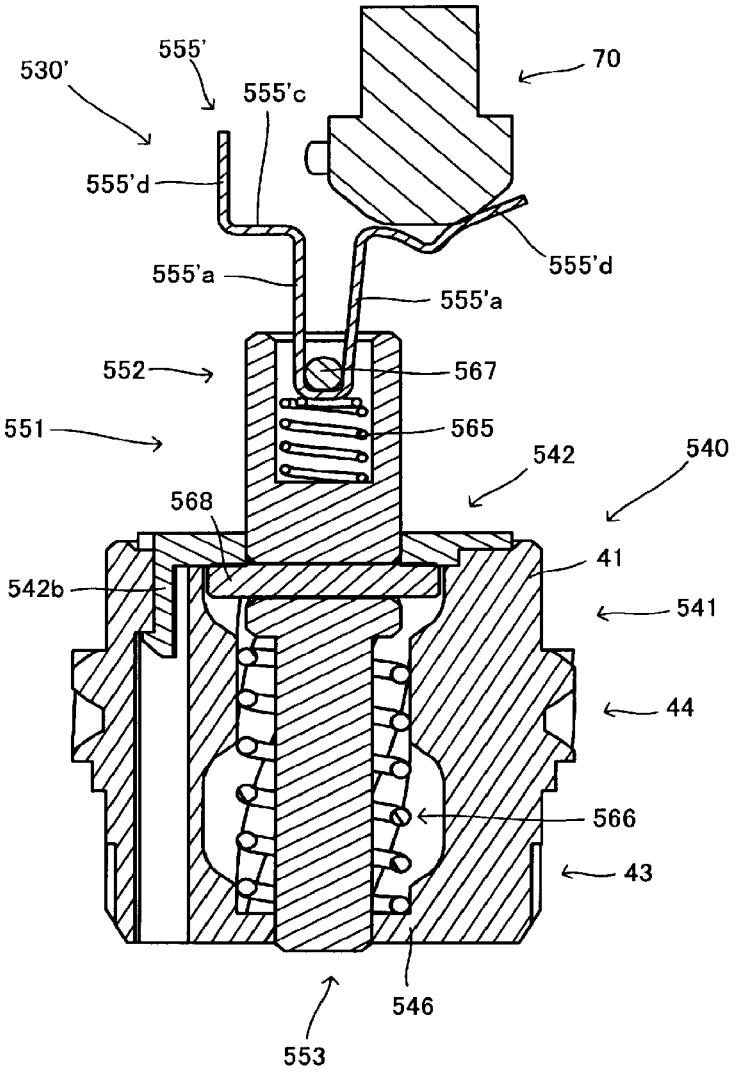
FIG. 50 is another sectional view along the shaft line of the end member 530'.

According to the end member 530', in addition to the effects similar to the above-described end member 530, as illustrated in FIG. 50, the engaging plate 555'*d* is elastically deformed and smoothly disengaged when being disengaged from the driving shaft 70. In addition, when the rotating force is transmitted in a state where the driving shaft 70 is engaged with the end member 530', as illustrated by Fk in FIG. 48, since the rotating force is transmitted in the plate width direction of the engaging plate 555'*d*, the rotating force is appropriately transmitted without largely deforming the engaging plate 555'*d*.

Any of the end members in each aspect described above can perform both the operation (for example, refer to FIG. 11) in which the shaft member moves in the shaft line direction as the shaft member rotates around the shaft line, and an operation (for example, refer to FIG. 14) in which the rotating force receiving member moves in the shaft line direction regardless of the rotation, by the action of the part formed in a spiral shape. Regarding this, only the "operation in which the shaft member moves in the shaft line direction as the shaft member rotates around the shaft line" may be performed by the action of the part formed in a spiral shape, but from the viewpoint of more smooth attachment and detachment of the process cartridge, the "operation in which the rotating force receiving member moves in the shaft line direction regardless of the rotation" may be added as an auxiliary operation. Therefore, in the present invention, only the "operation in which the shaft member moves in the shaft line direction as the shaft member rotates around the shaft line" may be performed. In addition, when the "operation in which the rotating force receiving member moves in the shaft line direction regardless of the rotation" is also employed, it is preferable that a force (for example, an elastic force of the tip end member elastic member 65) by the means which is provided for performing the operation, is weaker than a force (for example, an elastic force of a rotating shaft elastic member 66) by the means which is provided for performing the "operation in which the shaft member moves in the shaft line direction as the shaft member rotates around the shaft line".

Here, next, an example of an aspect which is configured only of the "operation in which the shaft member moves in the shaft line direction as the shaft member rotates around the shaft line" will be described.

Figure 51:
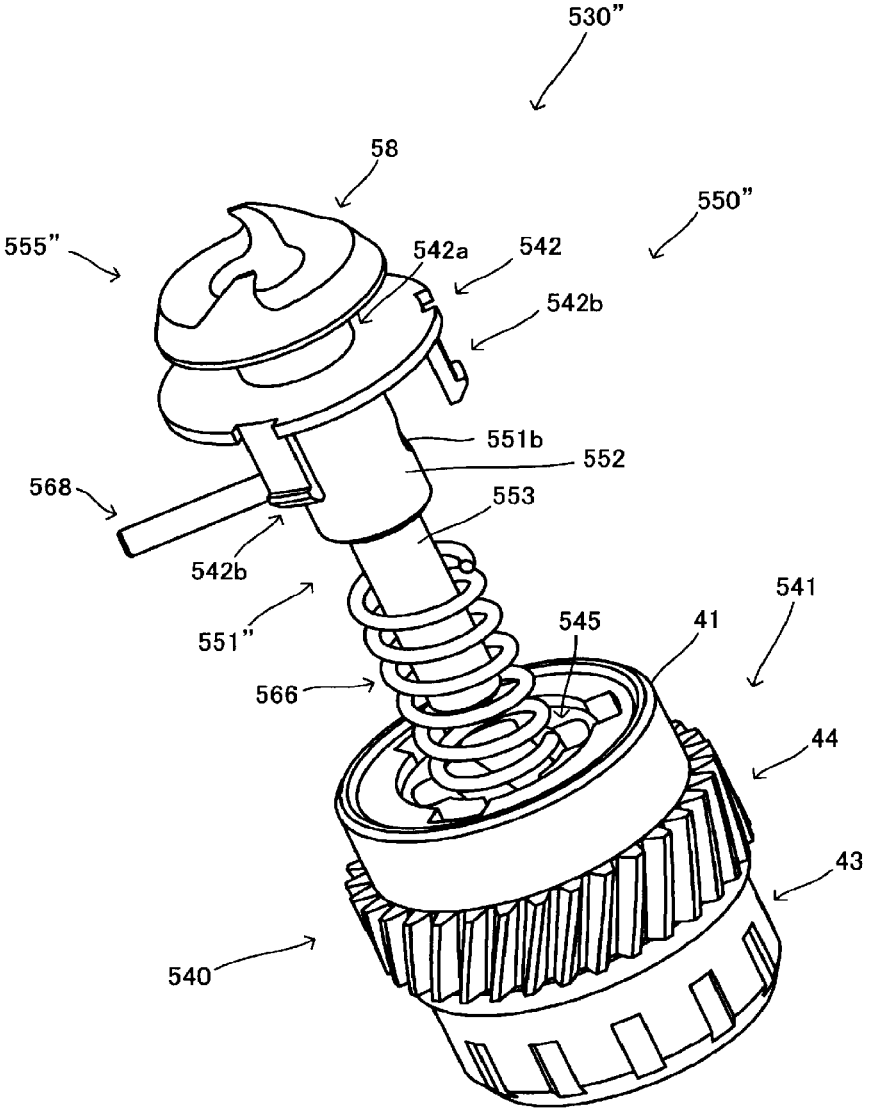
FIG. 51 is an exploded perspective view of an end member 530"
Figure 52:
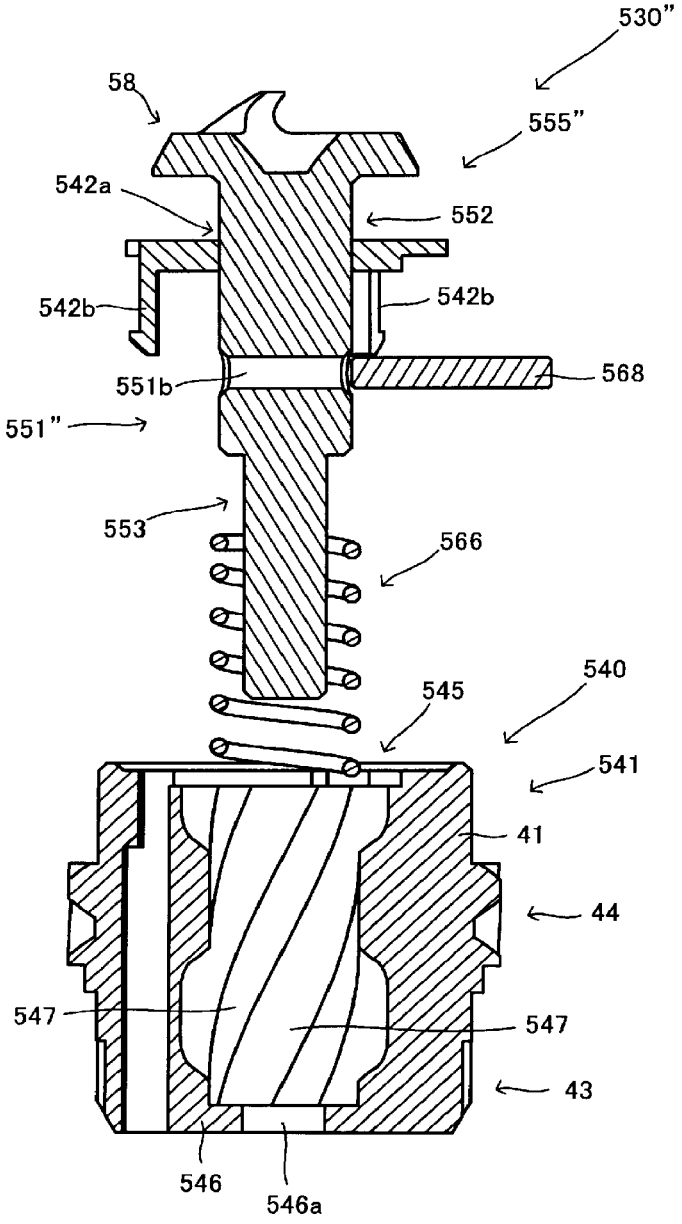
FIG. 52 is an exploded sectional view of the end member 530"
Figure 53:
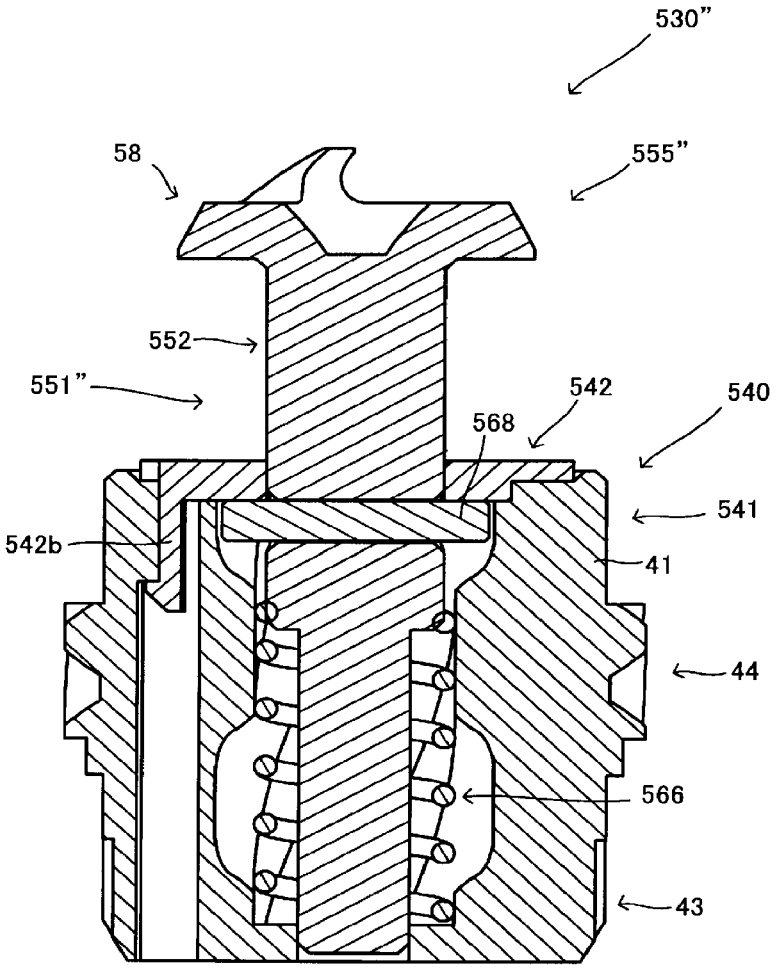
FIG. 53 is a sectional view of the end member 530"

FIGS. 51, 52, and 53 are views illustrating an end member 530" according to another modification example of the end member 530 of the fourth aspect. FIG. 51 is an exploded perspective view of the end member 530". FIG. 52 is an exploded sectional view along the shaft line direction of the end member 530". FIG. 53 is a sectional view along the shaft line direction of the end member 530" in which each member is combined. In the end member 530", a shaft member 550" is employed instead of the shaft member 550 of the end member 530. The bearing member 540 is the same as the bearing member 540 of the end member 530.

The shaft member 550" is formed to be integrated with a rotating shaft 551" and a tip end member 555", and is not provided with the tip end member elastic member 565. Therefore, the rotating shaft 551" and the tip end member 555" cannot relatively move, and move and rotate integrally all the time. Parts except this are the same as the shaft member 550. Therefore, in the example, the "operation in which the rotating force receiving member moves in the shaft line direction regardless of the rotation" cannot be performed, and the shaft member 550" becomes an end member only for performing the "operation in which the shaft member moves in the shaft line direction as the shaft member rotates around the shaft line" by the actions of the spiral groove 547 and the pin 568.

By the end member 530", since the relationship between the spiral groove 547 and the pin 568 can also act in accordance with the relationship between the spiral groove 547 and the pin 67 in the end member 30, the transmission of the rotating force equivalent to that in the related art can be performed, and more smooth attachment to and detachment from the apparatus body can be performed.

Figure 54:
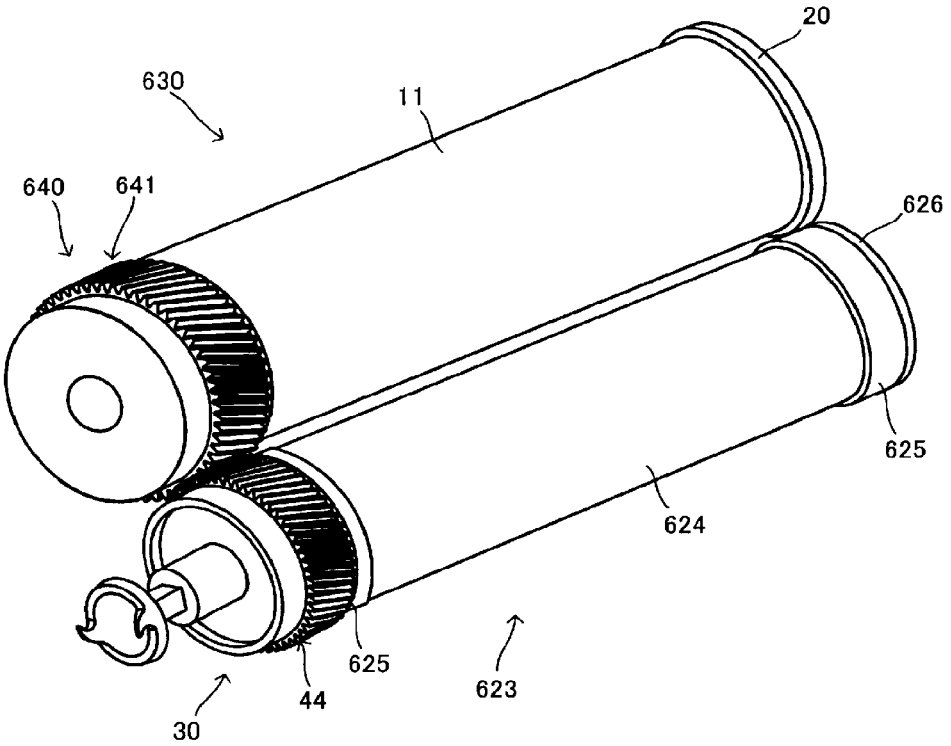
FIG. 54 is a perspective view illustrating an example in which the end member 30 is employed in a developing roller unit.

Above, aspects in which all of the described end members are disposed in the end portion of the photosensitive drum 11, and accordingly, the photosensitive drum unit is formed, are described. Meanwhile, as described in FIG. 2, the developing roller unit or the charging roller unit which is provided with another drum-like member is provided in the process cartridge. Here, in all of the end members according to the above-described aspects and the modification examples, instead of being disposed in the photosensitive drum, it is possible to be employed in the developing roller unit or the charging roller unit and receive the rotation driving force from the apparatus body. FIG. 54 is one aspect, and illustrates a developing roller unit 623 provided in the end member 30. FIG. 54 is a perspective view of a photosensitive drum unit 630 which is disposed to be adjacent to the developing roller unit 623, matching the developing roller unit 623.

The developing roller unit 623 is provided with a developing roller 624, a spacer ring 625, a lid member 626, a magnetic roller (not illustrated), and the end member 30. The end member 30 is as the description above. In addition, regarding other members, known members can be employed, but for example, the following configuration is provided.

The developing roller 624 is a member which covers a developing layer on the outer circumferential surface of the columnar rotating body. The developing roller 624 is a conductive cylinder made of aluminum or the like in the aspect, and here, the developing roller 624 is configured to be coated with the material which configures the developing layer.

The spacer ring 625 is a circular member which is disposed to be wound around the outer circumferential surface of each of both ends of the developing roller 624, and accordingly, a void between the developing roller 624 and the photosensitive drum 11 is held to be constant. The thickness of the spacer ring 625 is approximately from 200 μm to 400 μm.

Similar to the above-described lid member 20, the lid member 626 is disposed on one end side of the developing roller 624, and becomes a bearing for making the developing roller 624 rotate around the shaft line at one end of the developing roller unit 623.

The magnetic roller is not illustrated in FIG. 54 since the magnetic roller is disposed on the inside of the developing roller 624, but a plurality of magnetic poles are disposed along the shaft line by a roller formed of a resin, including a magnetic body or a non-magnetic body. Accordingly, by using magnetism, the developer can be adsorbed on a surface of the developing roller 624.

The end member 30 is as the description above, but the end member 30 is disposed in the end portion opposite to the end portion in which the lid member 626 is disposed among the end portions of the developing roller 624. Here, an example in which the end member 30 is employed is illustrated, but the invention is not limited thereto, and any other end members which are generally described can be employed.

In addition, at this time, the photosensitive drum unit 630 can be configured, for example, as follows. In other words, the photosensitive drum unit 630 is provided with the photosensitive drum 11, the lid member 20 which becomes a bearing for rotating the photosensitive drum 11 around the shaft line at each of both ends of the photosensitive drum 11, and an end member 640. At this time, the end member 640 is provided with a gear portion 641 which receives the rotating force being meshed with the gear portion 44 of the end member 30 disposed in the developing roller unit 623.

Above, each end member may be a configuration member included in the developing roller unit, and even in this case, each end member acts similar to those when the end members are provided in the photosensitive drum unit.

What is claimed is:

1. An end member to be disposed at an end portion of a columnar rotating body mounted on an image forming apparatus body, the end member comprising:

a tubular bearing member; and a shaft member held by the bearing member, wherein the shaft member includes:

a shaft-like rotating shaft which is disposed coaxially to the bearing member, and which rotates around a shaft line with respect to the bearing member to move in a direction of the shaft line; and a tip end member which is disposed coaxially to the rotating shaft, and at which a rotating force receiving member having a tip end provided with an engaging member which engages with a driving shaft of the image forming apparatus body is disposed, and a rotating force around the shaft line is transmitted to the rotating force receiving member, the rotating shaft, and the bearing member in order, wherein a recessed portion having a depth in the shaft line direction is formed on an end surface of the rotating force receiving member, and a side surface of the recessed portion is formed in a projected shape.

2. The end member according to claim 1, wherein at least one of the rotating shaft and the tip end member moves in a direction along the direction of the shaft line regardless of the rotation around the shaft line of the shaft member.

3. The end member according to claim 1, wherein a recessed portion having a depth in the shaft line direction is formed on an end surface of the rotating force receiving member, and a side surface of the recessed portion includes a spiral groove extending in a radial shape when viewed from the shaft line and being curved in a circumferential direction around the shaft line.

4. The end member according to claim 1, wherein the engaging member includes an inclined surface or a curved surface inclined to the shaft line direction.

5. The end member according to claim 1, wherein the engaging member includes a recessed portion with which the driving shaft is engaged.

6. The end member according to claim 1, wherein a part formed in a spiral shape is provided on an inner surface of the bearing member, and a member which moves inside the part formed in the spiral shape is provided in the rotating shaft, whereby the rotating shaft rotates around the shaft line with respect to the bearing member to move in the shaft line direction.

7. A photosensitive drum unit comprising a photosensitive drum as the columnar rotating body; and the end member according to claim 1, wherein the end member is disposed at least in one end portion of the photosensitive drum.

8. A process cartridge comprising:

a housing; and the photosensitive drum unit according to claim 7, wherein the photosensitive drum unit is held by the housing.

9. A developing roller unit comprising:

a developing roller as the columnar rotating body; and the end member according to claim 1, wherein the end member is disposed at least in one end portion of the developing roller.

10. A process cartridge comprising:

a housing; and the developing roller unit according to claim 9, wherein the developing roller unit is held by the housing.

11. An end member to be disposed at an end portion of a columnar rotating body mounted on an image forming apparatus body, the end member comprising:

a tubular bearing member; and a shaft member held by the bearing member, wherein the shaft member includes:

a shaft-like rotating shaft which is disposed coaxially to the bearing member, and which rotates around a shaft line with respect to the bearing member to move in a direction of the shaft line; and a tip end member which is disposed coaxially to the rotating shaft, and at which a rotating force receiving member having a tip end provided with an engaging member which engages with a driving shaft of the image forming apparatus body is disposed, and a rotating force around the shaft line is transmitted to the rotating force receiving member, the rotating shaft, and the bearing member in order, wherein a part formed in a spiral shape is provided on an inner surface of the rotating shaft, and a member which moves inside the part formed in the spiral shape is provided in the tip end member, whereby the tip end member rotates around the shaft line with respect to the rotating shaft to move in the shaft line direction.

12. The end member according to claim 11, wherein at least one of the rotating shaft and the tip end member moves in a direction along the direction of the shaft line regardless of the rotation around the shaft line of the shaft member.

13. A photosensitive drum unit comprising a photosensitive drum as the columnar rotating body; and the end member according to claim 11, wherein the end member is disposed at least in one end portion of the photosensitive drum.

14. A process cartridge comprising:

a housing; and the photosensitive drum unit according to claim 13, wherein the photosensitive drum unit is held by the housing.

* * * * *